US011821192B2

(12) United States Patent
Yang

(10) Patent No.: US 11,821,192 B2
(45) Date of Patent: Nov. 21, 2023

(54) WATER SPRAYING DEVICE, EFFUSER DEVICE, EFFUSER MOUNTING BOX THEREOF, AND TOILET THEREOF

(71) Applicant: Shanghai Kohler Electronics, Ltd., Shanghai (CN)

(72) Inventor: Dong Yang, Shanghai (CN)

(73) Assignee: Shanghai Kohler Electronics, Ltd., Shanghai (CN)

( * ) Notice: Subject to any disclaimer, the term of this patent is extended or adjusted under 35 U.S.C. 154(b) by 0 days.

(21) Appl. No.: 17/347,450

(22) Filed: Jun. 14, 2021

(65) Prior Publication Data

US 2021/0388593 A1 Dec. 16, 2021

(30) Foreign Application Priority Data

Jun. 16, 2020 (CN) ..... 202021116529.7
Sep. 4, 2020 (CN) ..... 202010924045.3
(Continued)

(51) Int. Cl.
*E03D 9/08* (2006.01)

(52) U.S. Cl.
CPC ..... *E03D 9/08* (2013.01)

(58) Field of Classification Search
CPC ..... E03D 9/08
(Continued)

(56) References Cited

U.S. PATENT DOCUMENTS 6,473,913 B1 * 11/2002 Bell, Sr. ..... A61H 33/6036 4/443
6,973,679 B1 * 12/2005 Schad ..... E03D 9/085 4/443
(Continued)

FOREIGN PATENT DOCUMENTS

CN 101851950 A 10/2010
CN 103041413 A 4/2013
(Continued)

OTHER PUBLICATIONS

Chinese Office Action from Chinese Patent No. 202010924045.3, dated Aug. 4, 2021, 14 pages. (including English summary).
(Continued)

*Primary Examiner* — Lori L Baker
(74) *Attorney, Agent, or Firm* — Lempia Summerfield Katz LLC

(57) ABSTRACT

A water spraying device comprises a housing comprising a mechanism mounting cavity, an effuser mounting cavity located at a front portion of the mechanism mounting cavity, and a water pipe accommodating cavity located at an upper portion of the mechanism mounting cavity and communicated with the effuser mounting cavity. The device also comprises an effuser comprising a nozzle and slidably arranged in the effuser mounting cavity; a water supply hose accommodated in the water pipe accommodating cavity and configured to supply water and move in the water pipe accommodating cavity; a driving mechanism mounted in the mechanism mounting cavity and configured to drive the effuser to move; and a transmission mechanism connecting the driving mechanism to the effuser. The housing comprises a housing water inlet and the effuser comprises an effuser water inlet. The water supply hose is connected between the housing water inlet and the effuser water inlet.

9 Claims, 32 Drawing Sheets

(30) Foreign Application Priority Data

Sep. 4, 2020 (CN) ..... 202010924059.5
Sep. 4, 2020 (CN) ..... 202021923715.1
Sep. 4, 2020 (CN) ..... 202021923793.1

(58) Field of Classification Search
USPC ..... 4/420.4, 420, 447–448
See application file for complete search history.

(56) References Cited

U.S. PATENT DOCUMENTS

| | | | | |
|---|---|---|---|---|
| 7,076,812 | B2 * | 7/2006 | Haberkorn | E03D 9/08 4/420.4 |
| 2013/0125300 | A1 * | 5/2013 | Xie | E03D 9/08 4/444 |
| 2013/0326803 | A1 * | 12/2013 | Maleki | B05B 9/01 4/448 |
| 2014/0143946 | A1 * | 5/2014 | Zhang | E03D 9/08 4/447 |
| 2015/0233105 | A1 * | 8/2015 | Slothower | E03D 9/085 4/448 |
| 2022/0154442 | A1 * | 5/2022 | Simon | E03D 9/08 |

FOREIGN PATENT DOCUMENTS

| | | | | | |
|---|---|---|---|---|---|
| CN | 104775490 | A | | 7/2015 | |
| CN | 105256869 | A | * | 1/2016 | A47K 7/08 |
| CN | 207959399 | U | | 10/2018 | |
| CN | 110219349 | A | | 9/2019 | |
| CN | 110454964 | A | | 11/2019 | |
| CN | 210032016 | U | | 2/2020 | |
| CN | 112196042 | B | | 3/2022 | |
| CN | 112227482 | B | | 3/2022 | |
| JP | H06212676 | A | | 8/1994 | |
| KR | 20130003018 | U | | 5/2013 | |

OTHER PUBLICATIONS

Chinese Office Action from Chinese Patent No. 202010924059.5, dated Aug. 11, 2021, 14 pages. (including English summary).
English Summary of Chinese Office Action from Chinese Patent Application No. 112196042, dated Mar. 25, 2022.
English Summary of Chinese Office Action from Chinese Patent Application No. 112227482, dated Mar. 22, 2022.

* cited by examiner

WATER SPRAYING DEVICE, EFFUSER DEVICE, EFFUSER MOUNTING BOX THEREOF, AND TOILET THEREOF

CROSS REFERENCE TO RELATED APPLICATION

This application claims the benefit of priority to: Chinese Patent Application No. 202021116529.7 filed in the Chinese Intellectual Property Office on Jun. 16, 2020, which is hereby incorporated by reference in its entirety; Chinese Patent Application No. 202010924059.5 filed in the Chinese Intellectual Property Office on Sep. 4, 2020, which is hereby incorporated by reference in its entirety; Chinese Patent Application No. 202010924045.3 filed in the Chinese Intellectual Property Office on Sep. 4, 2020, which is hereby incorporated by reference in its entirety; Chinese Patent Application No. 202021923793.1 filed in the Chinese Intellectual Property Office on Sep. 4, 2020, which is hereby incorporated by reference in its entirety; Chinese Patent Application No. 202021923715.1 filed in the Chinese Intellectual Property Office on Sep. 4, 2020, which is hereby incorporated by reference in its entirety.

FIELD

The present disclosure relates to a body flushing system used in an intelligent toilet, and more particularly, to a water spraying device and a toilet. The present disclosure also relates to the field of toilet technologies, and more particularly, to an effuser flusher. The present disclosure also relates to the field of intelligent toilet technologies, and more particularly, to an effuser device and a toilet. The present disclosure also relates to the field of technologies for mounting an effuser of a toilet, and more particularly, to an effuser mounting box and an effuser device. The present disclosure also relates to the field of toilet effuser technologies, and more particularly, to an effuser device.

BACKGROUND

A flushing module in a toilet generally has an open structure (referring to Chinese Patent Documents with application numbers of 201910608686.5 and 201110359958.6), and a freely exposed arrangement manner is adopted for a water supply hose. One end of the hose is connected to a water supply end (stationary), and the other end of the hose is connected to an effuser and reciprocates with the effuser. Because the hose is exposed, the hose will scratch with surrounding parts and components during movement, is easy to entangle with surrounding wiring harness, and is easy to cause wear and tear, resulting in pipe leakage.

Moreover, this freely exposed hose will take up a lot of space. Since one end of the hose is stationary, the other end is moving, and a middle portion of the hose will keep free rising, the hose sweeps a large area as a moving range when reciprocating, and the movement of the hose will occupy a large amount of space.

Toilets may have another technical problem. An effuser flusher is a component in an intelligent toilet, which includes an effuser, and the effuser may extend and retract, and is used for flushing a private part by a user.

Dirt may be adhered to a surface of the effuser during use, so that the effuser needs to be cleaned.

The effusers are all mounted on an open bracket, so that the effusers cannot be immersed and cleaned. Since a working environment of the effuser is relatively hidden and humid, bacteria, mildew, and odor are easily generated, so that user experience needs to be improved.

In light of this, it is necessary to provide the effuser flusher capable of immersing and cleaning the effuser.

Toilets may have another technical problem. An intelligent toilet generally includes an effuser, the effuser is mounted in an effuser box, and the effuser box is mounted at a back portion of a toilet body. The effuser is connected with a washing water channel, which may provide a user with a function of washing a private part.

In order to implement a washing function of the effuser, the effuser is usually mounted in the effuser box through a guiding rail, and then the effuser is driven to extend and retract through a driving mechanism. When the effuser extends forward from the effuser box, water may be sprayed through a nozzle at a front end of the effuser for washing by the user.

According to an intelligent toilet, extension and retraction of the effuser are mainly stopped through the driving mechanism, which lacks a structure for guiding and limiting the extension and retraction of the effuser, so that a performance needs to be improved.

Toilets may have another technical problem. As a common part in an intelligent toilet, an effuser is mounted in a toilet body via an effuser mounting box. A front end of the mounting box is provided with an effuser door (also called an end cover). The effuser can be telescopic in the effuser mounting box. When the effuser extends out to clean a private part of a user, a front end of the effuser needs to open the effuser door first. After the effuser retracts into the effuser mounting box, a reset spring on the effuser door drives the effuser door to reset.

The structure above has the following defects.

First, when the effuser extends out, it is necessary to overcome an acting force of a torsion spring on the effuser door, and the effuser does not extend smoothly.

Second, when the effuser extends out, it is necessary to be contacted with the effuser door, which will cause noise.

In light of this, it is necessary to provide an effuser mounting box and an effuser device which can realize automatic opening and closing of an effuser door.

Toilets may have another technical problem. An intelligent toilet is provided with an effuser, which can clean a private part of a user by spraying water through the effuser.

The effuser includes a telescopic effuser sleeve, a nozzle and a water supply hose. The effuser sleeve includes an outer sleeve and an inner sleeve, and the inner sleeve is slidably connected with the outer sleeve. The inner sleeve can be driven to extend and retract relative to the outer sleeve through a driving mechanism, such as an air cylinder, a motor, and the like. The nozzle is mounted at a front end of the inner sleeve, one end of the water supply hose is connected with an external water supply pipe, and the other end of the water supply hose passes through the outer sleeve and the inner sleeve, and then is connected with the nozzle. The water supply hose may move forward and backward with extension and retraction of the inner sleeve. When the inner sleeve retracts, a part of the water supply hose may be exposed outside a rear end of the outer sleeve, thus occupying a large amount of peripheral space. Moreover, the water supply hose may become tangled and curled, or interfere with surrounding parts.

In light of this, it is necessary to provide an effuser device which is beneficial for being arranged and mounted in an internal space of a toilet.

SUMMARY

The present disclosure aims at providing a water spraying device which can accommodate and limit a water supply hose, and a toilet.

The technical solutions of the present disclosure provide a water spraying device, including a housing, an effuser with a nozzle, a water supply hose for supplying water, and a driving mechanism for driving the effuser to move linearly. The housing includes a mechanism mounting cavity, an effuser mounting cavity, and a water pipe accommodating cavity. The water pipe accommodating cavity is located above the mechanism mounting cavity, the effuser mounting cavity is located on a front side of the mechanism mounting cavity, and the water pipe accommodating cavity is communicated with the effuser mounting cavity. The driving mechanism is mounted in the mechanism mounting cavity, the effuser is slidably arranged in the effuser mounting cavity, and the driving mechanism is connected with the effuser through a transmission mechanism. The housing is provided with a housing water inlet, and the effuser is provided with an effuser water inlet. The water supply hose is connected between the housing water inlet and the effuser water inlet, and the water supply hose is at least partially accommodated in the water pipe accommodating cavity and is capable of moving in the water pipe accommodating cavity.

Further, the water pipe accommodating cavity extends in a horizontal direction. A height of the water pipe accommodating cavity is smaller than a length of the water pipe accommodating cavity in a front-back direction.

Further, the housing water inlet is located on a front side of the water pipe accommodating cavity, and the water supply hose is curved in the water pipe accommodating cavity.

Further, the water supply hose is coated with a hose sheath.

Further, the effuser has an initial position and a forward position in the effuser mounting cavity and is capable of being switched between the initial position and the forward position. When the effuser is located in the forward position, the water supply hose is at least partially located in the water pipe accommodating cavity.

Further, the water supply hose is at least partially kept in contact with a top surface of the water pipe accommodating cavity.

Further, the driving mechanism includes a drive motor; the transmission mechanism includes a transmission gear set and a transmission chain. An output shaft of the drive motor is connected with a gear shaft of an input end gear in the transmission gear set. The transmission chain is meshed with an output end gear in the transmission gear set and the transmission chain is also fixedly connected with the effuser.

Further, the housing is formed by a first housing interfacing with a second housing.

Further, a guide mechanism is mounted in the effuser mounting cavity, and the effuser is slidably connected with the guide mechanism.

The technical solutions of the present disclosure further provide a toilet, which includes the water spraying device described in any of the above technical solutions.

By employing the foregoing technical solutions, the present disclosure has the following beneficial effects.

By arranging the water pipe accommodating cavity, the water spraying device and the toilet disclosed by the present disclosure enable the water supply hose to be accommodated in the water pipe accommodating cavity and move in the water pipe accommodating cavity with extending and retracting of the effuser. This may protect the water supply hose, avoid interference or friction between the water supply hose and surrounding parts, also reduce a vertical space occupied by the water supply hose during moving, reduce a height of the whole water spraying device, reduce a volume, save a space. This may be more beneficial to design, mounting, and use of the intelligent toilet.

The technical solutions of the present disclosure also provide an effuser flusher, which includes an effuser, an effuser box, a first water supply pipe for supplying washing water, and a second water supply pipe for supplying cleaning water. The effuser box includes a box body with a front end provided with a box body opening and a box cover pivotally mounted on the box body and capable of controlling opening and closing of the box body opening. The first water supply pipe is connected with a rear end of the effuser, and a front end of the effuser is provided with a nozzle. The effuser is mounted in a box body cavity of the box body and an end portion of the effuser with the nozzle is capable of extending forward and retracting backward through the box body opening. The second water supply pipe is communicated with the box body cavity and/or the second water supply pipe is communicated with the effuser. Under a state that the box cover closes the box body opening, the cleaning water in the second water supply pipe is capable of entering the box body cavity and immersing the effuser. Under a state that the box cover opens the box body opening, the cleaning water in the box body cavity is capable of being discharged through the box body opening.

In one embodiment, a cavity water inlet pipe communicated with the box body cavity is arranged on the box cover or the box body and the second water supply pipe is connected with the cavity water inlet pipe. The cleaning water in the second water supply pipe is capable of entering the box body cavity through the cavity water inlet pipe and immersing the effuser.

In one embodiment, the second water supply pipe is connected with a water inlet of the effuser or the second water supply pipe is connected with the first water supply pipe. The cleaning water in the second water supply pipe is capable of entering the box body cavity through the effuser and the nozzle and immersing the effuser.

In one embodiment, a sealing ring is arranged between the box cover and a peripheral edge of the box body opening.

In one embodiment, a front end of a box body bottom plate of the box body is provided with a flow guide plate obliquely extending forward and downward.

In one embodiment, a box cover driving mechanism for driving the box cover to overturn around a pivot shaft is arranged on the box body and an output end of the box cover driving mechanism is connected with the box cover.

In one embodiment, the output end of the box cover driving mechanism is an output end rotating wheel. One side of the box cover close to the output end rotating wheel is provided with a box cover side plate and the box cover side plate extends towards a rear end of the box body. A side plate pin shaft extending towards the output end rotating wheel is arranged on the box cover side plate. One side of the output end rotating wheel facing the box cover side plate is provided with a guiding groove for guiding opening and closing of the box cover. One end of the side plate pin shaft is matched in the guiding groove and is capable of sliding in the guiding groove.

In one embodiment, the guiding groove includes a first guiding groove with a curve contour line and a second guiding groove with a smooth arc contour line. The second guiding groove is communicated with the first guiding groove. When the side plate pin shaft slides in the first guiding groove, the box cover is capable of being switched between an opened state and a closed state. When the side plate pin shaft slides in the second guiding groove, the box cover is capable of being kept in the opened state.

In one embodiment, the effuser is slidably mounted in the box body cavity. An effuser bulge extends from the effuser towards the box body side plate of the box body and a guide groove is arranged on the box body side plate. The effuser bulge is matched in the guide groove, and is capable of sliding in the guiding groove. An effuser driving mechanism for driving the effuser to slide in the box body cavity is further arranged on the box body. An output end of the effuser driving mechanism is connected with the effuser.

In one embodiment, the effuser is capable of extending and retracting. The effuser includes at least two sections of pipe bodies and two adjacent sections of pipe bodies are connected in a sliding and sealing manner.

By adopting the above technical solutions, the present disclosure has the following beneficial effects.

According to the effuser flusher provided by the present disclosure, the box cover is mounted at the box body opening of the box body, when the box cover is closed, the box body cavity can be sealed by the box cover. When the effuser retracts into the box body cavity after use, the cleaning water may be supplied through the second water supply pipe, the cleaning water may enter the box body cavity through the second water supply pipe and immerse the effuser, and after immersing for a period of time, the surface of the effuser can be cleaned and disinfected. After cleaning, the box cover is opened again, so that waste water in the box body cavity is discharged into a ceramic toilet, which means that immersion cleaning and disinfection of the effuser is completed after using. This may effectively prevent generation of bacteria, mildew, and odor, and thus improve user experience.

The present disclosure also aims to provide an effuser device capable of guiding and limiting movement of an effuser and a toilet.

The technical solutions of the present disclosure also provide an effuser device, which includes an effuser mounting portion, an effuser capable of moving back and forth relative to the effuser mounting portion, and a driving mechanism for driving the effuser to move. An output end of the driving mechanism is connected with the effuser. A guiding mechanism for guiding and limiting movement of the effuser is arranged between a side portion of the effuser and the effuser mounting portion of an effuser box. The guiding mechanism includes a first convex portion and a second convex portion which are arranged on the effuser or the effuser mounting portion at an interval back and forth and a first guiding groove and a second guiding groove which are arranged on the effuser mounting portion or the effuser at an interval back and forth. The first convex portion is in clearance fit in the first guiding groove and the second convex portion is in clearance fit in the second guiding groove. The effuser has an initial position in a contained state and a terminal position in an extended state. When the effuser is located in the initial position, the first convex portion is contacted with one end of the first guiding groove and the second convex portion is contacted with one end of the second guiding groove. When the effuser is located in the terminal position, the first convex portion is contacted with the other end of the first guiding groove, and the second convex portion is contacted with the other end of the second guiding groove.

In one embodiment, the first convex portion and the second convex portion are cylinders or rollers respectively.

In one embodiment, the effuser device includes two effuser mounting portions, the effuser is located between the two effuser mounting portions, and the effuser is connected with each effuser mounting portion through the guiding mechanism.

In one embodiment, the first convex portion and the second convex portion are arranged on a side portion of the effuser and the first guiding groove and the second guiding groove are arranged on the effuser mounting portion. The first convex portion and the second convex portion respectively and correspondingly have a first convex portion initial position, a second convex portion initial position, a first convex portion terminal position, and a second convex portion terminal position on the effuser mounting portion. The first guiding groove is connected between the first convex portion initial position and the first convex portion terminal position and the second guiding groove is connected between the second convex portion initial position and the second convex portion terminal position.

In one embodiment, the first guiding groove is a first linear groove, and the second guiding groove is a second linear groove. In a direction from back to front, the first linear groove gradually extends downwardly and obliquely and the second linear groove gradually extends upwardly and obliquely.

In one embodiment, the first guiding groove is a first arc groove and the second guiding groove is a second arc groove. Two sides of an opening of the first arc groove are the first convex portion initial position and the first convex portion terminal position. Two sides of an opening of the second arc groove are the second convex portion initial position and the second convex portion terminal position. The second convex portion terminal position is located above the first convex portion initial position. In a direction from back to front, a connecting line between the first convex portion initial position and the first convex portion terminal position gradually extends downwardly and obliquely and a connecting line between the second convex portion initial position and the second convex portion terminal position gradually extends upwardly and obliquely.

In one embodiment, the first arc groove is a first minor arc groove, a first semi-arc groove, or a first major arc groove. Correspondingly, the second arc groove is a second minor arc groove, a second semi-arc groove, or a second major arc groove.

In one embodiment, an effuser height limiting plane is arranged above the effuser. The second minor arc groove is tangent to the effuser height limiting plane and a tangent point between the second minor arc groove and the effuser height limiting plane is a second minor arc groove tangent point.

In one embodiment, the effuser height limiting plane is a bottom surface of an effuser box top plate.

In one embodiment, a tangent line of a vertex of the first minor arc groove passes through the second minor arc groove tangent point. A length of the tangent line between the vertex and the second minor arc groove tangent point is equal to a length of the effuser. An included angle between the effuser in the terminal position and the effuser in the initial position is $\alpha$, wherein $0<\alpha<90°$. An included angle between the tangent line and the effuser in the initial position is $\beta$, wherein $0<\beta<90°$. Then, $\beta$ is smaller than $\alpha$.

The technical solutions of the present disclosure also provide a toilet, including any of the effuser devices described above.

By adopting the above technical solutions, the present disclosure has the following beneficial effects.

According to the nozzle device and the toilet provided by the present disclosure, the guiding mechanism is arranged between the effuser and the effuser mounting portion to guide and limit the movement of the effuser. The guiding mechanism includes the first convex portion, the second convex portion, the first guiding groove, and the second guiding groove. The first convex portion and the second convex portion may be selectively arranged on the side portion of the effuser, and thus the first guiding groove and the second guiding groove are arranged on the effuser mounting portion. The first convex portion and the second convex portion may be selectively arranged on the effuser mounting portion, and thus the first guiding groove and the second guiding groove are arranged on the side portion of the effuser. The first guiding groove and the second guiding groove guide and limit the first convex portion and the second convex portion synchronously, so that the movement track of the effuser may be limited and the movement of the effuser can meet needs of a user.

The technical solutions of the present disclosure also provide an effuser mounting box, including a box body for mounting an effuser, an effuser door pivotally connected with the box body and a driving mechanism for driving the effuser door to turn upward and downward. A front end of the box body is provided with a box body opening for the effuser to extend out. An upper end of the effuser door is connected with the box body and the effuser door is capable of opening and closing the box body opening. The driving mechanism is mounted on the box body and an output end of the driving mechanism is connected with the effuser door.

Further, the output end of the driving mechanism is an output end rotating wheel. One side of the effuser door close to the output end rotating wheel is provided with a side plate of the effuser door, and the side plate of the effuser door extends towards a rear end of the box body. The side plate of the effuser door is provided with a side plate pin shaft extending towards the output end rotating wheel. One side of the output end rotating wheel facing the side plate of the effuser door is provided with a guiding groove. One end of the side plate pin shaft is matched in the guiding groove and is capable of sliding in the guiding groove.

Further, the guiding groove includes a first guiding groove with a curved contour line. The first guiding groove comprises an initial end of the first guiding groove and a terminal end of the first guiding groove. The first guiding groove extends from a middle portion to an edge on the output end rotating wheel, and the terminal end of the first guiding groove is located outside the initial end of the first guiding groove. When the side plate pin shaft is located in the initial end of the first guiding groove, the effuser door is in a closed state. When the side plate pin shaft is located between the initial end of the first guiding groove and the terminal end of the first guiding groove, the effuser door is in a partially opened state. When the side plate pin shaft is located in the terminal end of the first guiding groove, the effuser door is in a completely opened state.

Further, in a direction from the initial end of the first guiding groove to the terminal end of the first guiding groove, a radius of curvature of the first guiding groove is gradually increased.

Further, the guiding groove further includes a second guiding groove with a smooth arc contour line. The second guiding groove is concentrically arranged with a central axis of the output end rotating wheel. One end of the second guiding groove is communicated with the terminal end of the first guiding groove. A distance between the terminal end of the first guiding groove and the central axis of the output end rotating wheel is D, a radius of the second guiding groove is R, then R=D. When the side plate pin shaft is located in the second guiding groove, the effuser door is kept in the completely opened state.

Further, a central angle of the second guiding groove is $\alpha$, then $180° \leq \alpha < 360°$.

Further, the driving mechanism further includes a drive motor and a transmission device and the transmission device is connected between the output end rotating wheel and the drive motor.

Further, a circumference surface of the output end rotating wheel is provided with a circle of wheel teeth and the transmission device includes a transmission device output gear, and the transmission device output gear is meshed with the output end rotating wheel.

Further, the output shaft of the drive motor is provided with a motor gear. The transmission device further includes a transmission device input gear and a transmission device drive gear, and the transmission device drive gear is in transmission connection with the transmission device input gear. The transmission device input gear is meshed with the motor gear, and the transmission device drive gear is meshed with the transmission device output gear.

The technical solutions of the present disclosure further provide an effuser device, including a telescopic effuser and the effuser mounting box described in any of the above technical solution. The effuser is mounted in the box body of the effuser mounting box. When the effuser is in a retracted state, the effuser is integrally located in the box body and the effuser door closes the box body opening of the box body. When the effuser is in an extended state, the effuser door opens the box body opening of the box body and an end portion of the effuser provided with a nozzle extends from the box body opening.

By employing the foregoing technical solutions, the present disclosure has the following beneficial effects.

According to the effuser mounting box and the effuser device provided by the present disclosure, the output end of the driving mechanism is connected with the effuser door by setting the driving mechanism and the driving mechanism opens the effuser door before the effuser needs to extend, so that the effuser can smoothly extend from the box body opening without being contacted with the effuser door. After the effuser retracts, the driving mechanism drives the effuser door to close. During extending and retracting of the effuser, the effuser is unable to touch the effuser door, so that the extending movement of the effuser is smoother and the effuser is unable to be in frictional contact with the effuser door. Thus, this may reduce the noise during system operation.

A technical solution of the present disclosure also provides an effuser device, including a telescopic protection sleeve, a telescopic water supply casing and a nozzle with a water flow channel. The protection sleeve includes an outer sleeve and an inner sleeve slidably connected with the outer sleeve. The water supply casing includes an outer casing and an inner casing slidably connected with the outer casing. A sleeve end cover is mounted at one end of the outer sleeve, the sleeve end cover is provided with a water pipe joint for being connected with an external water supply pipe, and one end of the inner sleeve far away from the sleeve end cover is provided with a liquid spraying hole. The nozzle is mounted in the inner sleeve, and a water outlet end of the water flow channel is communicated with the liquid spraying hole. The outer casing is fixedly mounted in the outer sleeve, and one end of the outer casing is connected with the water pipe joint. One end of the inner casing is slidably mounted in the outer casing, and the other end of the inner casing is connected with a water inlet end of the water flow channel.

Further, the effuser device includes more than two water supply casings. Accordingly, the sleeve end cover is provided with more than two water pipe joints, the nozzle includes more than two water flow channels, and the inner sleeve is provided with more than two liquid spraying holes. Each outer casing is correspondingly connected with one water pipe joint, each inner casing is correspondingly connected with the water inlet end of one water flow channel, and the water outlet end of each water flow channel is correspondingly communicated with one liquid spraying hole.

Further, a sealing ring is arranged between the inner casing and the outer casing.

Further, one end of the inner casing facing the sleeve end cover is provided with a casing boss. The casing boss is in clearance fit with a wall of the outer casing. An end portion of the outer casing facing the nozzle is provided with an annular baffle for stopping the casing boss.

Further, the sealing ring is arranged between the casing boss and the wall of the outer casing.

Further, one end of the inner sleeve facing the sleeve end cover is provided with an inner sleeve boss. The inner sleeve boss is in clearance fit with a wall of the outer sleeve. An end portion of the outer sleeve facing the nozzle is provided with an outer sleeve boss for stopping the inner sleeve boss.

Further, the inner sleeve has an inner sleeve extended state and an inner sleeve retracted state. When the inner sleeve is in the inner sleeve retracted state, the end portion of the inner sleeve provided with the liquid spraying hole is located outside the outer sleeve and at least one liquid spraying hole is located outside the outer sleeve.

Further, the inner casing has an inner casing extended state and an inner casing retracted state. When the inner sleeve is in the inner sleeve retracted state, the inner casing is in the inner casing extended state, the inner sleeve extends from the outer sleeve and the inner casing extends from the outer casing. When the inner sleeve is in the inner sleeve retracted state, the inner casing is in the inner casing retracted state, a part of the inner sleeve retracts into the outer sleeve, and at least a part of the inner casing retracts into the outer casing.

Further, when the inner casing is in the inner casing retracted state, the whole inner casing retracts into the outer casing.

Further, the inner casing and the outer casing are hard water pipes respectively.

By employing the foregoing technical solutions, the present disclosure has the following beneficial effects.

According to the effuser device provided by the present disclosure, the telescopic water supply casing is arranged in the telescopic protection sleeve, the outer casing of the water supply casing is fixedly mounted in the outer sleeve of the protection sleeve, the inner casing of the water supply casing is located in the inner sleeve of the protection sleeve, the water inlet of the outer casing is connected with the water pipe joint on the sleeve end cover, and the water outlet of the inner sleeve is connected with the water inlet end of the water flow channel of the nozzle. When the inner sleeve extends and retracts, the inner casing extends and retracts synchronously with the inner sleeve and the water supply casing is always kept in the protection sleeve. Thus, this may effectively save an external space of the protection sleeve and is beneficial to spatial layout of other functions of an intelligent toilet and mounting of the effuser device.

DETAILED DESCRIPTION

Figure 1:
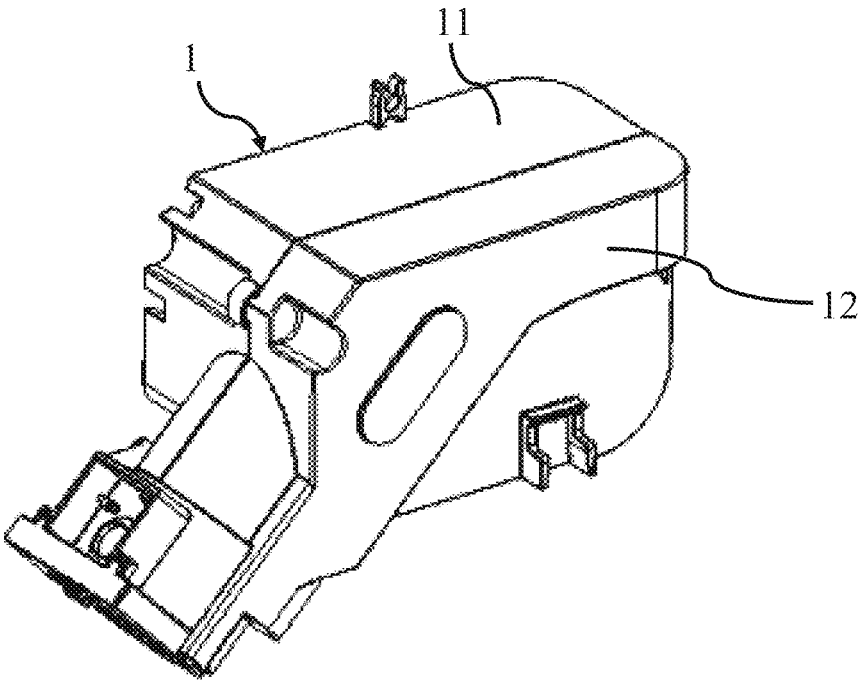
FIG. 1 is a perspective view of a water spraying device provided by an embodiment of the present disclosure.

The specific embodiments of the present disclosure is further described with reference to the drawings hereinafter. Same parts are denoted by same reference numerals. It should be noted that the terms "front", "back", "left", "right", "up", and "down" used in the following description refer to the directions in the accompanying drawings, and the terms "inner" and "outer" refer to the directions toward or far away from geometric centers of a specific parts respectively.

First Embodiment: Water Spraying Device and Toilet

Figure 2:
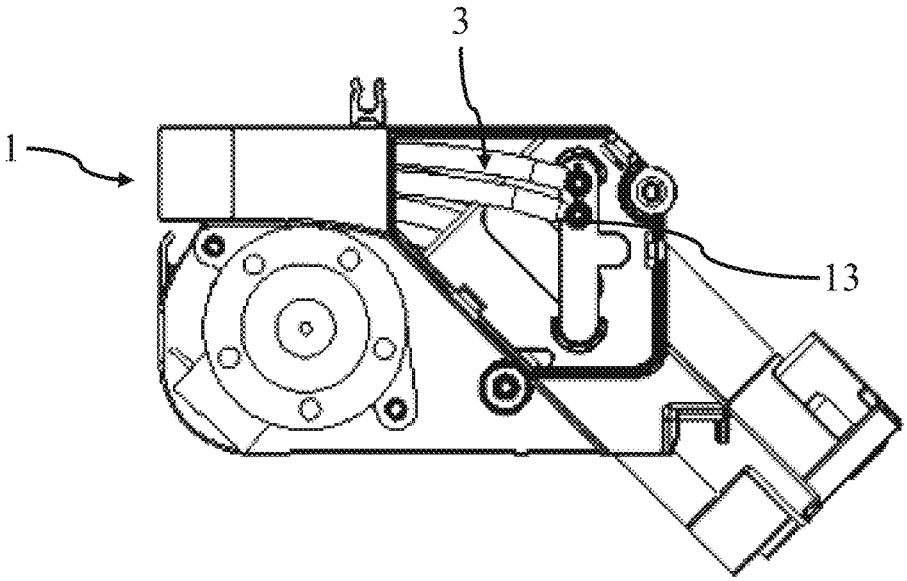
FIG. 2 is a rear view of the water spraying device shown in FIG. 1.
Figure 3:
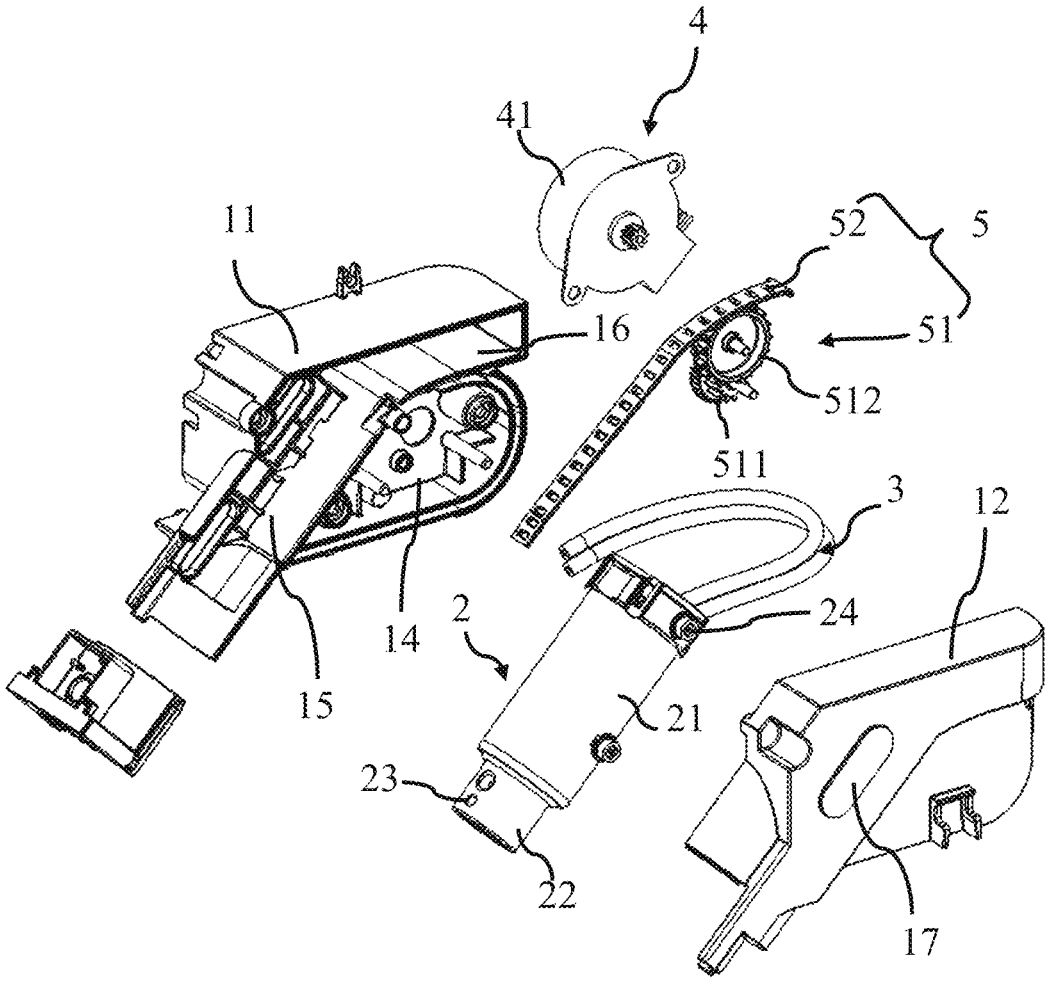
FIG. 3 is an exploded view of the water spraying device shown in FIG. 1.
Figure 4:
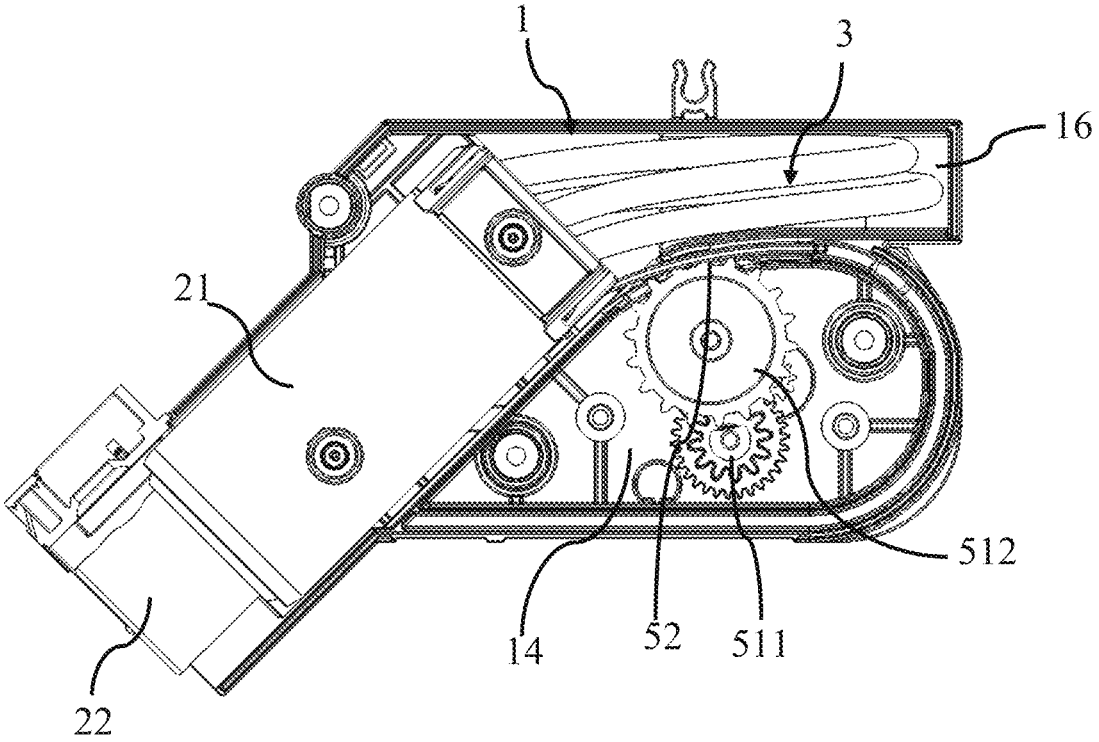
FIG. 4 is a schematic diagram showing that most of a water supply hose is accommodated in a water pipe accommodating cavity when an effuser is in a retracted state.
Figure 5:
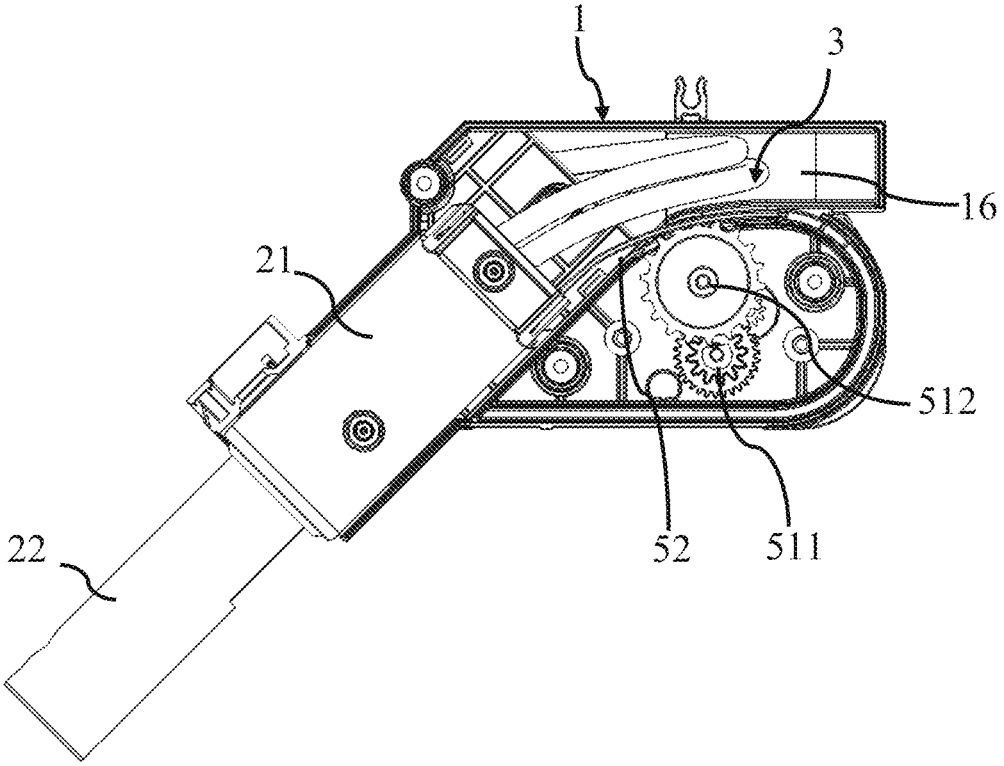
FIG. 5 is a schematic diagram showing that a portion of the water supply hose is kept accommodated in the water pipe accommodating cavity when the effuser is in an extended state.

FIG. 1 is a perspective view of a water spraying device provided by an embodiment of the present disclosure. FIG. 2 is a rear view of the water spraying device shown in FIG. 1. FIG. 3 is an exploded view of the water spraying device shown in FIG. 1. FIG. 4 is a schematic diagram showing that most of a water supply hose is accommodated in a water pipe accommodating cavity when an effuser is in a retracted state. FIG. 5 is a schematic diagram showing that a portion of the water supply hose is kept accommodated in the water pipe accommodating cavity when the effuser is in an extended state.

As shown in FIGS. 1 to 5, a water spraying device provided by an embodiment of the present disclosure includes a housing 1, an effuser 2 with a nozzle 23, a water supply hose 3 for supplying water, and a driving mechanism 4 for driving the effuser 2 to move linearly.

The housing 1 includes a mechanism mounting cavity 14, an effuser mounting cavity 15 and a water pipe accommodating cavity 16.

The water pipe accommodating cavity 16 is located above the mechanism mounting cavity 14, the effuser mounting cavity 15 is located on a front side of the mechanism mounting cavity 14, and the water pipe accommodating cavity 16 is communicated with the effuser mounting cavity 15.

The driving mechanism 4 is mounted in the mechanism mounting cavity 14, the effuser 2 is slidably arranged in the effuser mounting cavity 15, and the driving mechanism 4 is connected with the effuser 2 through a transmission mechanism 5.

The housing 1 is provided with a housing water inlet 13, and the effuser 2 is provided with an effuser water inlet.

The water supply hose 3 is connected between the housing water inlet 13 and the effuser water inlet, and the water supply hose 3 is at least partially accommodated in the water pipe accommodating cavity 16 and is capable of moving in the water pipe accommodating cavity 16.

The water spraying device provided by the present disclosure is mainly mounted at a rear portion of the toilet and sprays water through the nozzle, so that the water is used by a user to clean a private part.

The water spraying device mainly includes the housing 1, the effuser 2, the water supply hose 3 and the driving mechanism 4.

The housing 1 is used to provide a mounting cavity for mounting various parts and components. The housing 1 includes the mechanism mounting cavity 14, the effuser mounting cavity 15 and the water pipe accommodating cavity 16. The mechanism mounting cavity 14 is located in a middle lower portion of the housing 1, the water pipe accommodating cavity 16 is located above the mechanism mounting cavity 14, and the water pipe accommodating cavity 16 is separated from the mechanism mounting cavity 14 by a baffle. The effuser mounting cavity 15 is located on the front side of the mechanism mounting cavity 14, the effuser mounting cavity 15 is located obliquely below a front side of the water pipe accommodating cavity 16, and the water pipe accommodating cavity 16 is communicated with the effuser mounting cavity 15.

A front end of the effuser 2 is provided with the nozzle 23, and an interior of the effuser 2 is provided with a waterway. The effuser 2 is mounted in the effuser mounting cavity 15 and is capable of sliding in the effuser mounting cavity 15 to realize forward movement and reset of the effuser 2.

When the effuser 2 moves forward, the nozzle 23 may extend out of the effuser mounting cavity 15 for spraying water.

The driving mechanism 4 is mounted in the mechanism mounting cavity 14. The driving mechanism 4 is connected with the effuser 2 through the transmission mechanism 5 for driving the effuser 2 to reciprocate in the effuser mounting cavity 15.

The housing water inlet 13 is arranged at a side portion of the housing 1, and a rear end of the effuser 2 or one end of the effuser facing the water pipe accommodating cavity 16 is provided with the effuser water inlet.

One end of the water supply hose 3 is connected with the housing water inlet 13, and the other end of the water supply hose is connected with the effuser water inlet. A portion or most of the water supply hose 3 is accommodated in the water pipe accommodating cavity 16. When the effuser 2 moves back and forth, the portion of the water supply hose 3 in the water pipe accommodating cavity 16 can move in the water pipe accommodating cavity 16 to adapt to the movement of the effuser 2.

During a whole working cycle when the effuser 2 extends and retracts, the water supply hose 3 is restricted to move in the water pipe accommodating cavity 16, so that the water supply hose 3 does not contact and rub with external surrounding parts and wiring harnesses, thus protecting the water supply hose 3.

In the present disclosure, the forward movement or backward movement of the effuser 2 is only a relative concept, and not only refers to the forward movement and backward movement in the horizontal direction. To meet the requirement of a water spraying angle of the nozzle 23, the effuser 2 may be obliquely arranged. The effuser 2 may move downward and forward, such that the nozzle extends out. The effuser 2 may move upward and backward, such that the nozzle retracts.

In the present disclosure, the driving mechanism 4 may be a motor, and the transmission mechanism 5 can be a gear combination, a connecting rod combination, or the like.

In one embodiment, as shown in FIGS. 3 to 5, the water pipe accommodating cavity 16 extends in the horizontal direction. A height of the water pipe accommodating cavity 16 is smaller than a length of the accommodating cavity 16 in a front-back direction.

With this arrangement, the water pipe accommodating cavity 16 is flat, which can reduce a vertical space occupied by the water supply hose 3 when moving, reduce a height of the whole water spraying device, reduce a volume, save a space, and be more beneficial to design, mounting and use of the intelligent toilet.

In one embodiment, as shown in FIGS. 2 to 5, the housing water inlet 13 is located at the front side of the water pipe accommodating cavity 16, and the water supply hose 3 is curved in the water pipe accommodating cavity 16.

One end of the water supply hose 3 is fixedly connected with the housing water inlet 13 and remains stationary, while the other end of the water supply hose 3 is connected with the effuser water inlet and can move along with the movement of the effuser 2. A main portion of the water supply hose 3 is located in the water pipe accommodating cavity 16, and is bent or curved, so that a lateral size of the water pipe accommodating cavity 16 can be reduced.

Generally, the housing water inlet 13 and the effuser water inlet are both located at the front side of the water pipe accommodating cavity 16, and the water supply hose 3 is bent into a U shape, which will not affect the flowing of the water.

In one embodiment, the water supply hose 3 is coated with a hose sheath. The hose sheath may be a rubber hose, which covers the water supply hose 3 to protect the water supply hose 3 and prevent the water supply hose 3 from being rubbed by a cavity wall of the water pipe accommodating cavity 16 when moving.

In one embodiment, as shown in FIGS. 3 to 5, the effuser 2 has an initial position and a forward position and is capable of being switched between the initial position and the forward position.

When the effuser 2 is located in the forward position, the water supply hose 3 is at least partially located in the water pipe accommodating cavity 16.

With this arrangement, it can be ensured that even if the effuser 2 moves forward, a portion of the water supply hose 3 will always be located in the water pipe accommodating cavity 16, and the whole water supply hose 3 will not be separated from the water pipe accommodating cavity 16. When the effuser 2 retreats, since the water supply hose 3 is not separated from the water pipe accommodating cavity 16, the water supply hose 3 can retreat in the water pipe accommodating cavity 16, thereby being restricted to move in the water pipe accommodating cavity 16.

In one embodiment, as shown in FIGS. 3 to 5, the effuser 2 has a telescopic structure, and includes an outer pipe 21 and an inner pipe 22 slidably connected with the outer pipe 21. The nozzle 23 is arranged at a front end of the inner pipe 22. The inner pipe 22 can slide back and forth relative to the outer pipe 21. The outer pipe 21 is mounted in the effuser mounting cavity 15 and can slide. When the outer pipe 21 moves forward to a designated position, the effuser 2 is located in the forward position, the inner pipe 22 extends out of the outer pipe 21, and the nozzle 23 extends out to spray water. When the outer pipe 21 moves backward to a designated position, the effuser 2 is located in the initial position, the inner pipe 22 retracts into the outer pipe 21, and the nozzle 23 retracts.

With this arrangement, a telescopic amount of the effuser 2 can be increased to satisfy telescoping requirements when being mounted on the toilet.

The inner pipe 22 may be driven to extend out by water or a driving member, and may be driven to retract by a resetting member. The arrangement of the inner pipe and the outer pipe may refer to the contents in the related art, and which will not be elaborated herein.

In one embodiment, as shown in FIGS. 4 and 5, the water supply hose 3 is at least partially kept in contact with a top surface of the water pipe accommodating cavity 16, and the water supply hose 3 can be held down by the top surface of the water pipe accommodating cavity 16 to limit a longitudinal space required for the water supply hose 3 to move, and guide the water supply hose 3 to move.

In one embodiment, as shown in FIGS. 3 to 5, the driving mechanism 4 includes a drive motor 41. The transmission mechanism 5 includes a transmission gear set 51 and a transmission chain 52.

An output shaft of the drive motor 41 is connected with a gear shaft of an input end gear 511 in the transmission gear set 51.

The transmission chain 52 is meshed with an output end gear 512 in the transmission gear set 51, and the transmission chain 52 is also fixedly connected with the effuser 2.

When the drive motor 41 rotates towards a first direction, the drive motor drives the transmission chain 52 to move forward by driving the transmission gear set 51, and then drives the effuser 2 to move forward to the forward position.

When the drive motor 41 rotates towards a second direction, the drive motor drives the transmission chain 52 to move backward by driving the transmission gear set 51, and then drives the effuser 2 to retract to the initial position.

According to needs, as shown in FIG. 3, an elongated strip-shaped limiting groove 17 may be arranged on the housing 1 and a limiting block 24 may be arranged on the effuser 2. When the effuser 2 moves forward to the forward position, the limiting block 24 is contacted with a front end of the limiting groove 17, and when the effuser 2 retracts to the initial position, the limiting block 24 is contacted with a rear end of the limiting groove 17.

In one embodiment, as shown in FIG. 1 and FIG. 3, the housing 1 is formed by a first housing 11 interfacing with a second housing 12. The first housing 11 and the second housing 12 may be butted and assembled by a screw, a bolt, or the like.

When assembling the water spraying device, the driving mechanism 4, the transmission mechanism 5, the effuser 2 and the water supply hose 3 may be mounted at designated positions on the first housing 11, and then the second housing 12 may be assembled on the first housing 11, which is convenient for the mounting of the whole water spraying device.

In one embodiment, a guide mechanism is mounted in the effuser mounting cavity 15, and the effuser 2 is slidably connected with the guide mechanism to provide a guide for the effuser 2 to slide.

The guide mechanism may be a guide rail arranged along an axial direction of the effuser 2, a chute is arranged on the outer pipe 21 of the effuser 2, and the guide rail is in sliding fit with the chute.

The guide mechanism may also be a chute arranged along the axial direction of the effuser 2, a convex rail is arranged on the outer pipe 21 of the effuser 2, and the convex rail is in sliding fit with the chute.

The embodiments of the present disclosure further provide a toilet, which includes the water spraying device described in any of the above embodiments.

The water spraying device is mounted on a toilet body at a rear portion of the toilet, and the effuser 2 thereof can drive the nozzle 23 to extend out from a rear portion of the toilet body to clean a private part of a user. After flushing, the effuser 2 may drive the nozzle 23 to retract without protruding from the toilet body.

By arranging the water pipe accommodating cavity, the water spraying device and the toilet disclosed by the present disclosure enable the water supply hose to be accommodated in the water pipe accommodating cavity and move in the water pipe accommodating cavity with extending and retracting of the effuser, which can protect the water supply hose, avoid interference or friction between the water supply hose and surrounding parts, also reduce the vertical space occupied by the water supply hose during moving, reduce the height of the whole water spraying device, reduce the volume, save the space, and can be more beneficial to the design, mounting and use of the intelligent toilet.

According to needs, the above technical solutions may be combined to achieve the best technical effect.

In summary, the present disclosure discloses a water spraying device and a toilet, wherein the water spraying device includes a housing, an effuser, a water supply hose and a driving mechanism; the housing includes a mechanism mounting cavity, an effuser mounting cavity and a water pipe accommodating cavity; the driving mechanism is mounted in the mechanism mounting cavity, the effuser is slidably arranged in the effuser mounting cavity, and the driving mechanism is connected with the effuser through a transmission mechanism; the housing is provided with a housing water inlet, and the effuser is provided with an effuser water inlet; and the water supply hose is at least partially accommodated in the water pipe accommodating cavity and is capable of moving in the water pipe accommodating cavity. The water spraying device and the toilet disclosed by the present disclosure enable the water supply hose to be accommodated in the water pipe accommodating cavity, avoid interference or friction between the water supply hose and surrounding parts, also reduce a vertical space occupied by the water supply hose during moving, reduce a height of the whole water spraying device, reduce a volume, and save a space.

Second Embodiment: Effuser Flusher

Figure 6:
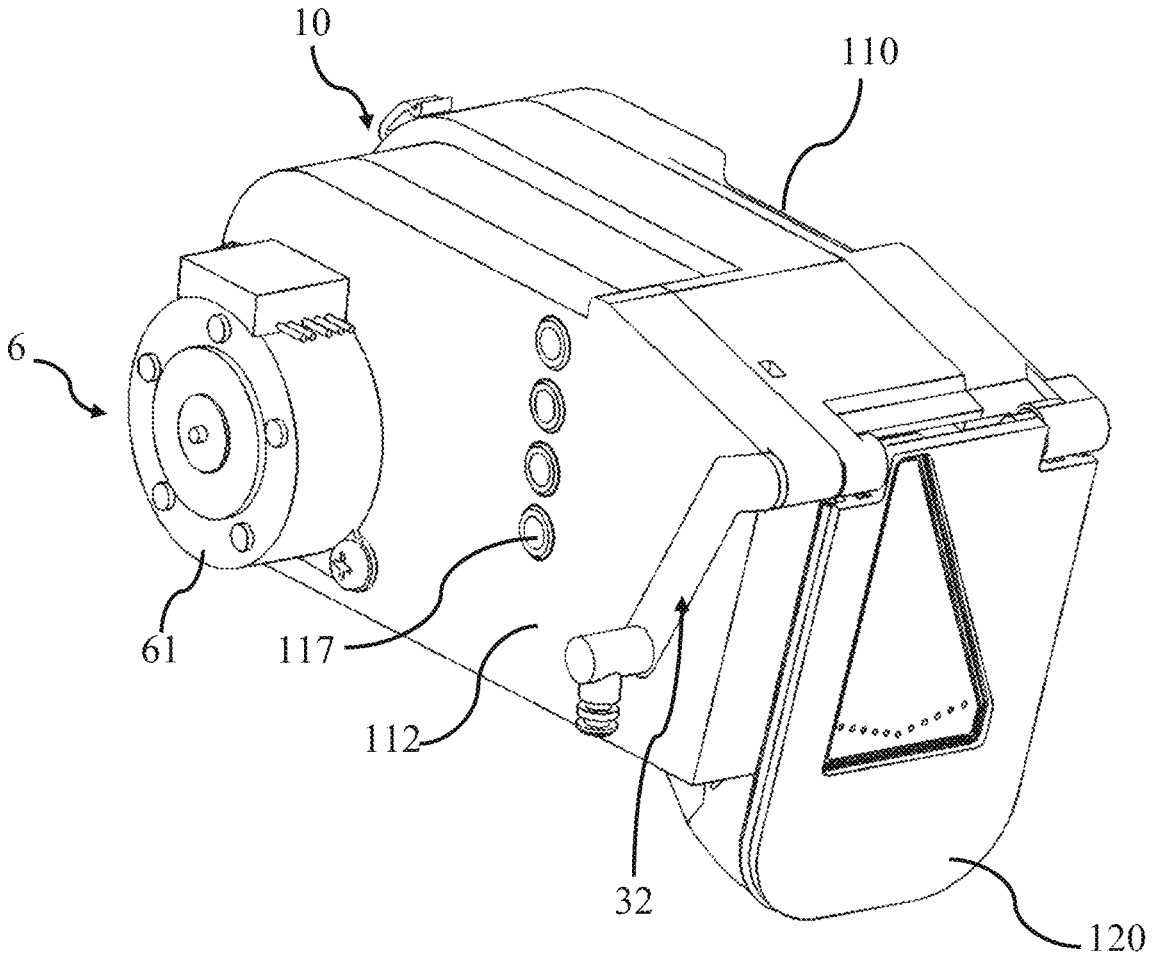
FIG. 6 is a stereoscopic diagram of an effuser flusher provided by an embodiment of the present disclosure.
Figure 7:
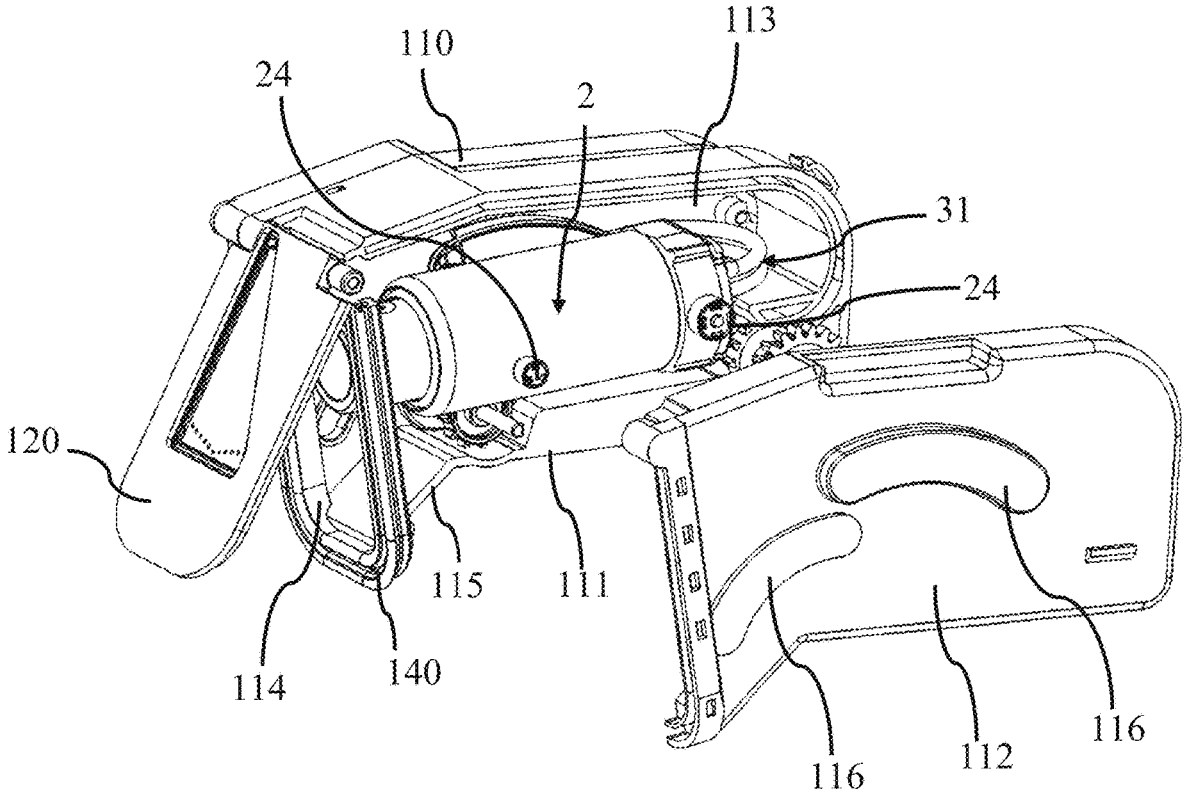
FIG. 7 is an exploded view of the effuser flusher shown in FIG. 6.
Figure 8:
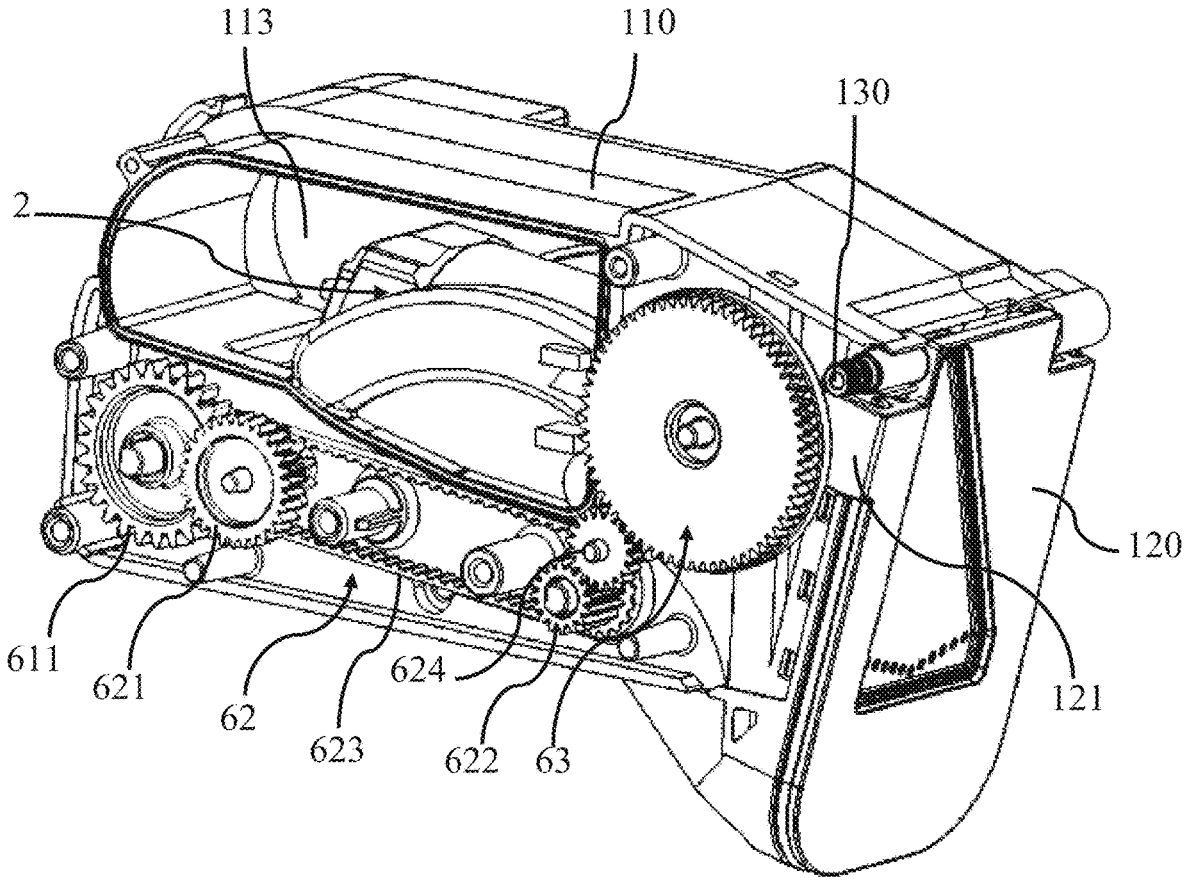
FIG. 8 is a schematic diagram of arrangement of a box cover driving mechanism.
Figure 9:
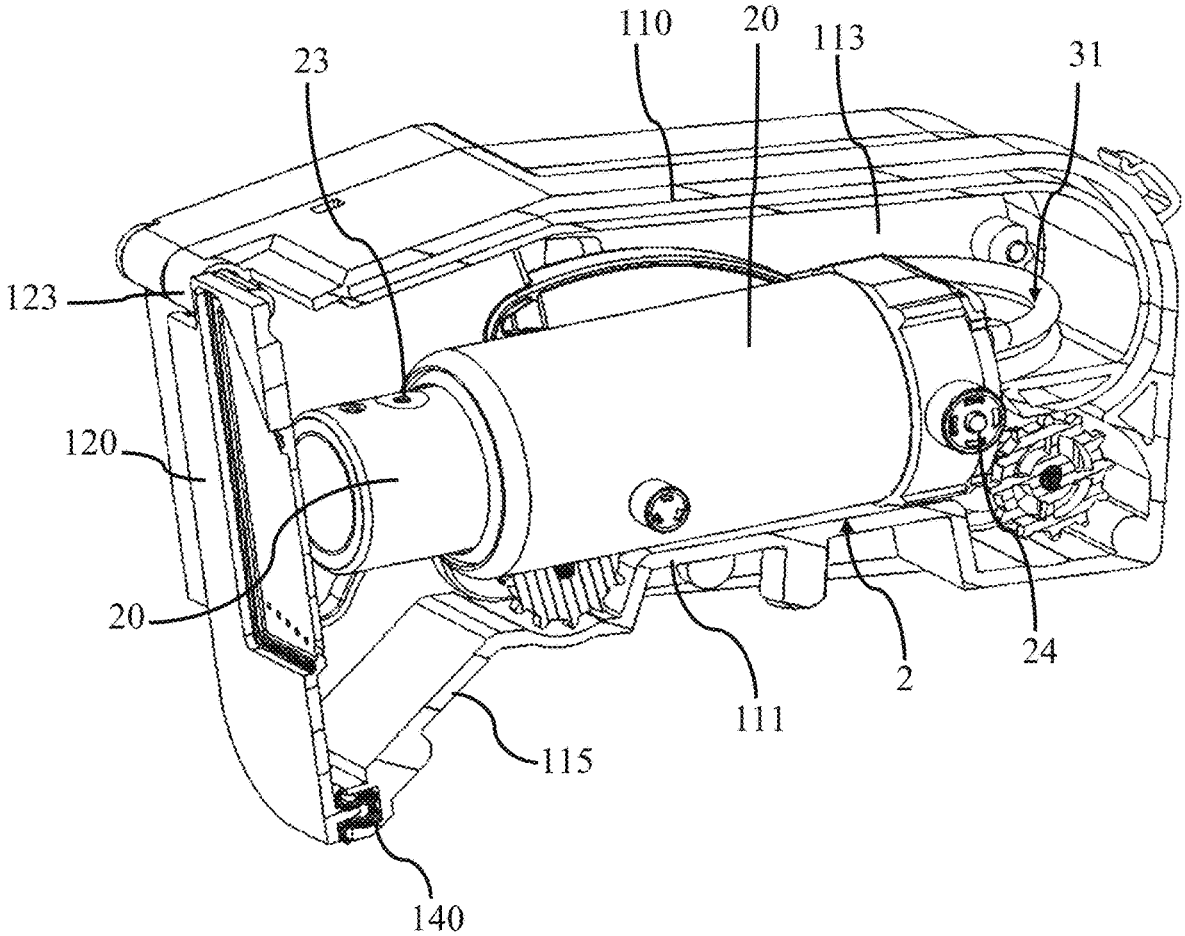
FIG. 9 is a cross-sectional view of the effuser flusher with the box cover in a closed state.
Figure 10:
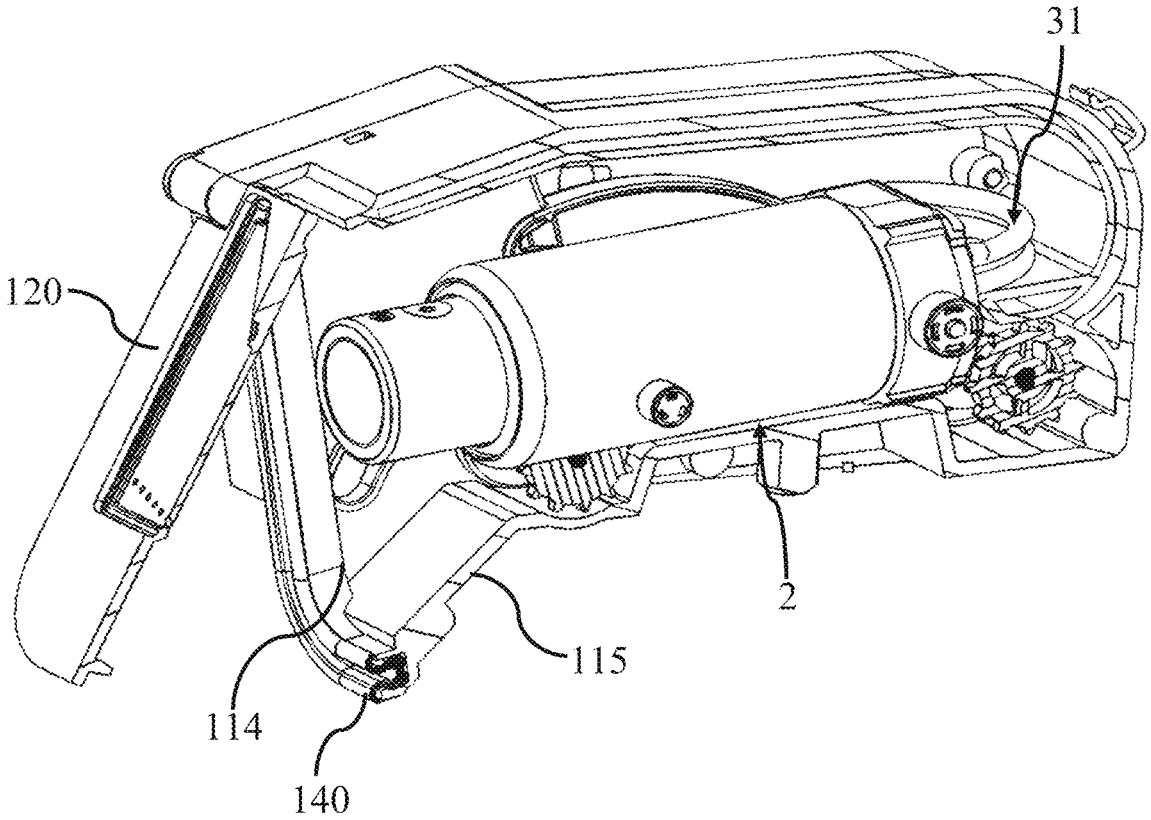
FIG. 10 is a cross-sectional view of the effuser flusher with the box cover in an opened state.
Figure 11:
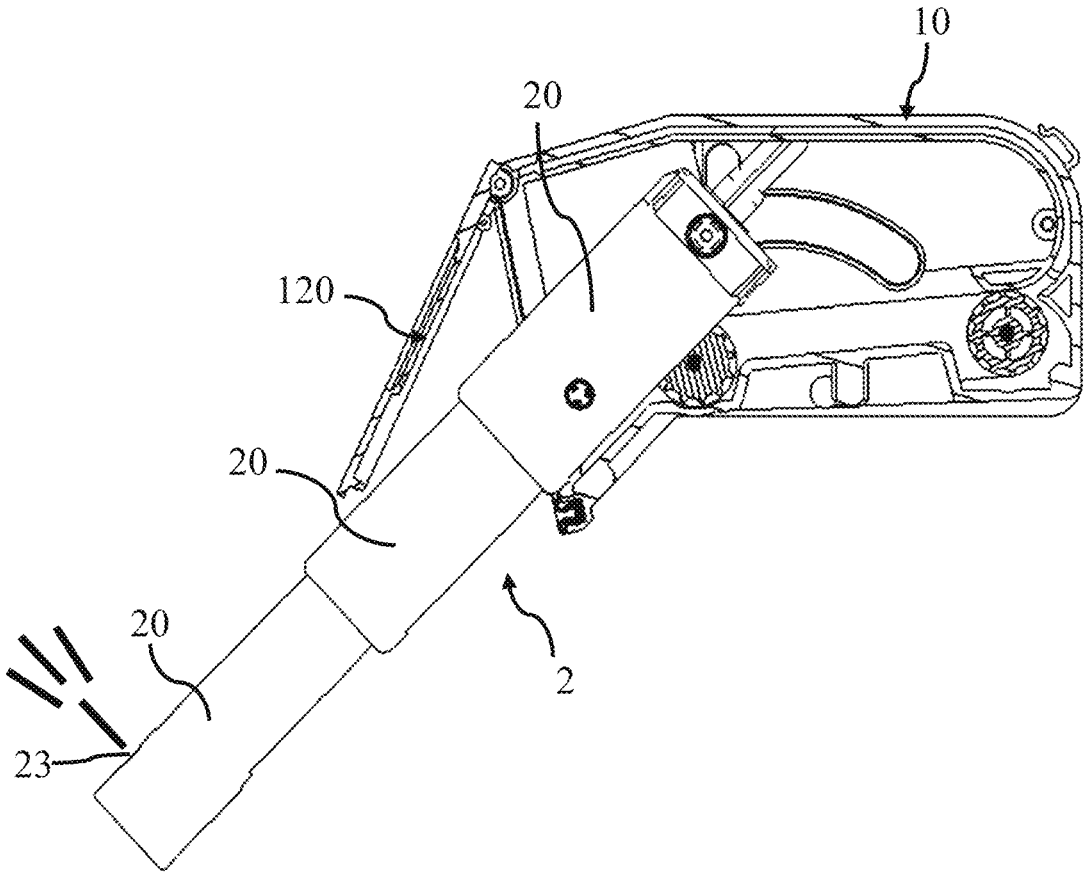
FIG. 11 is a schematic diagram showing that an end portion of an effuser with a nozzle extends out of an effuser box.
Figure 12:
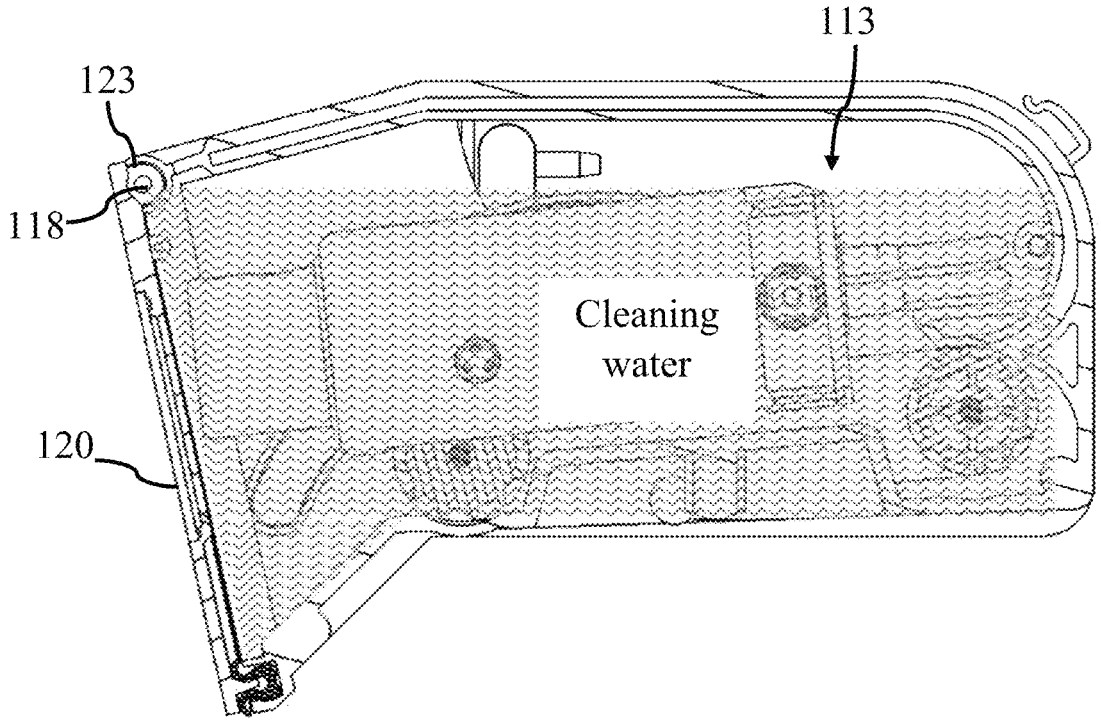
FIG. 12 is a schematic diagram showing that cleaning water in a box body cavity immerses the effuser.

FIG. 6 is a stereoscopic diagram of an effuser flusher provided by an embodiment of the present disclosure. FIG. 7 is an exploded view of the effuser flusher shown in FIG. 6. FIG. 8 is a schematic diagram of arrangement of a box cover driving mechanism. FIG. 9 is a cross-sectional view of the effuser flusher with the box cover in a closed state. FIG. 10 is a cross-sectional view of the effuser flusher with the box cover in an opened state. FIG. 11 is a schematic diagram showing that an end portion of an effuser with a nozzle extends out of an effuser box. FIG. 12 is a schematic diagram showing that cleaning water in a box body cavity immerses the effuse.

As shown in FIG. 6 to FIG. 12, an effuser flusher provided by an embodiment of the present disclosure includes an effuser 2, an effuser box 10, a first water supply pipe 31 for supplying washing water, and a second water supply pipe 32 for supplying cleaning water.

The effuser box 10 includes a box body 110 with a front end provided with a box body opening 114 and a box cover 120 pivotally mounted on the box body 110 and capable of controlling opening and closing of the box body opening 114.

The first water supply pipe 31 is connected with a rear end of the effuser 2, and a front end of the effuser 2 is provided with a nozzle 23.

The effuser 2 is mounted in a box body cavity 113 of the box body 110, and an end portion of the effuser 2 with the nozzle 23 is capable of extending forward and retracting backward through the box body opening 114.

The second water supply pipe 32 is communicated with the box body cavity 113 and/or the second water supply pipe 32 is communicated with the effuser 2.

Under a state that the box cover 120 closes the box body opening 114, the cleaning water in the second water supply pipe 32 is capable of entering the box body cavity 213 and immersing the effuser 2.

Under a state that the box cover 120 opens the box body opening 114, the cleaning water in the box body cavity 113 is capable of being discharged through the box body opening 114.

The effuser flusher provided by the present disclosure is used for being mounted in a toilet, and a user may use the effuser flusher to flush a private part of a body.

In the present disclosure, water used for washing by the user is called the washing water, and water used for immersing, disinfecting, or cleaning the effuser is called the cleaning water.

The effuser flusher includes the effuser 2, the effuser box 10, the first water supply pipe 31, and the second water supply pipe 32.

The effuser 2 may spray water, and the user needs to wash the private part through the effuser 2.

The effuser box 10 is a box body capable of being sealed, which is used for accommodating the effuser 2, and may also be used for containing the cleaning water, so as to immerse and clean the effuser 2.

A water inlet 117 is arranged in a box body side plate 112, one end of the first water supply pipe 31 is connected to the water inlet 117, and the other end of the first water supply pipe 31 is connected to the water inlet at a rear end of the effuser 2. The water inlet 117 is connected to a water supply pipe of washing water of a toilet or is connected to a water tank for supplying the washing water to the effuser 2 through the first water supply pipe 31 during mounting, when the user washes their genital and anal areas, the washing water is supplied to the effuser 2 through the first water supply pipe 31 and then sprayed from the nozzle 23 at the front end of the effuser 2. A one-way valve may be arranged in the water inlet 117 to prevent water in the first water supply pipe 31 from flowing back.

The second water supply pipe 32 is connected to a pipeline of cleaning water in the toilet or a water channel with a medicine box or a disinfectant box in the toilet for supplying the cleaning water to the effuser box 10.

It should be noted that a controller in the toilet controls the first water supply pipe 31 and the second water supply pipe 32 to supply water or stop supplying water. A distributor is arranged in the toilet, which may be used for controlling water supply to the first water supply pipe 31 and the second water supply pipe 32. A supply mode of the water channel belongs to a scope of a toilet water channel system and may refer to the content in the related art. Valves may be arranged in the first water supply pipe 31 and the second water supply pipe 32 as required.

Specifically, the effuser box 10 includes the box body 110 and the box cover 120, the box body 110 is internally provided with the box body cavity 113, and a front side of the box body 110 is provided with the box body opening 114. The box body opening 114 is communicated with the box body cavity 113, and the box body opening 114 may be used for extension and retraction of the effuser 2 and may also be used for discharging water.

The box body 110 includes a box body bottom plate 111, box body side plates 112 on two sides, a box body top plate at a top potion, and a box body rear end plate at a rear end. The box body cavity 113 is formed among the box body bottom plate 111, the box body side plates 112, the box body top plate, and the box body rear end plate, and a front end of the box body cavity 113 is the box body opening 114. When the box cover 120 seals the box body opening 114, the box body cavity 113 is a sealed cavity, which may store the cleaning water for immersing and cleaning the effuser 2. When the box cover 120 opens the box body opening 114, the effuser 2 may extend forward from the box body cavity 113 to the outside of the effuser box 10 through the box body opening 114, or retract into the box body cavity 113 from the outside of the effuser box 10.

An upper end of the box cover 120 is pivotally connected with the box body 110, which may be turned upward and downward for sealing the box body opening 114 or opening the box body opening 114. Pivotal connection in the present disclosure refers to a connection mode that two parts may rotate relatively, which may be implemented through connection by a hinge, connection by a rotating shaft, or connection by combination of a fixed shaft with a sleeve.

In the embodiment, the upper end of the box cover 120 is provided with a sleeve 123, an upper portion of the front end of the box body 110 is provided with a pivot shaft 118, the sleeve 123 is sheathed on the pivot shaft 118, and the box cover 120 may be driven to be turned upward and downward.

In conclusion, the box cover 120 is pivotally mounted on the box body 110 and is capable of controlling opening and closing of the box body opening 114. The above function may be implemented by many solutions, which are specifically described as follows.

In one of the solutions, the box cover 120 may be pushed to be opened by the extended effuser 2, and after the effuser 2 retracts, the box cover 120 is reset under an action of a gravity and seals the box body opening 114.

In one of the solutions, a reset spring may be arranged between the box cover 120 and the box body 2.

The box cover 120 may be pushed to be opened by the extended effuser 2, and after the effuser 2 retracts, the box cover 120 may be pulled back by the reset spring to seal the box body opening 114.

In one of the solutions, a first magnet may be arranged on the box cover 120, and a second magnet attracted to the first magnet may be arranged on the box body 2.

The box cover 120 may be pushed to be opened by the extended effuser 2, and after the effuser 2 retracts, the box cover 120 may be pulled back by an adsorption force between the first magnet and the second magnet, and the box cover 120 is reset and seals the box body opening 114.

In one of the solutions, the box cover 120 may also be driven to be opened and closed by the driving mechanism, and the driving mechanism may be a cylinder driving mechanism, a motor rocker driving mechanism, a motor gear driving mechanism, etc. The driving mechanism may actively drive opening and closing of the box cover 120.

The effuser 2 is mounted in the box body cavity 113 of the box body 110, and the effuser 2 may be fixedly mounted in the box body 110, and may also be slidably mounted in the box body 110, as long as the end portion of the effuser 2 with the nozzle 23 is capable of extending forward to the outside of the effuser box 10 through the box body opening 114 and is capable of retracting into the box body cavity 113 from the outside of the effuser box 10 through the box body opening 114.

When the effuser 2 is fixedly mounted in the box body 110, a telescopic effuser may be used, and the effuser 2 extends and retracts by itself, so that the end portion of the effuser 2 with the nozzle 23 extends and retracts from the box body opening 114.

When the effuser 2 is slidably mounted in the box body 110, the effuser 2 may be driven to move back and forth in the box body cavity 113 by using the effuser driving mechanism 4, so that the end portion of the effuser 2 with the nozzle 23 extends and retracts from the box body opening 114.

Certainly, a stroke of the effuser 2 can be increased by using the telescopic effuser and the effuser driving mechanism, which can meet needs of different users.

A water inlet joint at the rear end of the effuser 2 is connected to the first water supply pipe 31.

The second water supply pipe 32 has the following three connection modes, which are described in more detail below.

First connection mode includes the second water supply pipe 32 that is separately communicated with the box body cavity 113.

In the first connection mode, the outer surface of the effuser 2 is cleaned and disinfected, etc., which is specifically described as follows.

When the effuser 2 returns to the box body cavity 113 after flushing by the user, the box cover 120 closes the box body opening 114, the cleaning water may be supplied to the second water supply pipe 32, and the cleaning water (electrolyzed water and disinfectant water) in the second water supply pipe 32 is capable of directly entering the box body cavity 113 through the second water supply pipe 32. Since the box body cavity 113 is in a sealed state at the moment, the cleaning water may be stored in the box body cavity 113, such that a water level is higher than the effuser 2, and the effuser 2 may be immersed. Therefore, the effuser 2 is immersed, cleaned, and disinfected, etc., to clean the outer surface of the effuser 2.

After cleaning for a preset time, the box cover 120 may be opened, and thus the box body opening 114 is opened. The cleaning water in the box body cavity 113 is capable of being discharged into a ceramic bucket of the toilet through the box body opening 114.

Second connection mode includes the second water supply pipe 32 that is separately communicated with the effuser 2.

In the second connection mode, an internal water channel of the effuser 2 and the outer surface of the effuser 2 are cleaned and disinfected, etc., which is specifically described as follows.

When the effuser 2 returns to the box body cavity 113 after flushing by the user, the box cover 120 closes the box body opening 114, the cleaning water is supplied to the second water supply pipe 32, and the first water supply pipe 31 stops supplying the cleaning water to the effuser 2. The cleaning water (electrolyzed water and disinfectant water) in the second water supply pipe 32 is capable of entering the effuser 2 through the second water supply pipe 32, and then is sprayed into the box body cavity 113 through the nozzle 23. Since the box body cavity 113 is in the sealed state at the moment, the cleaning water may be stored in the box body cavity 113, such that the water level is higher than the effuser 2, and the effuser 2 is immersed.

The cleaning water may be used to clean and disinfect the internal water channel, the nozzle 23, and the like of the effuser 2 in this process, which is beneficial for removing dirt in the internal water channel, and may also be used to immerse, clean, and disinfect, etc., the effuser 2 to clean the outer surface of the effuser 2.

After cleaning for a preset time, the box cover 120 may be opened, and thus the box body opening 114 is opened. The cleaning water in the box body opening 113 is capable of being discharged into the ceramic bucket of the toilet through the box body opening 114.

Third connection mode includes the second water supply pipe 32 that is respectively communicated with the box body cavity 113 and the effuser 2.

In the third connection mode, the internal water channel of the effuser 2 and the outer surface of the effuser 2 are cleaned and disinfected, etc., which can shorten a water storage time, and is specifically described as follows.

When the effuser 2 returns to the box body cavity 113 after flushing by the user, the box cover 120 closes the box body opening 114, the cleaning water is supplied to the second water supply pipe 32, and the first water supply pipe 31 stops supplying the cleaning water to the effuser 2. Most of the cleaning water in the second water supply pipe 32 is capable of directly entering the box body cavity 113, a small part of the cleaning water in the second water supply pipe 32 is capable of entering the effuser 2 through the second water supply pipe 32, and then being sprayed into the box body cavity 113 through the nozzle 23. Since the box body cavity 113 is in the sealed state at the moment, the cleaning water may be stored in the box body cavity 113, such that the water level is higher than the effuser 2, and the effuser 2 is immersed.

The cleaning water may be used to clean and disinfect the internal water channel, the nozzle 23, and the like of the effuser 2 in this process, which is beneficial for removing dirt in the internal water channel, and may also be used to immerse, clean, and disinfect, etc., the effuser 2 to clean the outer surface of the effuser 2. Meanwhile, since most of the cleaning water may directly enter the box body cavity 113 to be stored, a time required for water storage can be shortened.

When the second and third connection modes are used, after the immersion of the effuser 2 is completed, the first water supply pipe 31 needs to be opened to inject clear water into the effuser 2 to flush the water channel and the nozzle 23 of the effuser 2, which may flush out dirt on one hand, and avoids residual cleaning water in the water channel on the other hand, thus avoiding affecting subsequent use by the user.

In the present application, communication between the second water supply pipe 32 and the box body cavity 113 refers to that the second water supply pipe 32 is directly or indirectly communicated with the box body cavity 113, and water in the second water supply pipe 32 may enter the box body cavity 113, which may be specifically connected through a pipeline. Communication between the second water supply pipe 32 and the effuser 2 refers to that the second water supply pipe 32 is directly or indirectly communicated with the water channel in the effuser 2, and water in the second water supply pipe 32 may enter the water channel of the effuser 2, which may be specifically connected through the pipeline or a joint.

According to the effuser flusher provided by the present disclosure, after flushing by the user, the effuser 2 returns to the box body cavity 113, the box cover 120 is closed, and then the box body opening 114 is sealed. The cleaning water may be injected into the box body cavity 113 through the second water supply pipe 32 to immerse, clean, and disinfect, etc., the effuser 2.

The cleaning water in the present disclosure may be arranged in advance according to needs, for example, an additional water box or an additional water tank may be arranged in the toilet, and the additional water box or the additional water tank contains the cleaning water arranged in advance. The second water supply pipe 32 may pass through the additional water box or the additional water tank, or the additional water box or the additional water tank supplies the cleaning water to the second water supply pipe 32 through the pipeline. A medicine box containing disinfection and sterilization medicines may also be arranged in the toilet, and the second water supply pipe 32 may pass through the medicine box.

In one embodiment, as shown in FIG. 8, a cavity water inlet pipe 130 communicated with the box body cavity 113 is arranged on the box cover 120 or the box body 110, and the second water supply pipe 32 is connected to the cavity water inlet pipe 130.

The cleaning water in the second water supply pipe 32 is capable of entering the box body cavity 113 through the cavity water inlet pipe 130 and immersing the effuser 2.

The embodiment is a specific implementation that the second water supply pipe 32 is communicated with the box body cavity 113: the cavity water inlet pipe 23 may be selectively arranged on the box cover 120 and/or the box body 110, the cavity water inlet pipe 130 is communicated with the box body cavity 113, and the second water supply pipe 32 is connected to the cavity water inlet pipe 130.

When the effuser 2 needs to be cleaned, the cleaning water in the second water supply pipe 32 is capable of entering the box body cavity 113 through the cavity water inlet pipe 130 and immersing the effuser 2, and then may clean, sterilize, and disinfect the outer surface of the effuser 2.

In one embodiment, the second water supply pipe 32 is connected to a water inlet of the effuser 2 or the second water supply pipe 32 is connected with the first water supply pipe 31.

The cleaning water in the second water supply pipe 32 is capable of entering the box body cavity 113 through the effuser 2 and the nozzle 23 and immersing the effuser 2.

The embodiment is a specific implementation that the second water supply pipe 32 is communicated with the effuser 2 and includes the following two connection modes.

In a first connection mode the second water supply pipe 32 is connected to the water inlet of the effuser 2. In the connection mode, when the effuser 2 needs to be cleaned, the cleaning water in the second water supply pipe 32 is capable of entering the box body cavity 113 through the effuser 2 and the nozzle 23 and immersing the effuser 2, and then may clean, sterilize, and disinfect, etc., the outer surface, the internal water channel, the nozzle 23, and the like of the effuser 2.

In a second connection mode the second water supply pipe 32 is connected to the first water supply pipe 31. In the connection mode, when the effuser 2 needs to be cleaned, the cleaning water in the second water supply pipe 32 is capable of entering the box body cavity 113 through the first water supply pipe 31, the effuser 2, and the nozzle 23 and immersing the effuser 2, and then may clean, sterilize, and disinfect, etc., the outer surface, the internal water channel, and the nozzle 23 of the effuser 2, the first water supply pipe 31, and the like.

In one embodiment, as shown in FIG. 7 and FIG. 9, a sealing ring 140 is arranged between the box cover 120 and a peripheral edge of the box body opening 114 to improve a sealing effect and avoid water from flowing out of the box body opening 114.

In one embodiment, as shown in FIG. 7, FIG. 9, and FIG. 10, a front end of the box body bottom plate 111 of the box body 110 is provided with a flow guide plate 115 obliquely extending forward and downward.

The flow guide plate 115 is integrally arranged at the front end of the box body bottom plate 111, and the flow guide plate 115 extends downward while extending forward, which is beneficial for quickly discharging water from the box body cavity 113. Discharged waste water may directly enter the ceramic bucket of the toilet.

In one embodiment, as shown in FIG. 6 and FIG. 8, a box cover driving mechanism 6 for driving the box cover 120 to overturn around a pivot shaft 118 is arranged on the box body 110, and an output end of the box cover driving mechanism 6 is connected to the box cover 120.

The box cover driving mechanism 6 is mounted on one side of the box body 110 and is used for driving the box cover 120 to turn upward and downward, so that the box cover 120 opens and closes the box body opening 114. The output end of the box cover driving mechanism 6 is connected to the box cover 120.

The box cover driving mechanism 6 may be a drive motor, a cylinder, a linkage mechanism, etc., as long as the box cover driving mechanism may drive the box cover 120 to rotate around the pivot shaft 118.

Arrangement of the box cover driving mechanism 6 can avoid friction caused by contact between the effuser 2 and the box cover 120, and a sealing performance of the box cover 120 to the box body opening 114 can be improved by the arrangement of the box cover driving mechanism 6.

Before the effuser 2 needs to extend, the box cover driving mechanism 6 opens the box cover 120 first, and thus the effuser 2 may smoothly extend from the box body opening 114 without being contacted with the box cover 120. After the effuser 2 retracts, the box cover driving mechanism 6 drives the box cover 120 to be closed, and may make the box cover 120 tightly close the box body opening 114 to improve the sealing performance. During extension and retraction of the effuser 1, the effuser 2 may not touch the box cover 120, so that the effuser 2 extends more smoothly, and the effuser 2 may not be in frictional contact with the box cover 120, which can reduce noise during system operation.

Figure 13:
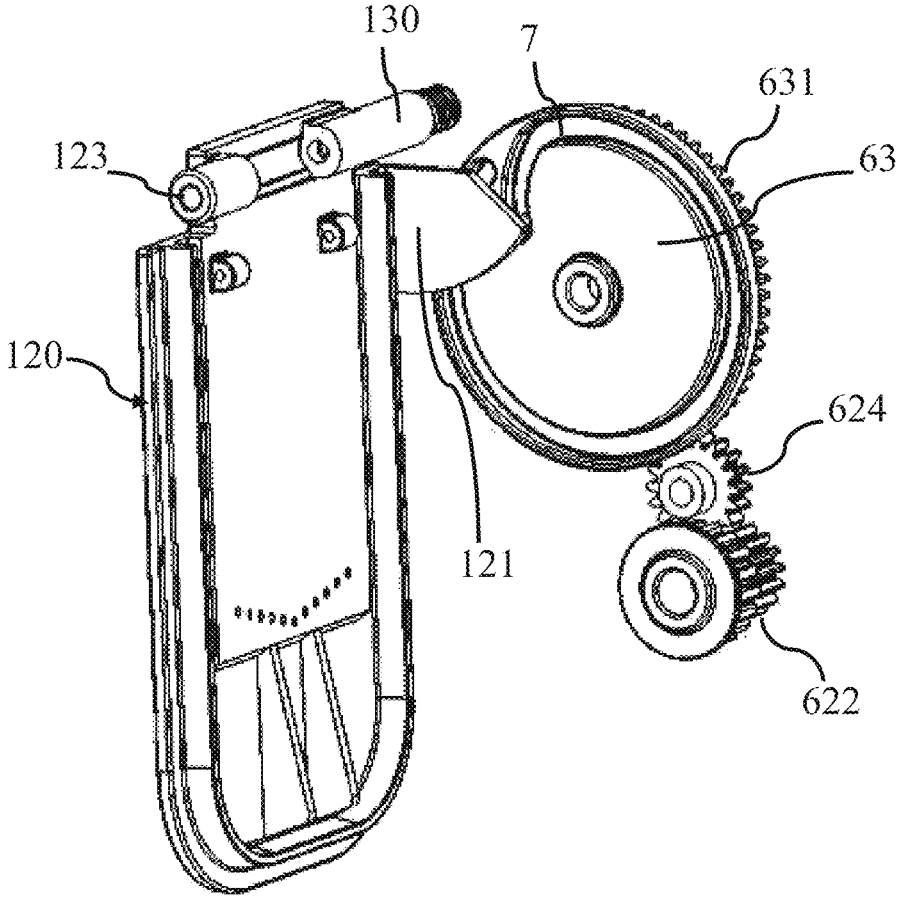
FIG. 13 is a schematic diagram showing that an output end rotating wheel is matched with the box cover.
Figure 14:
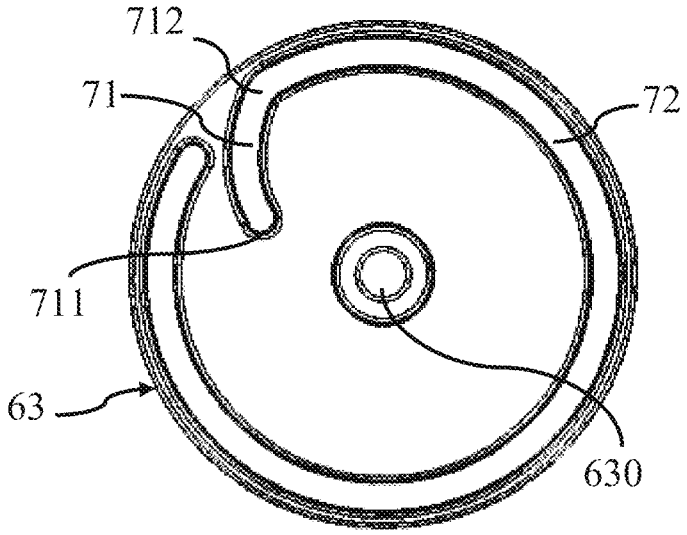
FIG. 14 is a schematic diagram showing that a guiding groove is arranged on the output end rotating wheel.
Figure 15:
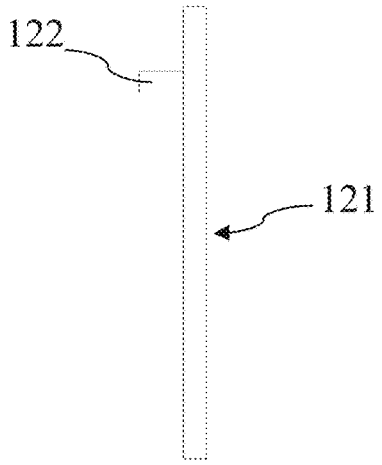
FIG. 15 is a top view showing that a side plate pin shaft is arranged on a box cover side plate/a side plate of an effuser door.
Figure 16:
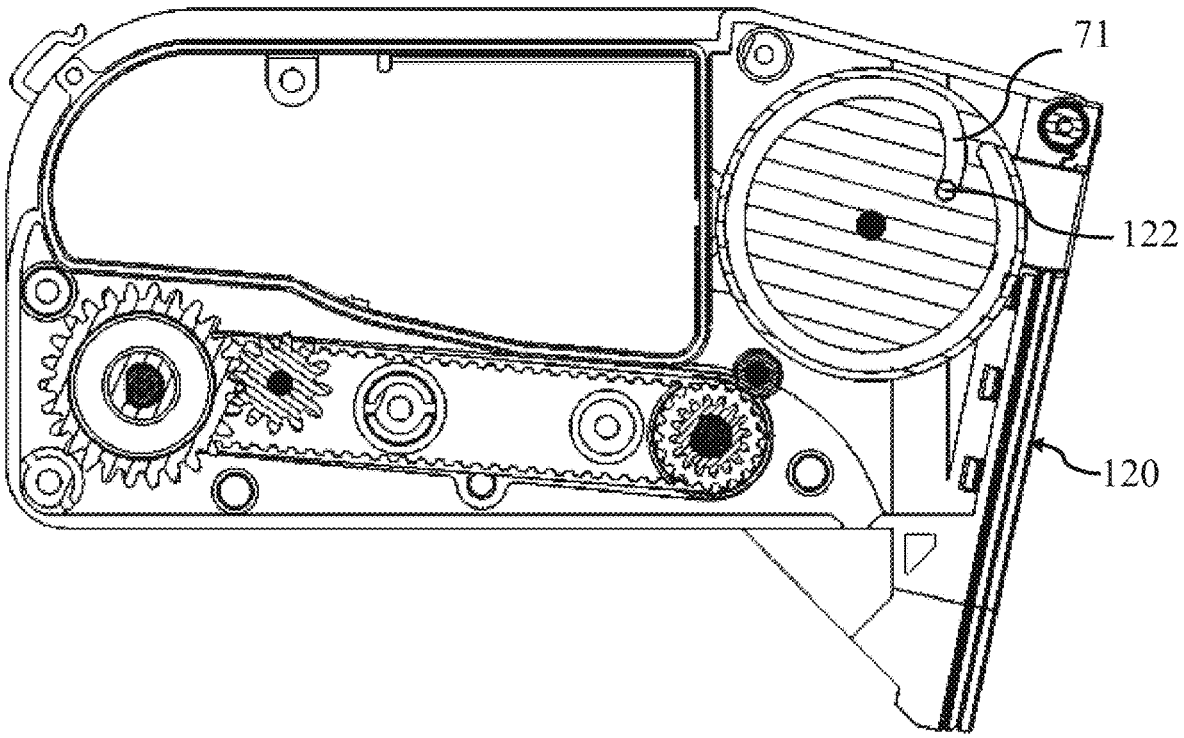
FIG. 16 is a schematic diagram showing that the side plate pin shaft is located in a first guiding groove initiating end, and the box cover is in the closed state.
Figure 17:
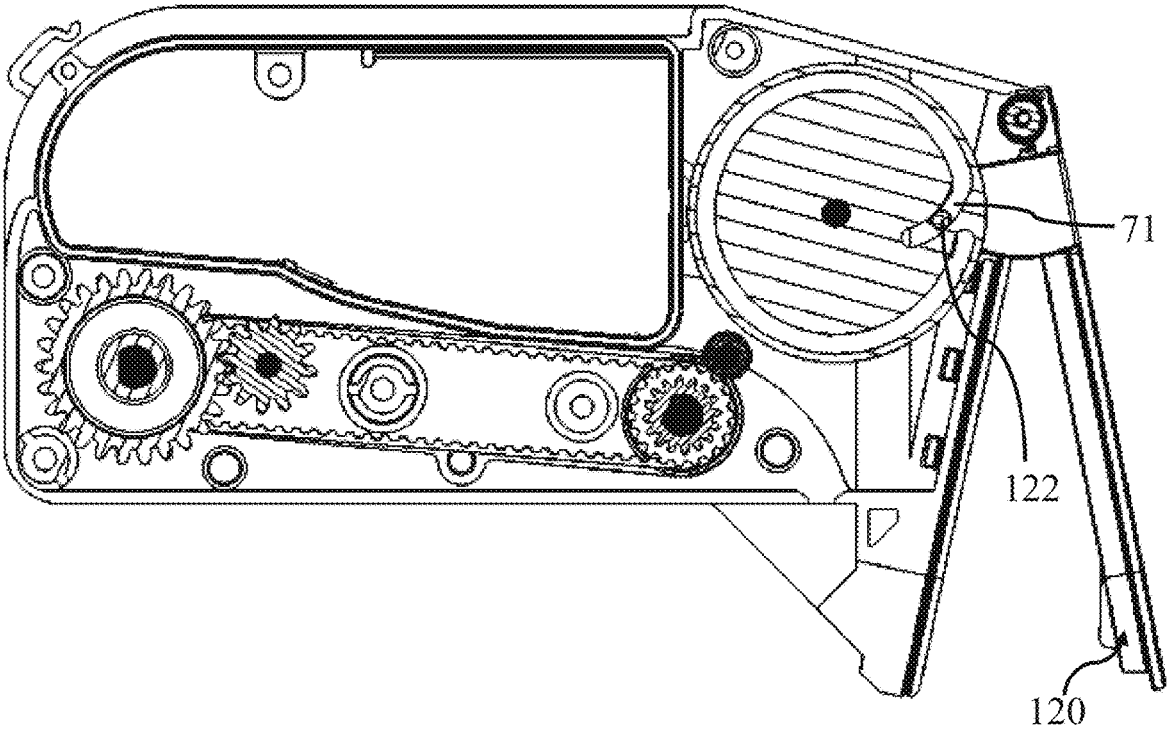
FIG. 17 is a schematic diagram showing that the side plate pin shaft is located between the first guiding groove initiating end and a first guiding groove terminating end, and the box cover is in a partially opened state.

FIG. 13 is a schematic diagram showing that an output end rotating wheel is matched with the box cover. FIG. 14 is a schematic diagram showing that a guiding groove is arranged on the output end rotating wheel. FIG. 15 is a top view showing that a side plate pin shaft is arranged on a box cover side plate. FIG. 16 is a schematic diagram showing that the side plate pin shaft is located in a first guiding groove initiating end, and the box cover is in the closed state. FIG. 17 is a schematic diagram showing that the side plate pin shaft is located between the first guiding groove initiating end and a first guiding groove terminating end, and the box cover is in a partially opened state.

In one embodiment, as shown in FIG. 8 and FIG. 13 to FIG. 17, the output end of the box cover driving mechanism 6 is an output end rotating wheel 63.

One side of the box cover 120 close to the output end rotating wheel 63 is provided with a box cover side plate 121, and the box cover side plate 121 extends towards a rear end of the box body 110.

A side plate pin shaft 122 extending towards the output end rotating wheel 63 is arranged on the box cover side plate 121.

One side of the output end rotating wheel 63 facing the box cover side plate 121 is provided with a guiding groove 7 for guiding opening and closing of the box cover 120.

One end of the side plate pin shaft 122 is matched in the guiding groove 7 and is capable of sliding in the guiding groove 7.

The output end rotating wheel 63 is mounted on one side of the box body 110 through a wheel axle. The box cover driving mechanism 6 may drive the output end rotating wheel 63 to rotate, and the output end rotating wheel 63 is provided with the guiding groove 7. The guiding groove 7 may be a part of a cam groove, which is a curved groove. An upper portion of the box cover 120 is provided with the box cover side plate 121, which extends from front to back. The side plate pin shaft 122 is arranged on the box cover side plate 121, which extends towards the output end rotating wheel 63. An end portion of the side plate pin shaft 122 is inserted into the guiding groove 7 during assembly, which is in clearance fit with the guiding groove 7 and may slide in the guiding groove 7. When the box cover driving mechanism 6 drives the output end rotating wheel 63 to rotate, the side plate pin shaft 122 may slide in the guiding groove 7, and the box cover 120 may be driven to be turned upward and downward through the box cover side plate 121 to open and close the box body opening 114.

Figure 18:
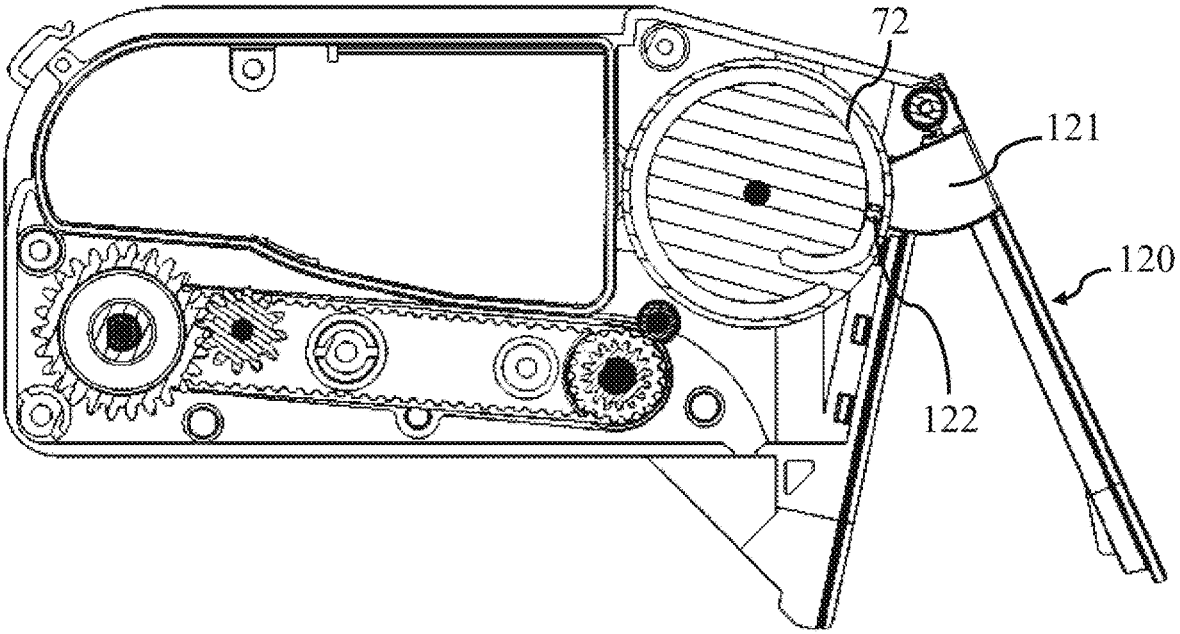
FIG. 18 is a schematic diagram showing that the side plate pin shaft is located in a second guiding groove, and the box cover is in a completely opened state.

FIG. 18 is a schematic diagram showing that the side plate pin shaft is located in a second guiding groove, and the box cover is in a completely opened state. In one embodiment, as shown in FIG. 13 to FIG. 18, the guiding groove 7 includes a first guiding groove 71 with a curve contour line and a second guiding groove 72 with a smooth arc contour line.

The second guiding groove 72 communicates with the first guiding groove 71.

When the side plate pin shaft 122 slides in the first guiding groove 71, the box cover 120 is capable of being switched between an opened state and a closed state.

When the side plate pin shaft 122 slides in the second guiding groove 72, the box cover 120 is capable of being kept in the opened state.

That is, the guiding groove 7 includes the first guiding groove 71 and the second guiding groove 72, and the second guiding groove 72 is communicated with the first guiding groove 71. The contour line of the first guiding groove 71 is a curve, and the contour line of the second guiding groove 72 is a smooth arc. The first guiding groove 71 extends from a middle portion to an edge of the output end rotating wheel 63, and the second guiding groove 72 is concentric with a center shaft 630 of the output end rotating wheel 63.

When the side plate pin shaft 122 slides in the first guiding groove 71, the box cover 120 may be opened and closed, so that the box cover 120 is capable of being switched between the opened state and the closed state.

When the side plate pin shaft 122 slides in the second guiding groove 72, the box cover 120 is kept in the opened state, so that the box cover 120 is capable of being kept in the opened state.

The first guiding groove 71 and the second guiding groove 72 are specifically configured as follows.

The first guiding groove 71 includes a first guiding groove initiating end 711 and a first guiding groove terminating end 712. The first guiding groove initiating end 711 and the first guiding groove terminating end 712 are oppositely arranged at two ends of the first guiding groove 71, and a part between the first guiding groove initiating end 711 and the first guiding groove terminating end 712 is a curved groove.

In a radial direction of the output end rotating wheel 63, the first guiding groove 71 extends from the middle to the edge on the output end rotating wheel 63. The first guiding groove terminating end 712 is located on an oblique outside of the first guiding groove initiating end 711.

When the side plate pin shaft 122 is located in the first guiding groove initiating end 711, the box cover 120 is in the closed state, which is an initial state of the box cover 120. When the side plate pin shaft 122 is located between the first guiding groove initiating end 711 and the first guiding groove terminating end 712, the box cover 120 is in a partially opened state. When the side plate pin shaft 122 is located in the first guiding groove terminating end 712, the box cover 120 is in the completely opened state.

That is, in a case when the box cover driving mechanism 6 drives the output end rotating wheel 63 to rotate, before the side plate pin shaft 122 slides from the first guiding groove initiating end 711 to the first guiding groove terminating end 712, the box cover 120 is in the partially opened state. The partially opened state refers to a state of the box cover 120 before complete opening or a semi-opened state, which is an opening process of the box cover 120.

In a case when the box cover driving mechanism 6 drives the output end rotating wheel 63 to rotate continuously, when the side plate pin shaft 122 slides into the first guiding groove terminating end 712, the box cover 120 is in a completely opened state, which means that the box cover 120 is completely opened or opened to a maximum angle.

The box cover driving mechanism 6 may drive the output end rotating wheel 63 to rotate reversely, so that the box cover 120 is reset to the closed state.

In an embodiment, a radius of curvature of the first guiding groove 71 is gradually increased in a direction from the first guiding groove initiating end 711 to the first guiding groove terminating end 712. The curvature of the first guiding groove 71 affects an opening speed, and the steeper the curve is or the smaller the curvature is, the faster the opening speed is. According to this arrangement, the opening speed of the box cover 120 is faster in an initial opening stage and becomes slow after opening by a certain angle, which is beneficial for control.

The second guiding groove 72 is arranged to be concentric with the center shaft 630 of the output end rotating wheel 63.

One end of the second guiding groove 72 communicates with the first guiding groove terminating end 712, and the other end of the second guiding groove 72 is spaced apart from the first guiding groove terminating end 712 by a preset distance.

A distance between the first guiding groove terminating end 712 and the center shaft 630 of the output end rotating wheel 63 is D, and a radius of the second guiding groove 72 is R, then R=D.

When the side plate pin shaft 122 is located in the second guiding groove 72, the box cover 120 is kept in the completely opened state.

According to this arrangement, after the box cover 120 is completely opened, in a case that the box cover driving mechanism 6 drives the output end rotating wheel 63 to rotate continuously, then the side plate pin shaft 122 slides into the second guiding groove 72 from the first guiding groove terminating end 712. Since R=D, when the side plate pin shaft 122 slides in the second guiding groove 72, the box cover 120 is kept in the completely opened state.

The radius of the second guiding groove 72 affects an opening angle, and the larger the R is, the larger the opening angle of the box cover 120 is. A length of the second guiding groove 72 affects a holding time for opening, the longer the length of the second guiding groove 72 is, the longer the time for keeping the box cover 120 in the completely opened state is.

A contour of the guiding groove 7 is reasonably designed to control the opened and closed states of the box cover 120 to meet different needs.

In a case that the box cover 120 needs to be closed, when the side plate pin shaft 122 slides to the first guiding groove terminating end 712 from the second guiding groove 72, the box cover 120 starts to be closed, and when the side plate pin shaft 122 slides to the first guiding groove initiating end 711, the box cover 120 is completely closed.

In an embodiment, a center angle of the second guiding groove 72 is $\alpha$, then $180° \leq \alpha < 360°$. An arc of the second guiding groove 72 is longer, which is a major arc, and a time for keeping the box cover 120 in the completely opened state is longer, which may satisfy a condition that the user uses the effuser 2 for a period of time.

In one embodiment, as shown in FIG. 6, FIG. 8, and FIG. 13, the box cover driving mechanism 6 includes a first drive motor 61 and a first transmission device 62.

The first transmission device 62 is located between the output end rotating wheel 63 and the first drive motor 61.

The first drive motor 61 and the first transmission device 62 are respectively mounted on one side of the box body 110. The first drive motor 61 is a forward and reverse rotation motor, which can implement forward rotation and reverse rotation. If the first drive motor 61 rotates forwardly and the box cover 120 is opened, then the first drive motor 61 rotates in a reverse direction and the box cover 120 is closed. If the first drive motor 61 rotates reversely and the box cover 120 is opened, then the first drive motor 61 rotates in a forward direction and the box cover 120 is closed.

The first transmission device 62 may be a gear set, a belt set, etc., and is used for transmitting a torque of the first drive motor 61 to the output end rotating wheel 63 to drive the output end rotating wheel 63 to rotate.

In order to facilitate transmission, a circle of rotating wheel teeth 631 are arranged on a circumferential surface of the output end rotating wheel 63.

The output shaft of the first drive motor 61 is provided with a first motor gear 611.

The first transmission device 62 includes a first input gear 621, a first transmission gear 622, a first transmission chain 623, and a first output gear 624. The first transmission gear 622 and the first input gear 621 are connected and transmitted through the first transmission chain 623.

The first input gear 621 is meshed with the first motor gear 611, the first transmission gear 622 is meshed with the first output gear 624, and the first output gear 624 is meshed with the output end rotating wheel 63, thus meshing and transmission among the gears are achieved, which has a high transmission efficiency, and can better drive the output end rotating wheel 63 to rotate.

Figure 19:
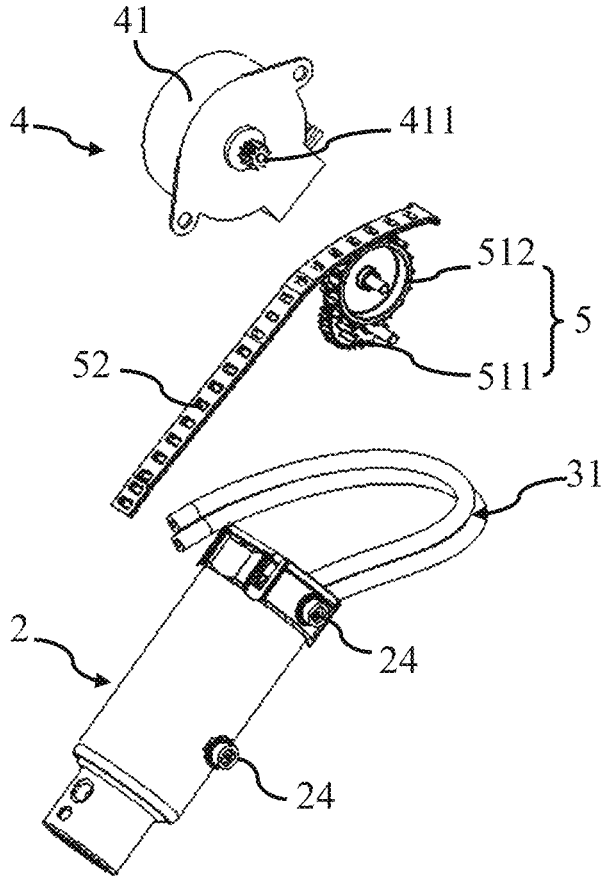
FIG. 19 is an exploded view of an effuser driving mechanism and the effuse.

FIG. 19 is an exploded view of an effuser driving mechanism and the effuse. In one embodiment, as shown in FIG. 7, FIG. 9, FIG. 11, and FIG. 19, the effuser 2 is slidably mounted in the box body cavity 113.

An effuser bulge 24 extends from the effuser 2 towards the box body side plate 112 of the box body 110, and a guide groove 116 is arranged on the box body side plate 112.

The effuser bulge 24 is matched in the guide groove 116 and is capable of sliding in the guide groove 116.

An effuser driving mechanism 4 for driving the effuser 2 to slide in the box body cavity 113 is further arranged on the box body 110.

An output end of the effuser driving mechanism 4 is connected to the effuser 1.

A slide rail may be mounted in the box body cavity 113, and the effuser 2 is mounted on the slide rail and may slide back and forth in the box body cavity 113. The effuser bulge 24 is in clearance fit with the guide groove 116, to guide and limit sliding movement of the effuser 2.

The effuser driving mechanism 4 is used for driving the effuser 2 to move back and forth.

Specifically, the effuser driving mechanism 4 includes a second drive motor 41, a second transmission device 5, and a second transmission chain 52.

A second motor gear 411 is mounted on an output shaft of the second drive motor 41. The second transmission device 5 includes a second input gear 511 and a second output gear 512.

The second input gear 511 is meshed with the second motor gear 411, the second transmission chain 52 is meshed with the second output gear 512, and one end of the second transmission chain 52 is fixedly connected with the rear end of the effuser 2.

The second transmission chain 52 is a hard chain or a chain plate capable of transmitting a horizontal force.

When the second drive motor 41 rotates in a first direction, the second drive motor may drive the second transmission chain 52 to move forward through the second transmission device 5, and then drives the effuser 2 to move forward, so that the nozzle 23 may extend out through the box body opening 114.

When the second drive motor 41 rotates in a second direction, the second drive motor may drive the second transmission chain 52 to move backward through the second transmission device 5, and then pulls the effuser 1 back to an initial position.

In one embodiment, as shown in FIG. 9 and FIG. 11, the effuser 2 is capable of extending and retracting. The effuser 2 includes at least two sections of pipe bodies 20, and two adjacent sections of pipe bodies 20 are connected in a sliding and sealing manner. The pipe body 20 is internally provided with a water channel. The nozzle 23 is arranged in the pipe body 20 at a frontmost end. The effuser 2 may extend and retract by arranging the effuser driving mechanism, for example, the effuser driving mechanism is the cylinder, the cylinder is fixedly mounted on the pipe body 20 at a rearmost end, and a piston rod of the cylinder is connected to the pipe body 20 at the frontmost end, so that the effuser 2 may extend and retract. According to this arrangement, a telescopic amount of the effuser 2 can be increased to satisfy telescoping requirement when being mounted on the toilet.

According to needs, the above technical solutions may be combined to achieve the best technical effect.

The present disclosure discloses an effuser flusher, including an effuser, an effuser box, a first water supply pipe for supplying washing water, and a second water supply pipe for supplying cleaning water. The effuser box includes a box body and a box cover; the first water supply pipe is connected with a rear end of the effuser, and a front end of the effuser is provided with a nozzle; and the effuser is mounted in a box body cavity of the box body, and an end portion of the effuser with the nozzle is capable of extending forward and retracting backward through a box body opening, wherein the second water supply pipe is communicated with the box body cavity and/or the second water supply pipe is communicated with the effuser. According to the effuser flusher provided by the present disclosure, the cleaning water can be supplied through the second water supply pipe to immerse the effuser, and clean and disinfect a surface of the effuser, so that the effuser can be effectively prevented from generating bacteria, mildew, and odor, thus improving user experience.

Third Embodiment: Effuser Device and Toilet

Figure 20:
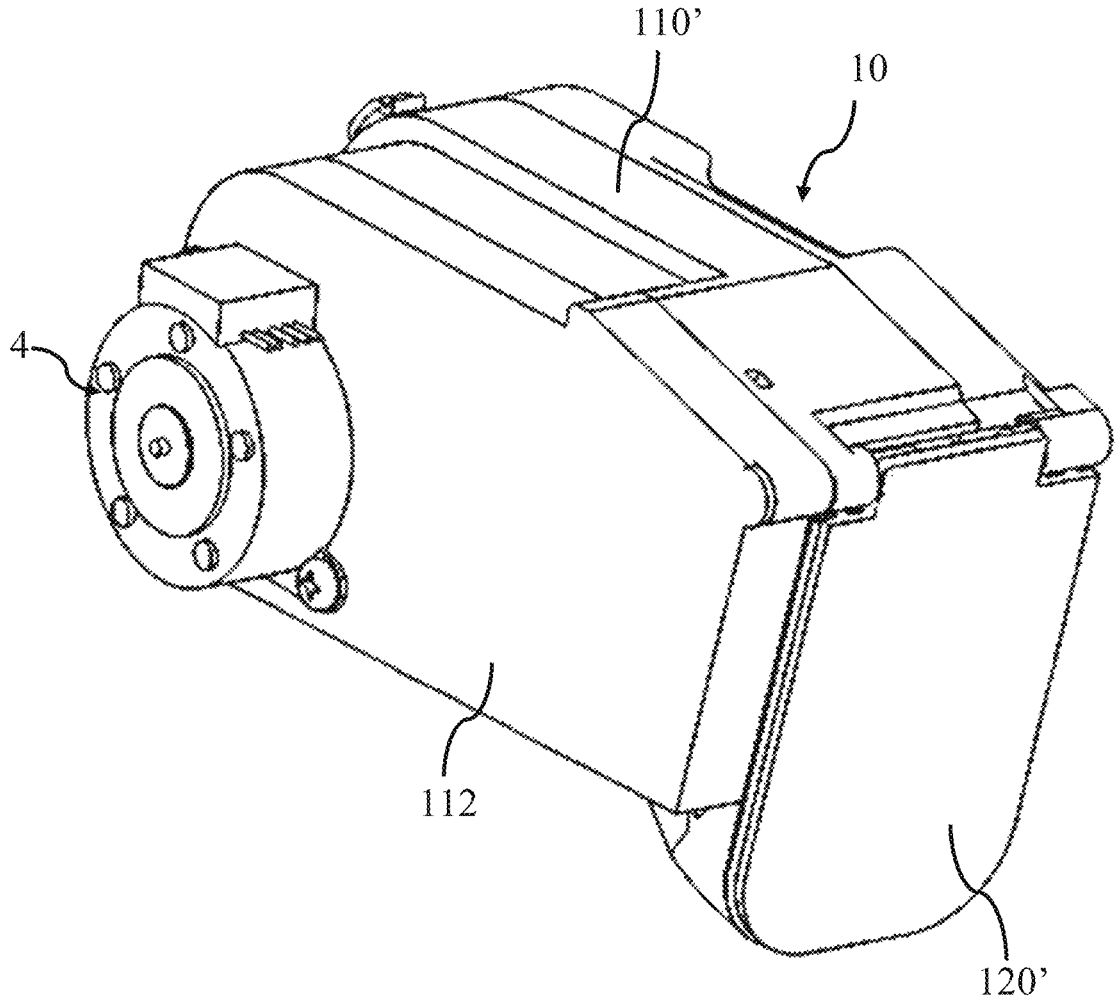
FIG. 20 is a stereoscopic diagram of an effuser device provided by an embodiment of the present disclosure.
Figure 21:
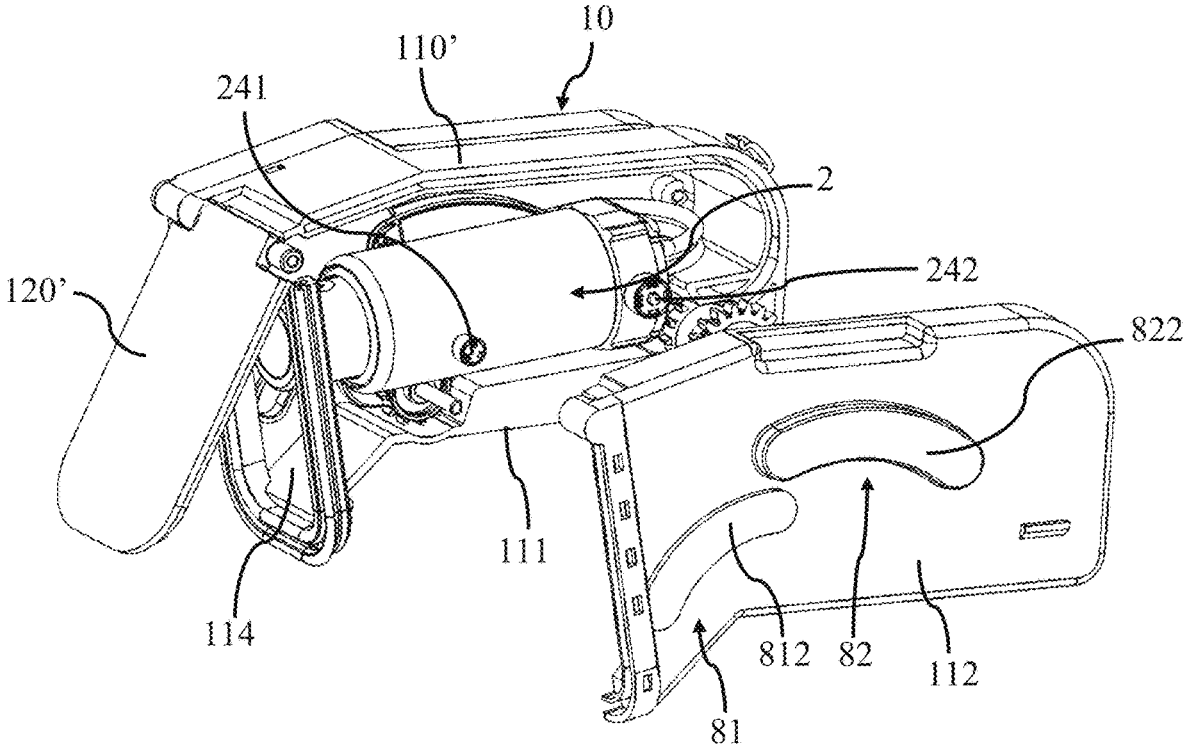
FIG. 21 is an exploded view of the effuser device provided by an embodiment of the present disclosure.
Figure 22:
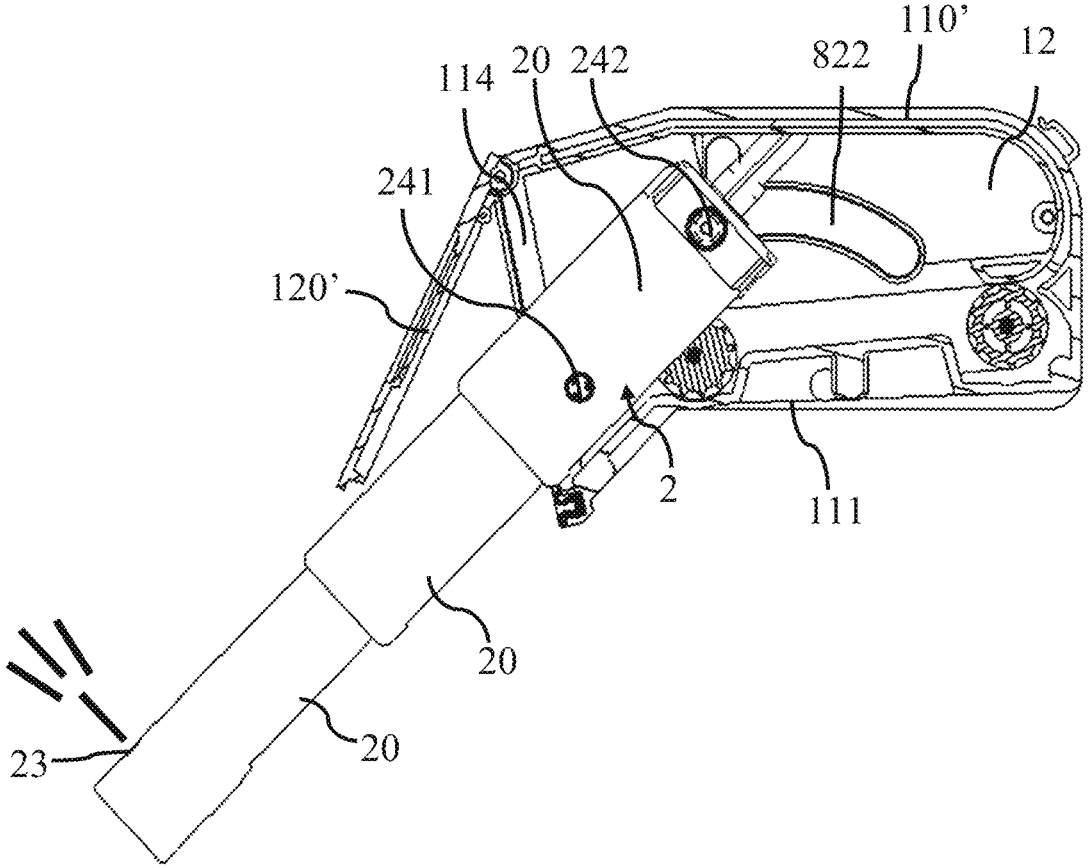
FIG. 22 is a schematic diagram of the effuser in an extended state.
Figure 23:
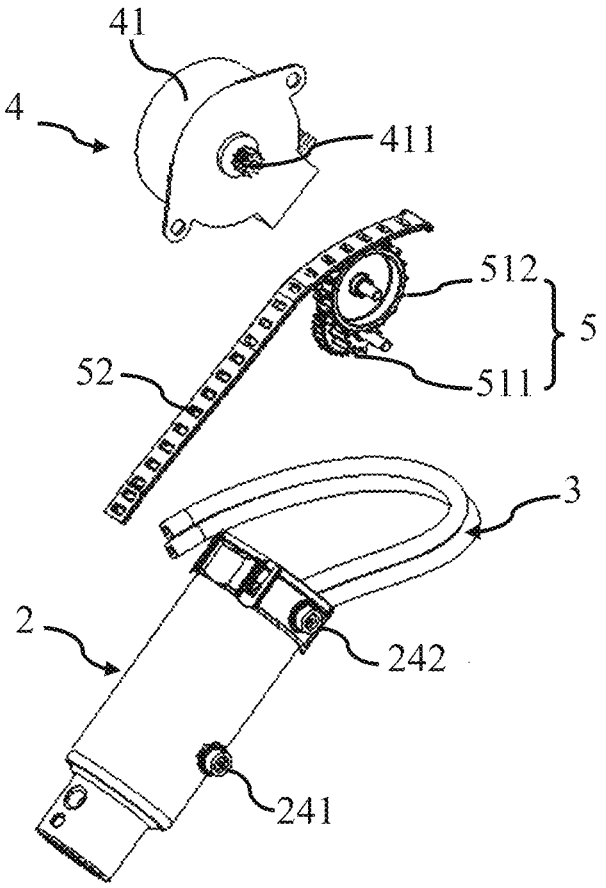
FIG. 23 is an exploded view of a driving mechanism.
Figure 24:
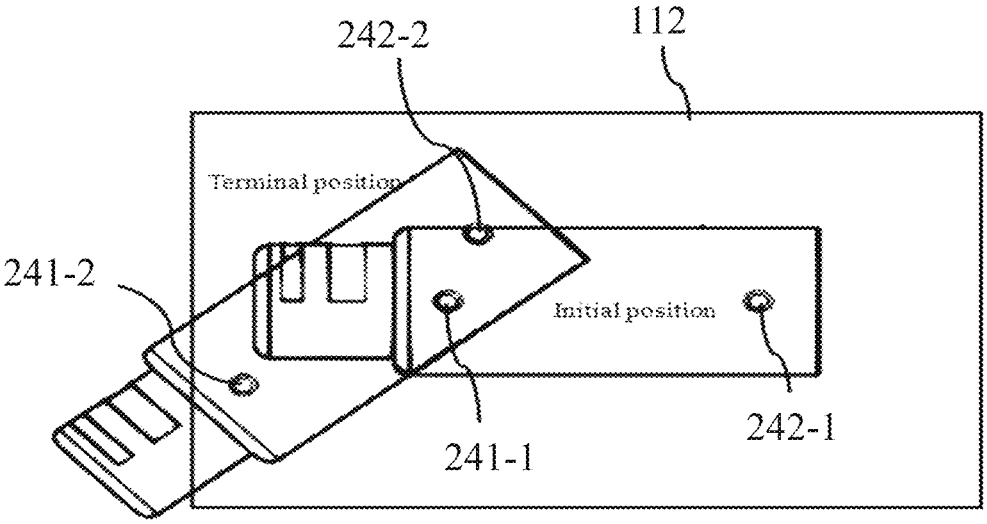
FIG. 24 is a schematic diagram of a first convex portion and a second convex portion in corresponding first convex portion initial position, first convex portion terminal position, second convex portion initial position and second convex portion terminal position on an effuser mounting portion when the effuser is located in an initial position and a terminal position.
Figure 25:
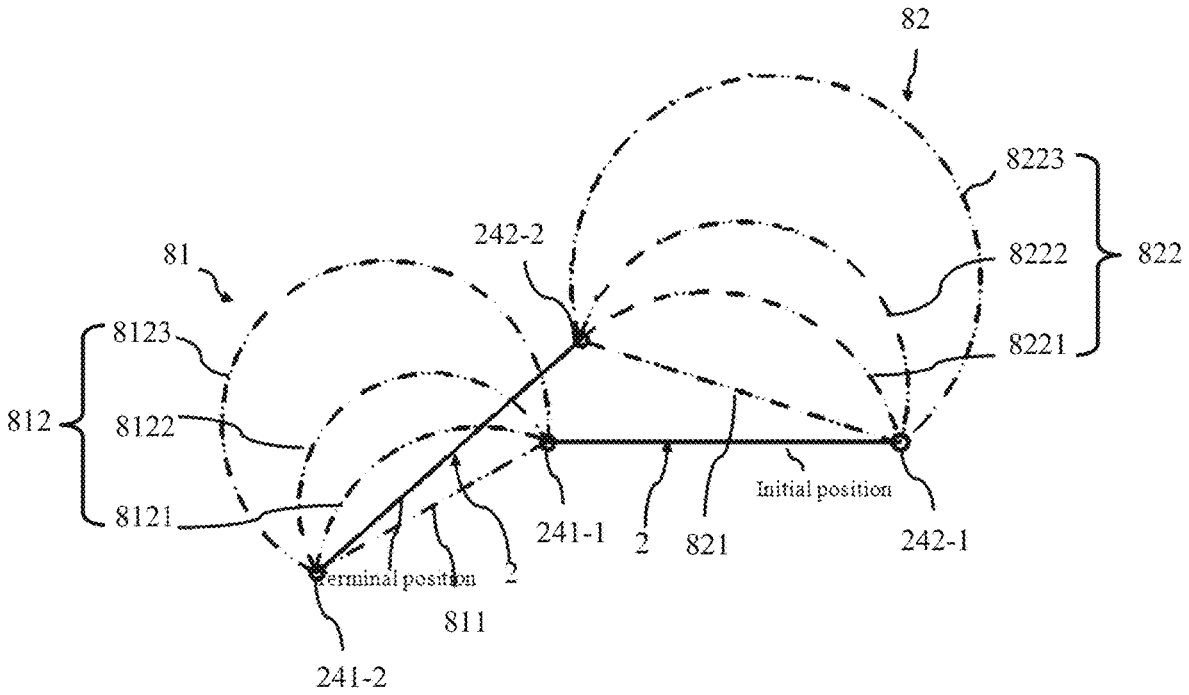
FIG. 25 is a schematic diagram of a first guiding groove and a second guiding groove with multiple structural forms.
Figure 26:
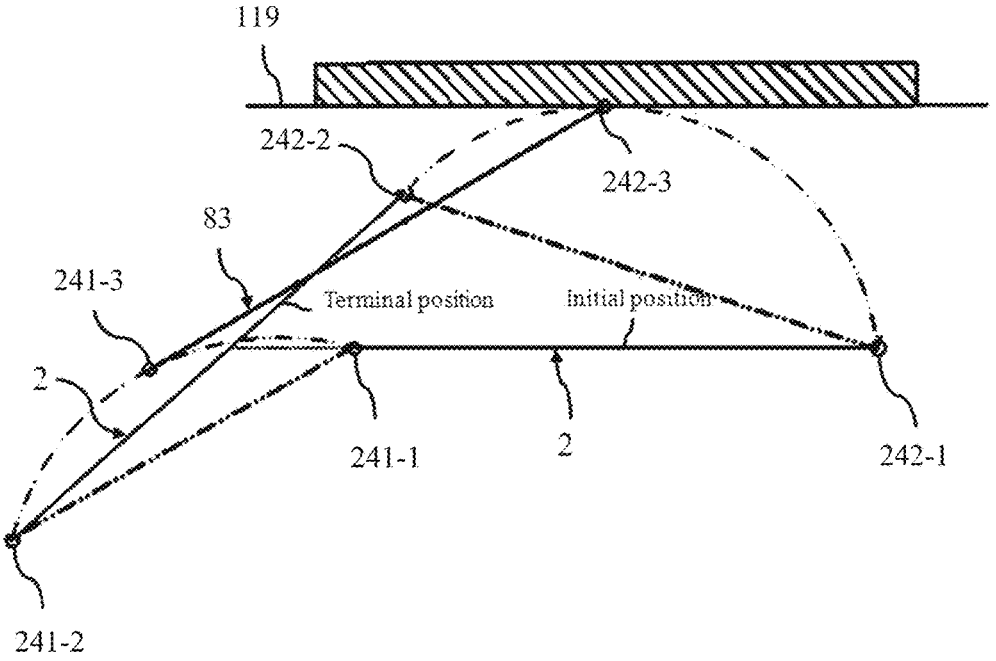
FIG. 26 is a schematic diagram showing that the second guiding groove is tangent to an effuser height limiting plane to form a second minor arc groove tangent point, and a tangent line of a vertex of a first minor arc groove passes through the second minor arc groove tangent point.
Figure 27:
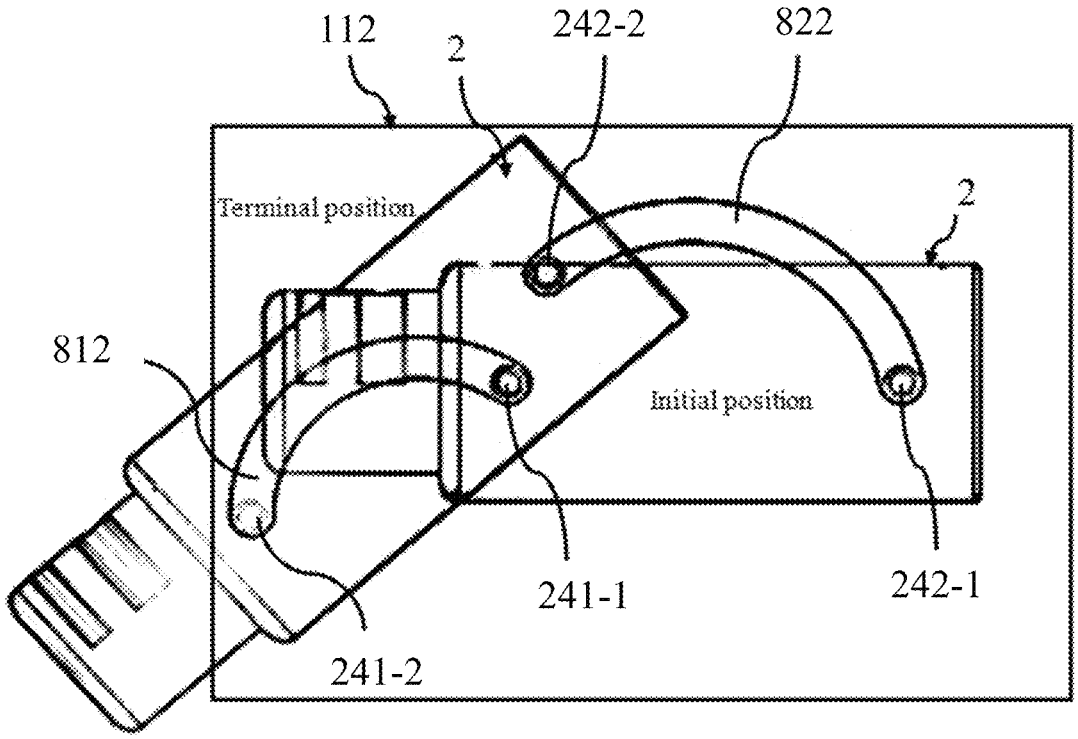
FIG. 27 is a schematic diagram showing that the first guiding groove is connected between the first convex portion initial position and the first convex portion terminal position, and the second guiding groove is connected between the second convex portion initial position and the second convex portion terminal position.

FIG. 20 is a stereoscopic diagram of an effuser device provided by an embodiment of the present disclosure. FIG. 21 is an exploded view of the effuser device provided by an embodiment of the present disclosure. FIG. 22 is a schematic diagram of the effuser in an extended state. FIG. 23 is an exploded view of a driving mechanism. FIG. 24 is a schematic diagram of a first convex portion and a second convex portion in corresponding first convex portion initial position, first convex portion terminal position, second convex portion initial position and second convex portion terminal position on an effuser mounting portion when the effuser is located in an initial position and a terminal position. FIG. 25 is a schematic diagram of a first guiding groove and a second guiding groove with multiple structural forms. FIG. 26 is a schematic diagram showing that the second guiding groove is tangent to an effuser height limiting plane to form a second minor arc groove tangent point, and a tangent line of a vertex of a first minor arc groove passes through the second minor arc groove tangent point. FIG. 27 is a schematic diagram showing that the first guiding groove is connected between the first convex portion initial position and the first convex portion terminal position, and the second guiding groove is connected between the second convex portion initial position and the second convex portion terminal position.

As shown in FIG. 20 to FIG. 27, an effuser device provided by an embodiment of the present disclosure includes an effuser mounting portion 112, an effuser 2 capable of moving back and forth relative to the effuser mounting portion 112, and a driving mechanism 4 for driving the effuser 2 to move.

An output end of the driving mechanism 4 is connected to the effuser 2.

A guiding mechanism for guiding and limiting movement of the effuser 2 is arranged between a side portion of the effuser 2 and the effuser mounting portion 112 of an effuser box 10.

The guiding mechanism includes a first convex portion 241 and a second convex portion 242 which are arranged on the effuser 2 or the effuser mounting portion 112 at an interval back and forth, and a first guiding groove 81 and a second guiding groove 82 which are arranged on the effuser mounting portion 112 or the effuser 2 at an interval back and forth.

The first convex portion 241 is in clearance fit in the first guiding groove 81, and the second convex portion 242 is in clearance fit in the second guiding groove 82.

The effuser 2 has an initial position in a contained state and a terminal position in an extended state.

When the effuser 2 is located in the initial position, the first convex portion 241 is contacted with one end of the first guiding groove 81, and the second convex portion 242 is contacted with one end of the second guiding groove 82.

When the effuser 2 is located in the terminal position, the first convex portion 241 is contacted with the other end of the first guiding groove 81, and the second convex portion 242 is contacted with the other end of the second guiding groove 82.

The effuser device provided by the embodiment of the present disclosure includes the effuser mounting portion 112, the effuser 2, and the driving mechanism 4.

The effuser mounting portion 112 may be a bracket, a housing of a toilet, or a side plate of the effuser box 10.

The effuser 2 is slidably connected with the effuser mounting portion 112, and the effuser 2 may move back and forth relative to the effuser mounting portion 112 to extend and retract. A front end of the effuser 2 is provided with a nozzle 23, and a rear end of the effuser is provided with a water supply pipe 3.

The driving mechanism 4 may be mounted outside the effuser mounting portion 112 and may also be mounted on the effuser mounting portion 112.

An input end of the driving mechanism 4 is connected to the rear end of the effuser 2, and the driving mechanism 4 may drive the effuser 2 to move back and forth to make the effuser 2 extend and retract.

The driving mechanism 4 may be a cylinder mechanism, a motor-gear mechanism, a motor-transmission chain mechanism, etc.

Under an action of the driving mechanism 4, the effuser 2 has an extended state of extending and retracting relative to the effuser mounting portion 112 and a contained state of being contained on one side of the effuser mounting portion 112.

When the effuser 2 is in the contained state, the whole effuser 2 is contained on one side of the effuser mounting portion 112, and at the moment, the effuser 2 is located in an initial position.

When the effuser 2 is in the extended state, the front end of the effuser 2 with the nozzle 23 extends forwards, which may be used for washing by a user. At the moment, the effuser 2 is located in a terminal position, and the effuser 2 no longer slides forward after sliding to the terminal position.

In order to control a track of the effuser 2, the guiding mechanism is arranged between the side portion of the effuser 2 and the effuser mounting portion 112 and is used for guiding and limiting the movement of the effuser 2.

The guiding mechanism includes the first convex portion 241, the second convex portion 242, the first guiding groove 81, and the second guiding groove 82. The first convex portion 241 and the second convex portion 242 are arranged at an interval back and forth, the first convex portion 241 is located on a front side of the second convex portion 242, and the first convex portion 241 is smaller than the second convex portion 242. The first guiding groove 81 and the second guiding groove 82 are arranged at an interval back and forth, the first guiding groove 81 is located on a front side of the second guiding groove 82, and a groove width of the first guiding groove 81 is smaller than that of the second guiding groove 82.

A first arrangement mode of the guiding mechanism is that the first convex portion 241 and the second convex portion 242 may be selectively arranged on the side portion of the effuser 2, and then the first guiding groove 81 and the second guiding groove 82 are arranged on the effuser mounting portion 112.

A second arrangement mode of the guiding mechanism is that the first convex portion 241 and the second convex portion 242 may be selectively arranged on the effuser mounting portion 112, and then the first guiding groove 81 and the second guiding groove 82 are arranged on the side portion of the effuser 2.

The first convex portion 241 is in clearance fit with the first guiding groove 81, the first convex portion 241 may slide relative to the first guiding groove 81, and the first guiding groove 81 guides the first convex portion 241.

The second convex portion 242 is in clearance fit with the second guiding groove 82, the second convex portion 242 may slide relative to the second guiding groove 82, and the second guiding groove 82 guides the second convex portion 242.

Meanwhile, the first guiding groove 81 may also limit forward and backward movement of the first convex portion 241, and the second guiding groove 81 may also limit forward and backward movement of the second convex portion 242. Specific descriptions are as follow.

When the effuser 2 is located in the initial position, the first convex portion 241 is contacted with one end of the first guiding groove 81, and meanwhile, the second convex portion 242 is contacted with one end of the second guiding groove 82.

When the effuser 2 is located in the terminal position, the first convex portion 241 is contacted with the other end of the first guiding groove 81, and meanwhile, the second convex portion 242 is contacted with the other end of the second guiding groove 82.

In a case of using the above first arrangement mode in the guiding mechanism: when the effuser 2 is located in the initial position, the first convex portion 241 is contacted with a rear end of the first guiding groove 81, and meanwhile, the second convex portion 242 is contacted with a rear end of the second guiding groove 82; when the effuser 2 is located in the terminal position, the first convex portion 241 is contacted with a front end of the first guiding groove 81, and meanwhile, the second convex portion 242 is contacted with a front end of the second guiding groove 82.

In a case of using the above second arrangement mode in the guiding mechanism: when the effuser 2 is located in the initial position, the first convex portion 241 is contacted with the front end of the first guiding groove 81, and meanwhile, the second convex portion 242 is contacted with the front end of the second guiding groove 82. When the effuser 2 is located in the terminal position, the first convex portion 241 is contacted with the rear end of the first guiding groove 81, and meanwhile, the second convex portion 242 is contacted with the rear end of the second guiding groove 82.

From this, the first guiding groove 81 and the second guiding groove guide 6 guide and limit the first convex portion 241 and the second convex portion 242 synchronously, so that the movement track of the effuser 2 can be limited, and the movement of the effuser can meet needs of a user.

In one embodiment, the first convex portion 241 and the second convex portion 242 are cylinders or rollers, respectively. A contact surface between the cylinder and the first guiding groove 81 or the second guiding groove 82 is an arc surface, which can reduce friction between the cylinder and a groove wall and facilitates the cylinder to move along the first guiding groove 81 or the second guiding groove 82, thus guiding the effuser 2.

The roller may be mounted on the effuser 2 or the effuser mounting portion 112 through a wheel axle, the roller is in rolling contact with the first guiding groove 81 or the second guiding groove 82, and friction between the roller and the groove wall is rolling friction, which reduces a friction force, and facilitates the roller to roll along the first guiding groove 81 or the second guiding groove 6, thus guiding the effuser 2.

In one embodiment, the effuser device includes two effuser mounting portions 112, the effuser 2 is located between the two effuser mounting portions 112, and the effuser 2 is connected to each effuser mounting portion 112 through the guiding mechanism. The effuser device includes two oppositely arranged effuser mounting portions 112, and one guiding mechanism is respectively arranged between left and right sides of the effuser 2 and the two effuser mounting portions 112. The guiding mechanisms on the two sides may support and guide the effuser 2, and the movement track of the effuser 2 may be defined by tracks of the first guiding groove 81 and the second guiding groove 82.

In one embodiment, as shown in FIG. 20 to FIG. 27, the effuser device includes the effuser box 10, and the effuser mounting portion 112 is a side plate of the effuser box 10.

Specifically, the effuser box 10 includes an effuser box bottom plate 111, the effuser mounting portions 112 arranged on two sides of the effuser box bottom plate 111, an effuser box top plate 110' mounted above the two effuser mounting portions 112, and an effuser box rear end plate mounted at rear ends of the two effuser mounting portions 112 and the effuser box top plate 110'.

A front end of the effuser box 10 is provided with a box body opening 114, an effuser door 120' is mounted on the box body opening 114, and an upper end of the effuser door 120' is mounted on the effuser box top plate 110' through a rotating shaft or a hinge. The effuser door 120' is capable of being turned up and down around the shaft, so that the box body opening 114 is capable of being opened and closed.

The effuser 2 is connected to the effuser mounting portion 112 through the above guiding mechanism, and the effuser 2 is capable of moving forward to extend out of the effuser box 10 or moving backward to be contained in the effuser box 10.

When the effuser 2 is in the contained state, the whole effuser 2 is contained in the effuser box 10, the box body opening 114 is closed through the effuser door 120', and at the moment, a position of the effuser 2 in the effuser box 10 is the initial position.

When the effuser 2 is in the extended state, the front end of the effuser 2 with the nozzle 23 extends forward from the box body opening 114, which may be used for washing by a user. At the moment, the position of the effuser 2 in the effuser box 10 is the terminal position, and the effuser 2 no longer slides forward after sliding to the terminal position.

In one embodiment, the effuser door 120' is hinged to the box body opening 114, and an effuser door driving mechanism for driving the effuser door 120' to be opened and closed is mounted on the effuser box 10. The effuser door driving mechanism may be a cylinder, a motor-gear assembly, a motor rocker assembly, etc. An output end of the effuser door driving mechanism is connected to the effuser door 120'.

When the effuser 2 needs to extend, the effuser door 120' is opened through the effuser door driving mechanism first, and then the front end of the effuser 2 with the nozzle 23 extends forward from the box body opening 114, which can avoid the effuser 2 from touching the effuser door 120' to generate abnormal noise. After the effuser 2 retracts, the effuser door 120' is closed through the effuser door driving mechanism to seal the box body opening 114.

In one embodiment, as shown in FIG. 22, the effuser 2 may be a telescopic effuser, which includes a plurality of casings 20 sheathed together, and two adjacent casings 20 may slide relatively, so that the effuser 2 may extend and retract by itself, thus increasing a telescopic amount of the effuser 2. The nozzle 23 is arranged on the casing 20 at a frontmost end.

In one embodiment, the first convex portion 241 and the second convex portion 242 are arranged on a side portion of the effuser 2, and the first guiding groove 81 and the second guiding groove 82 are arranged on an inner surface of the effuser mounting portion 112.

The first convex portion 241 and the second convex portion 242 respectively and correspondingly have a first convex portion initial position 241-1, a second convex portion initial position 242-1, a first convex portion terminal position 241-2, and a second convex portion terminal position 242-2 on the effuser mounting portion 112.

The first guiding groove 81 is connected between the first convex portion initial position 241-1 and the first convex portion terminal position 241-2, and the second guiding groove 82 is connected between the second convex portion initial position 242-1 and the second convex portion terminal position 242-2.

In the embodiment and the following embodiments, the above first arrangement mode is used in the guiding mechanism.

Specifically, the first convex portion 241 and the second convex portion 242 may be arranged on one casing 20 at a rearmost end. The initial position and the terminal position of the effuser 2 may refer to an initial position and a terminal position of one casing 20 at the rearmost end relative to the effuser mounting portion 112, or an initial position and a terminal position of one casing 20 at the rearmost end in the effuser box 10.

When the effuser 2 is located in the initial position, the first convex portion 241 and the second convex portion 242 have the first convex portion initial position 241-1 and the second convex portion initial position 242-1, respectively, on the effuser mounting portion 112. When the effuser 2 is located in the initial position, the first convex portion 241 is projected towards the effuser mounting portion 112, which is namely the first convex portion initial position 241-1. When the effuser 2 is located in the initial position, the second convex portion 242 is projected towards the effuser mounting portion 112, which is namely the second convex portion initial position 242-1.

When the effuser 2 is located in the terminal position, the first convex portion 241 and the second convex portion 242 respectively and correspondingly have the first convex portion terminal position 241-2 and the second convex portion terminal position 242-2 on the effuser mounting portion 112. When the effuser 2 is located in the terminal position, the first convex portion 241 is projected towards the effuser mounting portion 112, which is namely the first convex portion terminal position 241-2. When the effuser 2 is located in the terminal position, the second convex portion 242 is projected towards the effuser mounting portion 112, which is namely the second convex portion terminal position 242-2.

The first guiding groove 81 is connected between the first convex portion initial position 241-1 and the first convex portion terminal position 241-2, and the first convex portion initial position 241-1 and the first convex portion terminal position 241-2 are two ends of the first guiding groove 81. The first convex portion 241 is in clearance fit in the first guiding groove 81, and the first convex portion 241 is capable of sliding or moving in the first guiding groove 81. When the first convex portion 241 is located in the first convex portion initial position 241-1 in the first guiding groove 81, the effuser 2 is in the contained state, and is located in the initial position. When the first convex portion 241 is located in the first convex portion terminal position 241-2 in the first guiding groove 81 by movement of the effuser 2, the effuser 2 is in the extended state, and is located in the terminal position.

The second guiding groove 82 is connected between the second convex portion initial position 242-1 and the second convex portion terminal position 242-2, and the second convex portion initial position 242-1 and the second convex portion terminal position 242-2 are two ends of the second guiding groove 82. The second convex portion 242 is in clearance fit in the second guiding groove 82, and the second convex portion 242 is capable of sliding or moving in the second guiding groove 82. When the second convex portion 242 is located in the second convex portion initial position 242-1 in the second guiding groove 82, the effuser 2 is in the contained state, and is located in the initial position. When the second convex portion 242 is located in the second convex portion terminal position 242-2 in the second guiding groove 82 by movement of the effuser 2, the effuser 2 is in the extended state, and is located in the terminal position.

An action that the first guiding groove 81 guides and limits the first convex portion 241 is synchronous with an action that the second guiding groove 82 guides and limits the second convex portion 242. That is, when the first convex portion 241 is located in the first convex portion initial position 241-1 in the first guiding groove 81, the second convex portion 242 is located in the second convex portion initial position 242-1 in the second guiding groove 82. When the first convex portion 241 is located in the first convex portion terminal position 241-2 in the first guiding groove 81, the second convex portion 242 is located in the second convex portion terminal position 242-2 in the second guiding groove 82.

According to the effuser device provided in the embodiment, the first guiding groove 81 and the second guiding groove 82 may be correspondingly arranged on the effuser mounting portion 112 according to the first convex portion 241 and the second convex portion 24 on the effuser 2, two ends of the first guiding groove 81 are the initial position and the terminal position of the first convex portion 241, and two ends of the second guiding groove 82 are the initial position and the terminal position of the second convex portion 242. Therefore, the first guiding groove 81 and the second guiding groove 82 may respectively guide and limit the first convex portion 241 and the second convex portion 242, and the first guiding groove 81 and the second guiding groove 82 guide and limit the first convex portion 241 and the second convex portion 242 synchronously, so that the movement track of the effuser 2 may be defined, and the movement of the effuser can meet needs of a user.

In the embodiment, the first guiding groove 81 and the second guiding groove 82 may be grooves arranged on the inner surface of the effuser mounting portion 112 and may also be through holes penetrating through the inner surface and an outer surface of the effuser mounting portion 112.

In one embodiment, as shown in FIG. 25, the first guiding groove 81 is a first linear groove 811, and the second guiding groove 82 is a second linear groove 821.

In a direction from back to front, the first linear groove 811 gradually extends downwardly and obliquely, and the second linear groove 821 gradually extends upwardly and obliquely.

In the embodiment, the first guiding groove 81 is a linear groove and is specifically the first linear groove 811. The second guiding groove 82 is also a linear groove and is specifically the second linear groove 821.

Two ends of the first linear groove 811 are the first convex portion initial position 241-1 and the first convex portion terminal position 241-2, and two ends of the second linear groove 821 are the second convex portion initial position 242-1 and the second convex portion terminal position 242-2.

The second linear groove 821 is located above a rear side of the first linear groove 811, and a connecting line between the first convex initial position 241-1 and the second convex initial position 4-1 is basically parallel to a plane where the effuser box bottom plate 111 is located, so that the effuser 2 in the initial position is basically parallel to the plane where the effuser box bottom plate 111 is located.

The second convex terminal position 242-2 is located diagonally above a rear portion of the first convex initial position 241-1, and the first convex terminal position 241-2 is located diagonally below a front portion of the first convex initial position 241-1.

Therefore, in a direction from back to front, the first linear groove 811 gradually extends downwardly and obliquely, and the second linear groove 821 gradually extends upwardly and obliquely.

According to this arrangement, when the effuser 2 is driven to move forward and extend, a rear end of the effuser 2 gradually moves forward and upward, and the front end of the effuser 2 with the nozzle 23 gradually moves forward and downward, so that the nozzle 23 may be tilted forward and upward, and water sprayed from the nozzle 23 may be obliquely sprayed forward and upward, which is convenient for washing a private part by a user.

In one embodiment, as shown in FIG. 25, the first guiding groove 81 is a first arc groove 812, and the second guiding groove 82 is a second arc groove 822.

Two sides of an opening of the first arc groove 812 are the first convex portion initial position 241-1 and the first convex portion terminal position 241-2.

Two sides of an opening of the second arc groove 822 are the second convex portion initial position 242-1 and the second convex portion terminal position 242-2.

The second convex portion terminal position 242-2 is located above the first convex portion initial position 241-1.

In a direction from back to front, a connecting line between the first convex portion initial position 241-1 and the first convex portion terminal position 241-2 gradually extends downwardly and obliquely, and a connecting line between the second convex portion initial position 242-1 and the second convex portion terminal position 242-2 gradually extends upwardly and obliquely.

In the embodiment, the first guiding groove 81 is an arc groove and is specifically the first arc groove 812. The second guiding groove 82 is also an arc groove and is specifically the second arc groove 822.

In the embodiment, the first guiding groove 81 and the second guiding groove 82 are curved grooves or curved guiding grooves. By controlling the movement track of the effuser 2 with the curved guiding grooves, the effuser 2 may be contained in the effuser box 10 in a flat orientation after use, which can effectively reduce a height of the effuser box 10, make the effuser box 10 smaller to save an internal space of a toilet, and facilitate internal layout of the toilet.

Two sides or two ends of an opening of the first arc groove 812 are the first convex portion initial position 241-1 and the first convex portion terminal position 241-2. Two sides or two ends of an opening of the second arc groove 822 are the second convex portion initial position 242-1 and the second convex portion terminal position 242-2.

The second arc groove 822 is located above a rear side of the first arc groove 812, and a connecting line between the first convex initial position 241-1 and the second convex initial position 242-1 is basically parallel to a plane where the effuser box bottom plate 111 is located, so that the effuser 2 in the initial position is basically parallel to the plane where the effuser box bottom plate 111 is located. The effuser 2 in the initial position may be contained in the effuser box 10 in a flat orientation.

The second convex terminal position 242-2 is located diagonally above a rear portion of the first convex initial position 241-1, and the first convex terminal position 241-2 is located diagonally below a front portion of the first convex initial position 241-1.

Therefore, in a direction from back to front, a connecting line between the first convex portion initial position 241-1 and the first convex portion terminal position 241-2 gradually extends downwardly and obliquely, and a connecting line between the second convex portion initial position 242-1 and the second convex portion terminal position 242-2 gradually extends upwardly and obliquely, so that the opening of the first arc groove 812 faces downward and backward, and the opening of the second arc groove 822 faces downward and forwards.

According to this arrangement, when the effuser 2 is driven to move forward and extend, a rear end of the effuser 2 gradually moves forward and upward first, and then moves forward and downward, and the front end of the effuser 2 with the nozzle 23 gradually moves forward and upward, and then moves forward and downward, so that the nozzle 23 may be tilted forward and upward, and water sprayed from the nozzle 23 may be obliquely sprayed forward and upward, which is convenient for washing a private part by a user.

In one embodiment, as shown in FIG. 25, the first arc groove 812 is a first minor arc groove 8121, a first semi-arc groove 8122, or a first major arc groove 8123.

Correspondingly, the second arc groove 822 is a second minor arc groove 8221, a second semi-arc groove 8222, or a second major arc groove 8223.

When the first arc groove 812 is the first minor arc groove 8121, the second arc groove 822 is the second minor arc groove 8221.

When the first arc groove 812 is the first semi-arc groove 8122, the second arc groove 822 is the second semi-arc groove 8222.

When the first arc groove 812 is the first major arc groove 8123, the second arc groove 822 is the second major arc groove 8223.

In a case that the first arc groove 812 and the second arc groove 822 are major arc grooves, when the effuser 2 extends, the effuser 2 may move backward first at the beginning, and then move forwards. The effuser 2 needs a maximum height space.

In a case that the first arc groove 812 and the second arc groove 822 are semi-arc grooves, when the effuser 2 extends, the effuser 2 may move forward directly. The effuser 2 needs a medium height space.

In a case that the first arc groove 812 and the second arc groove 822 are minor arc grooves, when the effuser 2 extends, the effuser 2 may move forward directly. The effuser 2 needs a minimum height space.

The linear groove, the major arc groove, the semi-arc groove, and the minor arc groove above may meet requirements of different working conditions.

In one embodiment, as shown in FIG. 26, an effuser height limiting plane 119 is arranged above the effuser 2.

The second minor arc groove 621 is tangent to the effuser height limiting plane 119, and a tangent point between the second minor arc groove 8221 and the effuser height limiting plane 119 is a second minor arc groove tangent point 242-3.

The effuser height limiting plane 119 may be a solid plane and may also be a dummy surface, and the effuser height limiting plane 119 may be obtained as long as a limited height L of the effuser 2 is obtained in advance and then the L is measured upward from the plane where the effuser box bottom plate 111 is located.

The effuser 2 may be ensured to not exceed the effuser height limiting plane 16 during movement as long as the second minor arc groove 8221 is tangent to the effuser height limiting plane 119.

When the effuser box 10 is used, the effuser height limiting plane 119 is located below the effuser box top plate 110'.

In one embodiment, the effuser height limiting plane 119 is a bottom surface of the effuser box top plate 110'. In one embodiment, the effuser height limiting plane 119 is a solid plane, which is the bottom surface of the effuser box top plate 110'. After obtaining a position of the second minor arc groove tangent point 242-3 on the bottom surface of the effuser box top plate 110' during design, a radius of the second minor arc groove 8221 can be appropriately reduced according to an actual situation to avoid the effuser 2 from being contacted with the bottom surface of the effuser box top plate 110' during movement.

In one embodiment, as shown in FIG. 26, a tangent line 83 of a vertex 241-3 of the first minor arc groove 8121 passes through the second minor arc groove tangent point 242-3.

A length of the tangent line 83 between the vertex 241-3 and the second minor arc groove tangent point 242-3 is equal to a length of the effuser 2.

An included angle between the effuser 2 in the terminal position and the effuser 2 in the initial position is $\alpha$, wherein $0<\alpha<90°$.

An included angle between the tangent line 83 and the effuser 2 in the initial position is $\beta$, wherein $0<\beta<90°$.

Then, $\beta$ is smaller than $\alpha$.

According to this arrangement, tracks of the first minor arc groove 8121 and the second minor arc groove 8221 may be planned in advance on the effuser mounting portion 112. Specific descriptions are as follows.

The initial position, an initial posture, the terminal position, and a terminal posture of the effuser 2 are preset according to specific working conditions, which are known, and the included angle $\alpha$ between the effuser 2 in the terminal position and the effuser 2 in the initial position is also known.

Consequently, specific tracks of the first minor arc groove 8121 and the second minor arc groove 8221 need to be determined on the effuser mounting portion 112.

If the effuser mounting portion 112 is a plastic plate, which is formed through injection by a mold, the track may be designed on the mold for manufacturing the effuser mounting portion 112, and the corresponding track on the mold is a guiding convex rib. Then, the corresponding effuser mounting portion 112 is manufactured by the mold, and the guiding groove is formed on the effuser mounting portion 112.

If the effuser mounting portion 112 is a hard plate, which may be directly grooved, then the track may also be directly designed on a substrate before forming the effuser mounting portion 112, and then after the track is obtained, the substrate is grooved to form the guiding groove, thus manufacturing of the effuser mounting portion 112 is completed.

The mold is taken as an example for illustration as follows.

The first convex portion initial position 241-1, the second convex portion initial position 242-1, the first convex portion terminal position 241-2, and the second convex portion terminal position 242-2 are determined on the mold for forming the effuser mounting portion 112 first.

According to the determined height L of the effuser height limiting plane 119, a straight line where the effuser height limiting plane 119 is located is marked in the mold.

An arc is drawn with the second convex portion initial position 242-1 and the second convex portion terminal position 242-2 as endpoints, the arc is tangent to the straight line where the effuser height limiting plane 119 is located, and a tangent point is the second minor arc groove tangent point 242-3, then a central axis curve of the second minor arc groove 8221 is obtained.

A tangent line 83 is made forward and downward from the second minor arc groove tangent point 242-3, the included angle between the tangent line 83 and the effuser 2 in the initial position is $\beta$, and $\beta$ is less than $\alpha$. Then, the vertex 241-3 is selected on the tangent line 83, wherein a distance between the vertex 241-3 and the second minor arc groove tangent point 242-3 is the length of the effuser 2. Then, an arc is drawn according to the first convex initial position 241-1 and the first convex terminal position 241-2, and the arc passes through the vertex 241-3, so that a central axis curve of the first minor arc groove 8121 is obtained.

Then, the central axis curve of the first minor arc groove 8121 and the central axis curve of the second minor arc groove 8221 are respectively taken as centers to symmetrically expand to two sides to form contours of a first guiding convex rib and a second guiding convex rib.

The first guiding convex rib and the second guiding convex rib which meet the requirements are formed in the contours. The guiding convex ribs may be formed on an inner surface of the mold by punching.

When the effuser mounting portion 112 is formed through injection by the mold, the first minor arc groove 8121 is formed in a position on the effuser mounting portion 112 corresponding to the first guiding convex rib in the mold, and the second minor arc groove 8221 is formed in a position on the effuser mounting portion 112 corresponding to the second guiding convex rib in the mold.

The substrate is taken as an example for illustration as follows.

The first convex portion initial position 241-1, the second convex portion initial position 242-1, the first convex portion terminal position 241-2, and the second convex portion terminal position 242-2 are determined on the substrate for forming the effuser mounting portion 112 first.

According to the determined height L of the effuser height limiting plane 119, a straight line where the effuser height limiting plane 119 is located is marked on the substrate.

An arc is drawn with the second convex portion initial position 242-1 and the second convex portion terminal position 242-2 as endpoints, the arc is tangent to the straight line where the effuser height limiting plane 119 is located, and a tangent point is the second minor arc groove tangent point 242-3, then a central axis curve of the second minor arc groove 8221 is obtained.

The tangent line 83 is made forward and downward from the second minor arc groove tangent point 242-3, the included angle between the tangent line 83 and the effuser 2 in the initial position is $\beta$, and $\beta$ is less than $\alpha$. Then, the vertex 241-3 is selected on the tangent line 83, wherein a distance between the vertex 241-3 and the second minor arc groove tangent point 242-3 is the length of the effuser 2. Then, an arc is drawn according to the first convex initial position 241-1 and the first convex terminal position 241-2, and the arc passes through the vertex 241-3, so that a central axis curve of the first minor arc groove 8121 is obtained.

Then, the central axis curve of the first minor arc groove 8121 and the central axis curve of the second minor arc groove 8221 are respectively taken as centers to symmetrically expand to two sides to form contours of the first minor arc groove 8121 and the second minor arc groove 8221.

The first minor arc groove 8121 is formed by directly cutting along the contour of the first minor arc groove 8121, and the second minor arc groove 8221 is formed by cutting along the contour of the second minor arc groove 8221, thus forming the first minor arc groove 8121 and the second minor arc groove 8221 on the effuser mounting portion 112.

In one embodiment, as shown in FIG. 20 and FIG. 23, the driving mechanism 4 includes a drive motor 41, a transmission device 5, and a transmission chain 52.

The drive motor 41 is mounted outside the effuser mounting portion 112, and a motor gear 411 is mounted on an output shaft of the drive motor. The transmission device 5 includes an input gear 511 and an output gear 512. The transmission device 5 is mounted inside the effuser mounting portion 112, and the motor gear 411 is located inside the effuser mounting portion 112.

The input gear 511 is meshed with the motor gear 411, the transmission chain 52 is meshed with the output gear 512, and one end of the transmission chain 52 is fixedly connected with a rear end of the effuser 2.

In the embodiment, the transmission chain 52 is an output end of the driving mechanism 4.

The transmission chain 52 is a hard chain or a chain belt capable of transmitting a horizontal force, which is capable of pushing the effuser 2 to move forwards and is also capable of pulling the effuser 2 to move backward.

When the drive motor 41 rotates in a first direction, the drive motor may drive the transmission chain 52 to move forward through the transmission device 5, and then drives the effuser 2 to move forwards, so that the effuser 2 may extend out through the box body opening 114, and the effuser 2 may reach the terminal position.

When the drive motor 41 rotates in a second direction, the drive motor may drive the transmission chain 52 to move backward through the transmission device 5, and then pulls the effuser 2 back to the initial position.

An embodiment of the present disclosure also provides a toilet, which includes the effuser device according to any one of the above embodiments. The effuser device is mounted in a housing at a rear end of the toilet.

According to needs, the above technical solutions may be combined to achieve the best technical effect.

The present disclosure discloses an effuser device and a toilet, wherein the effuser device includes an effuser mounting portion, an effuser, and a driving mechanism; a guiding mechanism for guiding and limiting movement of the effuser is arranged between a side portion of the effuser and the effuser mounting portion; the guiding mechanism includes a first convex portion and a second convex portion which are arranged on the effuser or the effuser mounting portion at an interval back and forth, and a first guiding groove and a second guiding groove which are arranged on the effuser mounting portion or the effuser at an interval back and forth; and the first convex portion is in clearance fit in the first guiding groove, and the second convex portion is in clearance fit in the second guiding groove. According to the effuser device and the toilet disclosed by the present disclosure, a movement track of the effuser can be limited by cooperation of the first convex portion and the second convex portion with the first guiding groove and the second guiding groove, so that the movement of the effuser can meet needs of a user.

Fourth Embodiment: Effuser Mounting Box and Effuser Device

Figure 28:
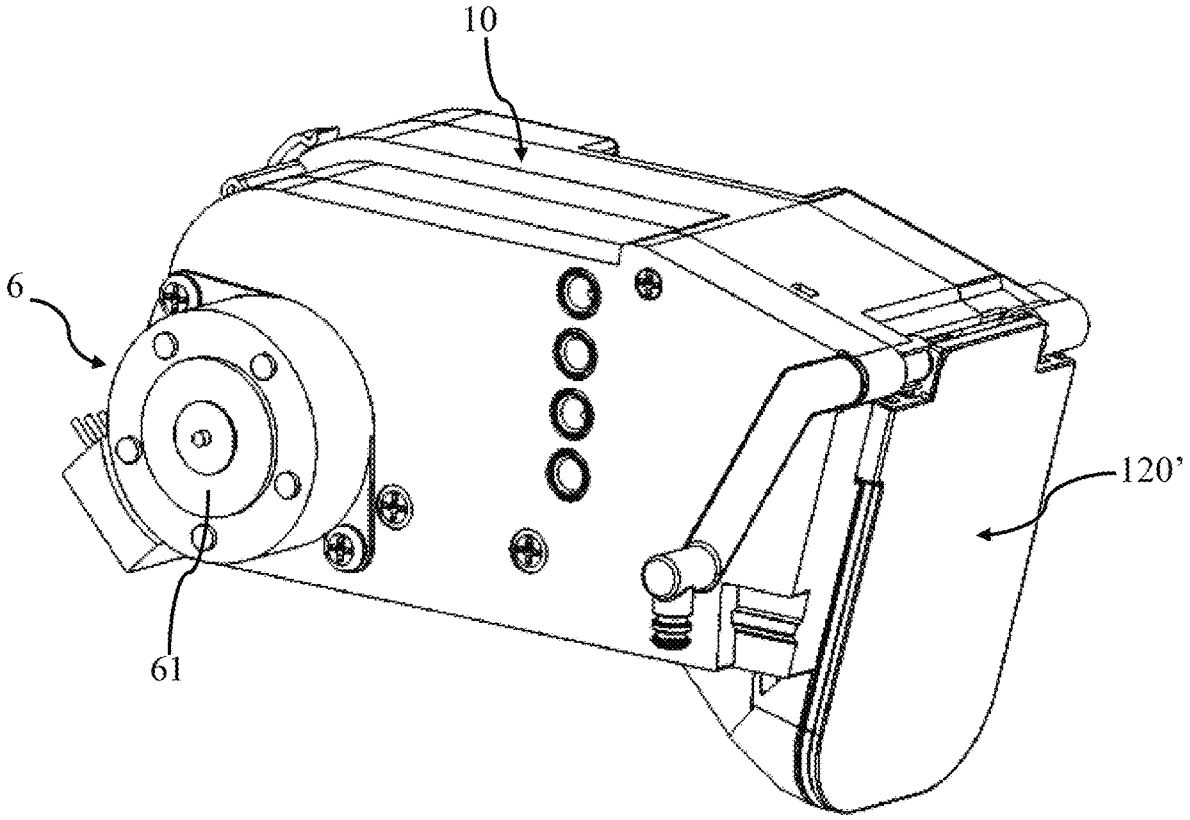
FIG. 28 is a perspective view of an effuser mounting box provided by an embodiment of the present disclosure.
Figure 29:
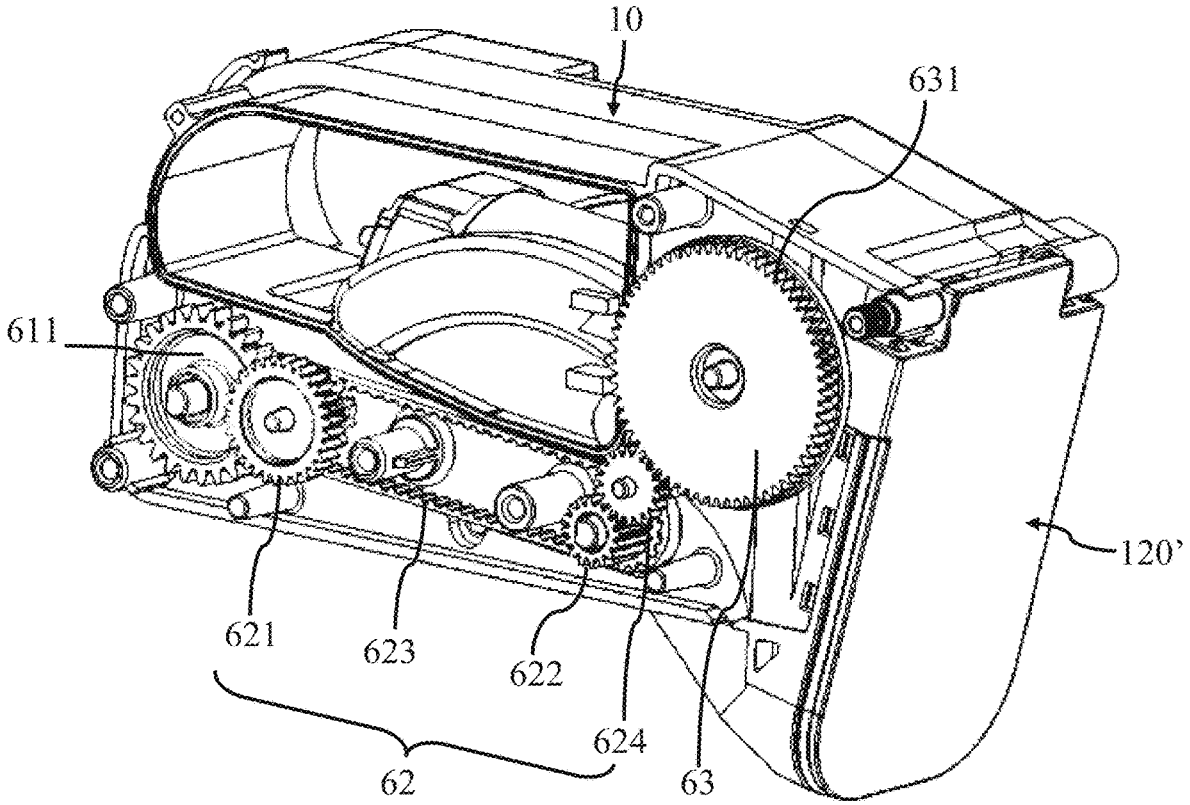
FIG. 29 is a schematic diagram showing that a driving mechanism is mounted at one side of a box body.
Figure 33:
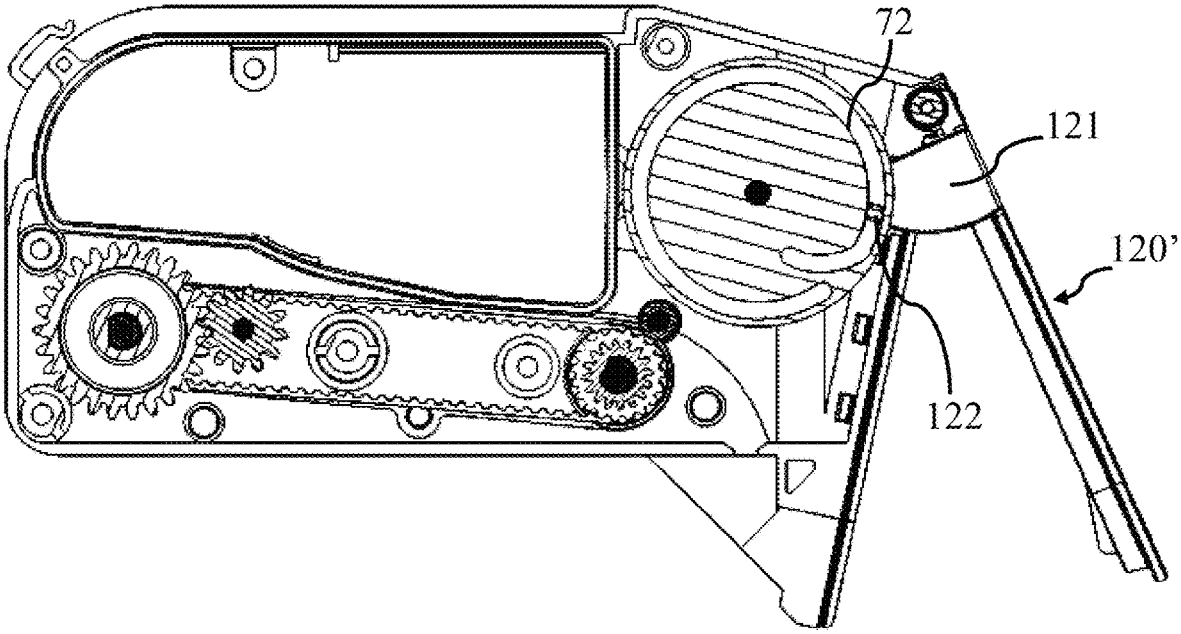
FIG. 33 is a schematic diagram showing that when the side plate pin shaft is located in the second guiding groove, the effuser door is kept in a completely opened state.
Figure 34:
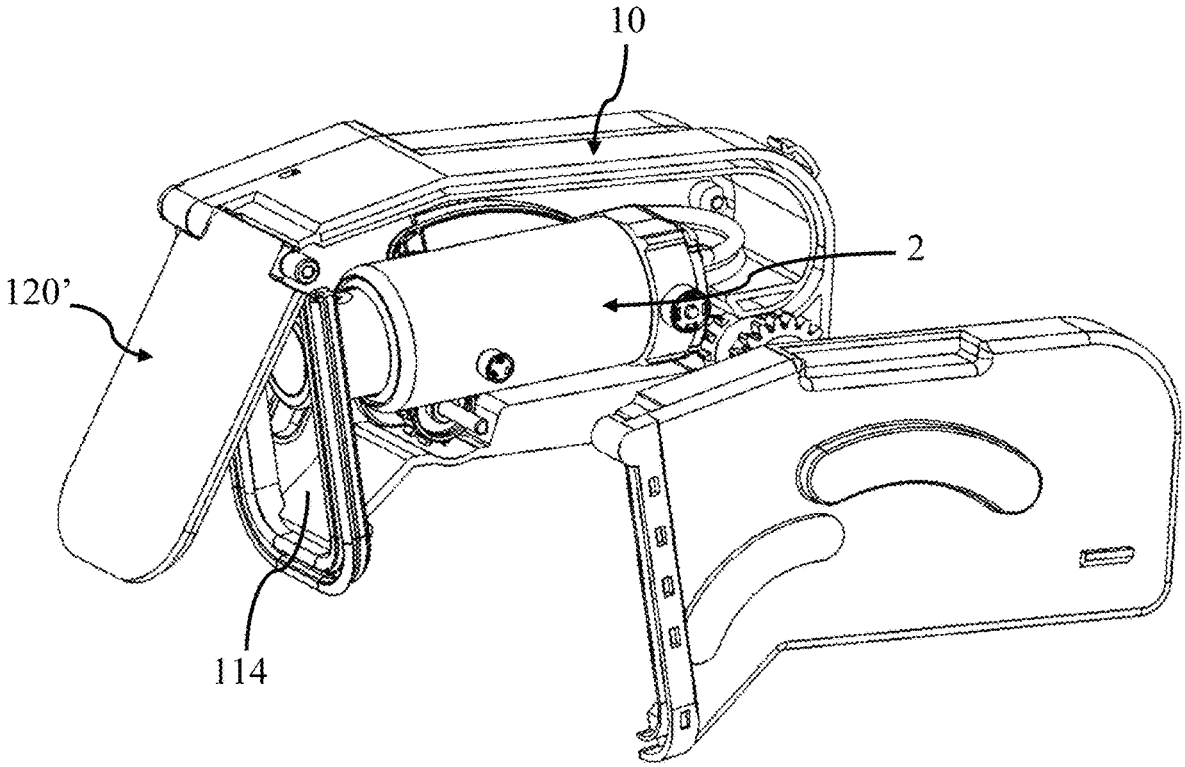
FIG. 34 is an exploded view of an effuser mounted in the effuser mounting box.
Figure 35:
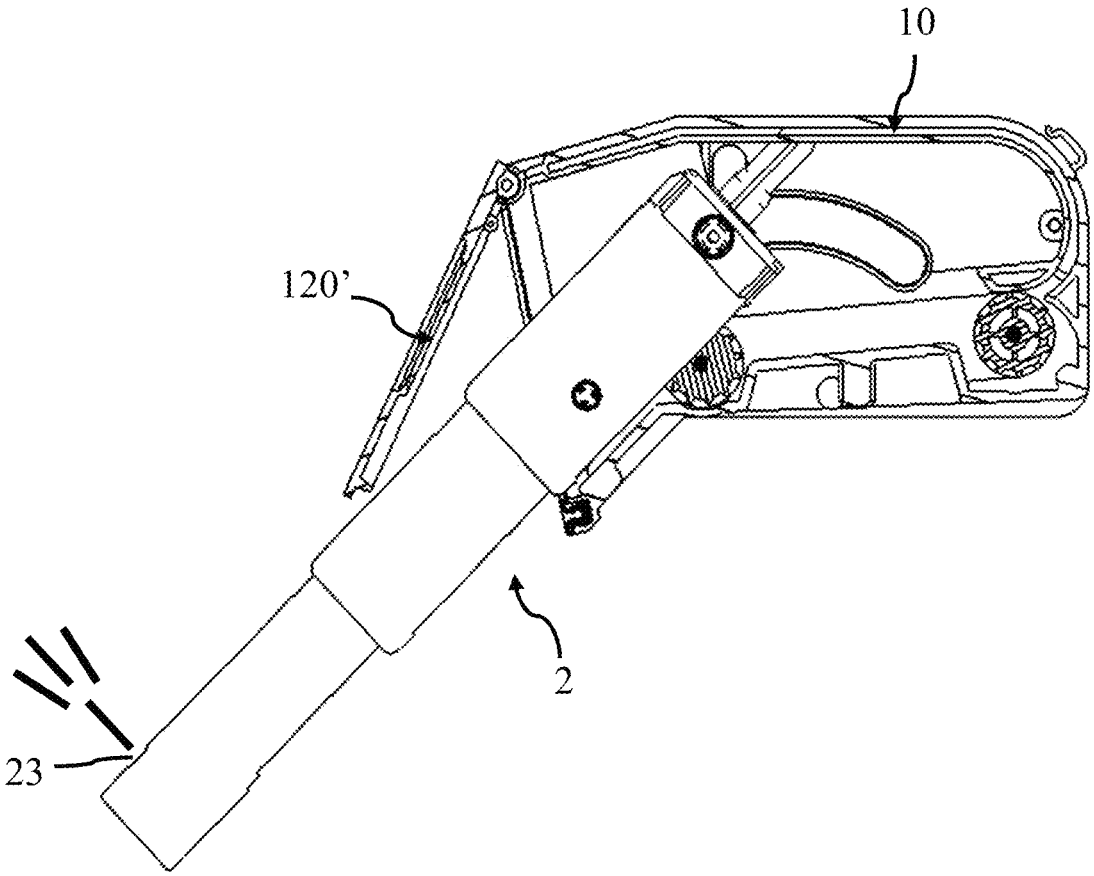
FIG. 35 is a schematic diagram of the effuser extending from the effuser mounting box.

FIG. 28 is a perspective view of an effuser mounting box provided by an embodiment of the present disclosure. FIG. 29 is a schematic diagram showing that a driving mechanism is mounted at one side of a box body. FIG. 33 is a schematic diagram showing that when the side plate pin shaft is located in the second guiding groove, the effuser door is kept in a completely opened state. FIG. 34 is an exploded view of an effuser mounted in the effuser mounting box. FIG. 35 is a schematic diagram of the effuser extending from the effuser mounting box.

As shown in FIGS. 28, 29, 33, 34, and 35, an effuser mounting box provided by an embodiment of the present disclosure includes a box body 10 for mounting an effuser 2, an effuser door 120' pivotally connected with the box body 10 and a driving mechanism 6 for driving the effuser door 120' to turn upward and downward.

A front end of the box body 10 is provided with a box body opening 114 for the effuser 2 to extend out.

An upper end of the effuser door 120' is connected to the box body 10 and the effuser door 120' is capable of opening and closing the box body opening 114.

The driving mechanism 6 is mounted on the box body 10 and an output end of the driving mechanism 6 is connected to the effuser door 120'.

The effuser mounting box provided by the present disclosure is mainly used for mounting the effuser 2. The effuser 2 may be telescopic, accommodated in the box body 10 of the effuser mounting box, or extended from the box body opening 114 of the box body 10.

The effuser door 120' is rotatably mounted at the front end of the box body 10 for closing and opening the box body opening 114. A top portion of the effuser door 120' is provided with a sleeve 123, a top portion at the front end of the box body 10 is provided with a mounting shaft, and the sleeve 123 is sheathed on the mounting shaft, so that the effuser door 120' can turn upward and downward to open and close the box body opening 114. When the effuser door 120' covers the box body opening 114, the effuser door 120' completely covers the box body opening 114, which is called that the effuser door 120' closes the box body opening 114. When the effuser door 120' turns upward and leaves the box body opening 114, the box body opening 114 is at least partially opened, which is called that the effuser door 120' opens the box body opening 114.

The driving mechanism 6 is mounted on one side of the box body 10 and is used for driving the effuser door 120' to turn upward and downward, so that the effuser door 120' opens and closes the box body opening 114. An output end of the driving mechanism 6 is connected to the effuser door 120'.

The driving mechanism 6 may be a drive motor, an air cylinder, a linkage mechanism and the like, as long as the driving mechanism can drive the effuser door 120' to rotate around the shaft.

According to the effuser mounting box provided by the present disclosure, the output end of the driving mechanism 6 is connected with the effuser door 2 by setting the driving mechanism 6, and the driving mechanism 6 opens the effuser door 120' before the effuser 2 needs to extend, so that the effuser 2 can smoothly extend from the box body opening 114 without being contacted with the effuser door 120'. After the effuser 2 retracts, the driving mechanism 6 drives the effuser door 120' to close. During extending and retracting of the effuser 2, the effuser 2 is unable to touch the effuser door 120', so that the extending movement of the effuser 2 is smoother and the effuser 2 is unable to be in frictional contact with the effuser door 120', which can reduce the noise during system operation.

Figure 30:
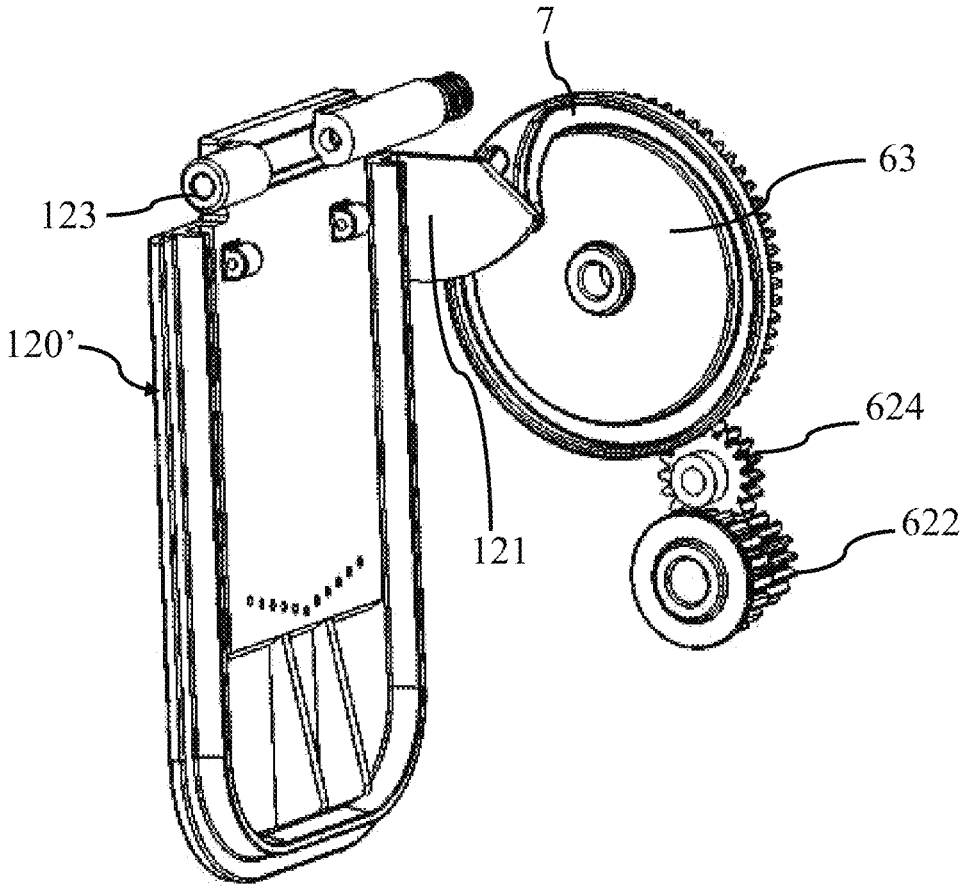
FIG. 30 is a schematic diagram showing that an output end rotating wheel is matched with an effuser door.

FIG. 30 is a schematic diagram showing that an output end rotating wheel is matched with an effuser door. FIG. 14 is a schematic diagram showing that a guiding groove is arranged on the output end rotating wheel. FIG. 15 is a top view showing that a side plate pin shaft is arranged on a side plate of an effuser door.

In one embodiment, as shown in FIGS. 30, 14, and 15, the output end of the driving mechanism 6 is an output end rotating wheel 63.

One side of the effuser door 120' close to the output end rotating wheel 63 is provided with a side plate 121 of the effuser door, and the side plate 121 of the effuser door extends towards a rear end of the box body 10.

The side plate 121 of the effuser door is provided with a side plate pin shaft 122 extending towards the output end rotating wheel 63.

One side of the output end rotating wheel 63 facing the side plate 121 of the effuser door is provided with a guiding groove 7.

One end of the side plate pin shaft 122 is matched in the guiding groove 7 and is capable of sliding in the guiding groove 7.

The output end rotating wheel 63 is mounted on one side of the box body 10 through a wheel axle. The driving mechanism 6 may drive the output end rotating wheel 63 to rotate, and the output end rotating wheel 63 is provided with the guiding groove 7. The guiding groove 7 may be a part of a cam groove, which is a curved groove. An upper portion of the effuser door 120' is provided with the side plate of the effuser door extending from front to back. The side plate pin shaft 122 is arranged on the side plate 121 of the effuser door and extends toward the output end rotating wheel 63. During assembly, an end portion of the side plate pin shaft 122 is inserted into the guiding groove 7, which is in clearance fit with the guiding groove 7 and can slide in the guiding groove 7. When the driving mechanism 6 drives the output end rotating wheel 63 to rotate, the side plate pin shaft 122 may slide in the guiding groove 7, and the effuser door 120' may be driven by the side plate 121 of the effuser door 120' to turn upward and downward to open and close the box body opening 114.

Figure 31:
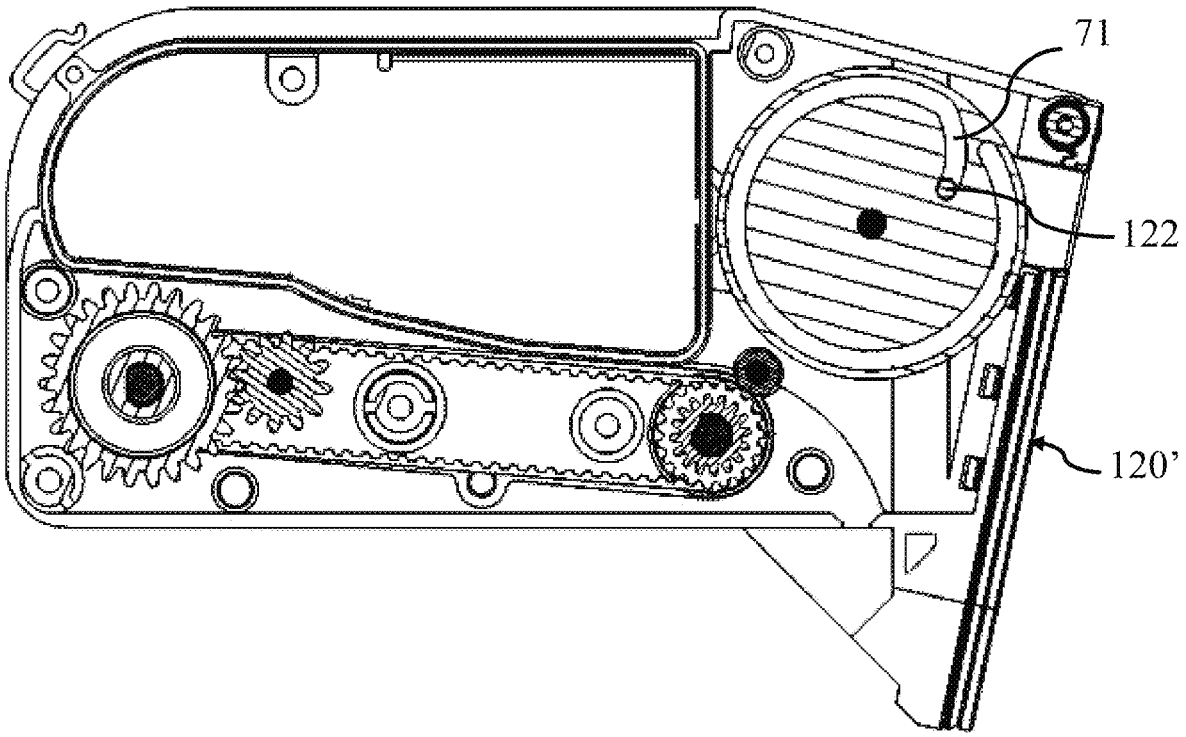
FIG. 31 is a schematic diagram showing that when the side plate pin shaft is located in an initial end of a first guiding groove, the effuser door is in a closed state.
Figure 32:
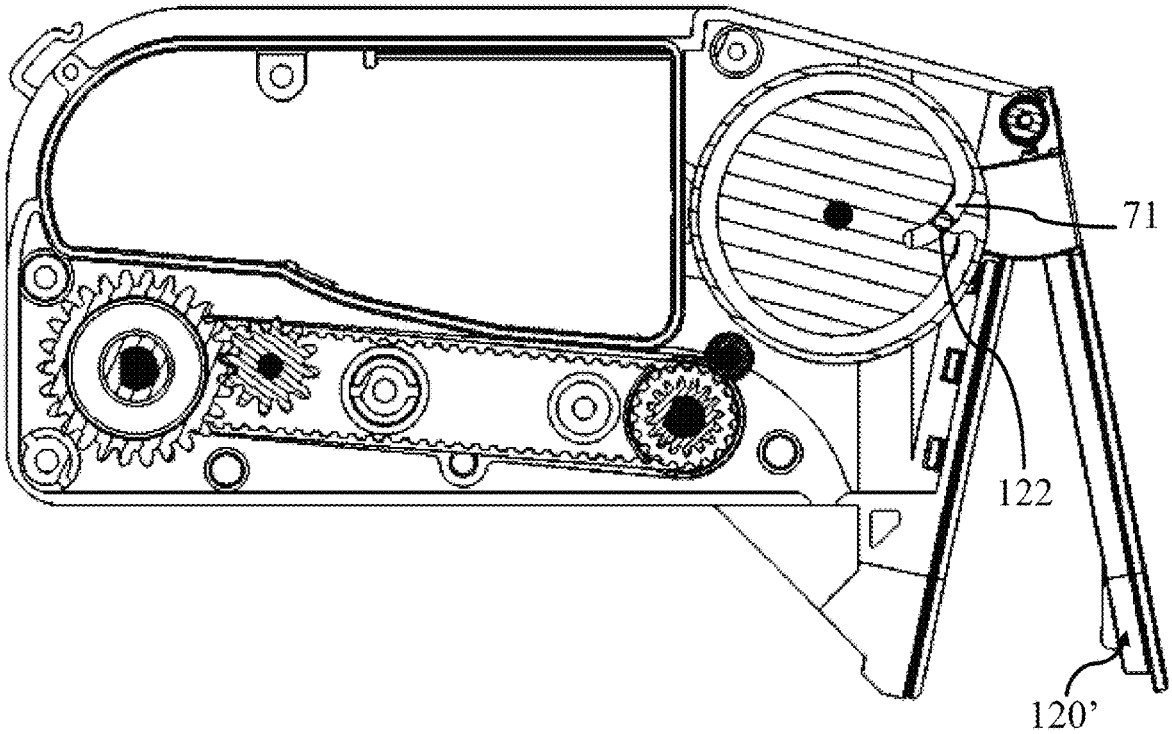
FIG. 32 is a schematic diagram showing that when the side plate pin shaft is located between the initial end of the first guiding groove and a terminal end of the first guiding groove, the effuser door is in a partially opened state.

FIG. 31 is a schematic diagram showing that when the side plate pin shaft is located in an initial end of a first guiding groove, the effuser door is in a closed state. FIG. 32 is a schematic diagram showing that when the side plate pin shaft is located between the initial end of the first guiding groove and a terminal end of the first guiding groove, the effuser door is in a partially opened state.

In one embodiment, as shown in FIGS. 14, 31, and 32, the guiding groove 7 includes a first guiding groove 71 with a curved contour line.

The first guiding groove 71 comprises an initial end 711 of the first guiding groove and a terminal end 712 of the first guiding groove.

The first guiding groove 71 extends from a middle portion to an edge on the output end rotating wheel 63, and the terminal end 712 of the first guiding groove is located outside the initial end 711 of the first guiding groove.

When the side plate pin shaft 122 is located in the initial end 711 of the first guiding groove, the effuser door 120' is in a closed state.

When the side plate pin shaft 122 is located between the initial end 711 of the first guiding groove and the terminal end 712 of the first guiding groove, the effuser door 120' is in a partially opened state.

When the side plate pin shaft 122 is located in the terminal end 712 of the first guiding groove, the effuser door 120' is in a completely opened state.

The guiding groove 7 includes the first guiding groove 71 with a curved contour line. The first guiding groove 71 is provided with the initial end 711 of the first guiding groove and the terminal end 712 of the first guiding groove opposite to each other, and a part between the initial end 711 of the first guiding groove and the terminal end 712 of the first guiding groove is a curved groove.

In a radial direction of the output end rotating wheel 63, the first guiding groove 71 extends from the middle portion to the edge on the output end rotating wheel 63. The terminal end 712 of the first guiding groove is located obliquely outside the initial end 711 of the first guiding groove.

When the side plate pin shaft 122 is located in the initial end 711 of the first guiding groove, the effuser door 120' is in a closed state. This is an initial state of the effuser door 120'.

When the driving mechanism 6 drives the output end rotating wheel 63 to rotate, the effuser door 120' is in a partially opened state before the side plate pin shaft 122 slides from the initial end 711 of the first guiding groove into the terminal end 712 of the first guiding groove. The partially opened state refers to a state before the effuser door 120' is completely opened, which is called a semi-opened state alternatively. This is an opening process of the effuser door 120'.

When the driving mechanism 6 drives the output end rotating wheel 63 to continuously rotate, the effuser door 120' is in a completely opened state when the side plate pin shaft 122 slides into the terminal end 712 of the first guiding groove. This is that the effuser door 120' is completely opened or opened to the maximum angle.

The driving mechanism 6 may drive the output end rotating wheel 63 to rotate reversely, so that the effuser door 120' is reset to the closed state.

In one embodiment, as shown in FIG. 14, in a direction from the initial end 711 of the first guiding groove to the terminal end 712 of the first guiding groove, a radius of curvature of the first guiding groove 71 is gradually increased. A curvature of the first guiding groove 71 affects a door opening speed. The steeper the curve is or the smaller the curvature is, the faster the door opening speed is. With this arrangement, the effuser door 120' opens faster in an initial opening stage, and the opening speed becomes slow after the effuser door 120' is opened to a certain angle, which is beneficial to control.

In one embodiment, as shown in FIG. 14, the guiding groove 7 further includes a second guiding groove 72 with a smooth arc contour line.

The second guiding groove 72 is concentrically arranged with a central axis 630 of the output end rotating wheel 63.

One end of the second guiding groove 72 is communicated with the terminal end 712 of the first guiding groove.

A distance between the terminal end 712 of the first guiding groove and the central axis 630 of the output end rotating wheel 63 is D, a radius of the second guiding groove 72 is R, then R=D.

When the side plate pin shaft 122 is located in the second guiding groove 72, the effuser door 120' is kept in the completely opened state.

The guiding groove 7 further includes the second guiding groove 72 with a smooth arc contour line. The second guiding groove 72 is concentric with the central axis 630 of the output end rotating wheel 63. The radius of the second guiding groove 72 is R. One end of the second guiding groove 72 is communicated or connected with the terminal end 712 of the first guiding groove, and the other end of the second guiding groove is spaced apart from the terminal end 712 of the first guiding groove by a preset distance.

The distance between the terminal end 712 of the first guiding groove and the central axis 630 is D, and R=D.

With this arrangement, after the effuser door 120' is completely opened, if the driving mechanism 6 drives the output end rotating wheel 63 to continuously rotate, the side plate pin shaft 122 slides into the second guiding groove 72 from the terminal end 712 of the first guiding groove. Because R=D, when the side plate pin shaft 122 slides in the second guiding groove 72, the effuser door 120' is kept in the completely opened state.

The radius of the second guiding groove 72 affects an opening angle, and the larger the R is, the larger the opening angle of the effuser door 120' is. A length of the second guiding groove 72 affects a holding time of opening the door. The longer the length of the second guiding groove 72 is, the longer the effuser door 120' is kept in the completely opened state.

By reasonably designing the contour of the guiding groove 7, the opening and closing states of the effuser door 120' can be controlled to meet different requirements.

When the effuser door 120' needs to be closed, the effuser door 120' starts to close when the side plate pin shaft 122 slides from the second guiding groove 72 into the terminal end 712 of the first guiding groove. When the side plate pin shaft 122 slides to the initial end 711 of the first guiding groove, the effuser door 120' is completely closed.

In one embodiment, as shown in FIG. 14, a central angle of the second guiding groove is $\alpha$, then $180° \leq \alpha < 360°$. An arc of the second guiding groove 72 is relatively long, which is a major arc, and the effuser door 120' is kept in the completely opened state for a long time, which can satisfy the need for a user to use the effuser 2 for a period of time.

In one embodiment, as shown in FIGS. 28 and 29, the driving mechanism 6 further includes a drive motor 61 and a transmission device 62.

The transmission device 62 is connected between the output end rotating wheel 63 and the drive motor 61.

The drive motor 61 and the transmission device 62 are respectively mounted on one side of the box body 10 on which the output end rotating wheel 63 is located. The drive motor 61 is a forward and reverse rotation motor, which can realize forward rotation and reverse rotation. If the effuser door 120' is opened when the drive motor 61 rotates forward, then the effuser door 120' is closed when the drive motor 61 rotates reversely. If the effuser door 120' is opened when the drive motor 61 rotates reversely, then the effuser door 120' is closed when the drive motor 61 rotates forward.

The transmission device 62 may be a gear set, a belt set, or the like, and is used to transmit a torque of the drive motor 61 to the output end rotating wheel 63 to drive the output end rotating wheel 63 to rotate.

In one embodiment, as shown in FIG. 29, a circumference surface of the output end rotating wheel 63 is provided with a circle of wheel teeth 631.

The transmission device 62 includes a transmission device output gear 624. The transmission device output gear 624 is meshed with the output end rotating wheel 63.

In this embodiment, the output end rotating wheel 63 is an output end gear, and the circumference surface of the output end rotating wheel 63 is provided with the teeth 631. An output end of the transmission device 62 is provided with the transmission device output gear 624. During assembly, the transmission device output gear 624 is meshed with the output end rotating wheel 63 to realize gear meshing transmission, which has high transmission efficiency and better drives the output end rotating wheel 63 to rotate.

In one embodiment, as shown in FIG. 29, an output shaft of the drive motor 61 is provided with a motor gear 611.

The transmission device 62 further includes a transmission device input gear 621 and a transmission device drive gear 622, and the transmission device drive gear 622 is in transmission connection with the transmission device input gear 621.

The transmission device input gear 621 is meshed with the motor gear 611, and the transmission device drive gear 622 is meshed with the transmission device output gear 624.

The motor gear 611 is mounted on the output shaft of the drive motor 61. The transmission device 62 includes the transmission device input gear 621, the transmission device drive gear 622 and the transmission device output gear 624. The transmission device input gear 621 and the transmission device drive gear 622 are in transmission connection, which may be connected by a gear set, a transmission belt or a transmission chain 623, as long as the transmission device input gear 621 can drive the transmission device drive gear 622 to rotate.

During assembly, the transmission device input gear 621 is meshed with the motor gear 611, the transmission device input gear 621 is in transmission connection with the transmission device drive gear 622, the transmission device drive gear 622 is meshed with the transmission device output gear 624, and the transmission device output gear 624 is meshed with the output end rotating wheel 63. A torque of the drive motor 61 may be transmitted to the output end rotating wheel 63 through the motor gear 611, the transmission device input gear 621, the transmission device drive gear 622 and the transmission device output gear 624 in turn, to finally drive the output end rotating wheel 63 to rotate.

As shown in FIGS. 34 and 35, an effuser device provided by an embodiment of the present disclosure includes a telescopic effuser 2 and the effuser mounting box described in any of the above embodiments.

The effuser 2 is mounted in the box body 10 of the effuser mounting box.

When the effuser 2 is in a retracted state, the effuser 2 is integrally located in the box body 10, and the effuser door 120' closes the box body opening 114 of the box body 10.

When the effuser 2 is in an extended state, the effuser door 120' opens the box body opening 114 of the box body 10, and an end portion of the effuser 2 provided with a nozzle 23 extends from the box body opening 114.

The effuser device provided by the embodiment mainly includes the effuser 2 and the effuser mounting box.

Please refer to the above description of the effuser mounting box for the structure, the construction and the working principle of the effuser mounting box, which are not elaborated herein.

The effuser 2 is telescopic, which can extend or retract.

In an initial state, the effuser 2 is kept in a retracted state, the entire effuser 2 is located in the box body 10, the effuser door 120' is in a closed state, and the effuser door 120' closes the box body opening 114 of the box body 10.

When a user needs to use the effuser 2, the user operates an operation button on an intelligent toilet, and the driving mechanism 6 first drives the effuser door 120' to open the box body opening 114. Then, a control mechanism of the effuser 2 makes the effuser 2 extend from or move forward in the box body 10, and finally the end portion of the effuser 2 with the nozzle 23 extends out of the box body opening 114, so that the user can use water sprayed from the nozzle 23 to clean a private part of a body of the user.

In conclusion, according to the effuser mounting box and the effuser device provided by the present disclosure, the output end of the driving mechanism is connected to the effuser door by setting the driving mechanism, and the driving mechanism opens the effuser door before the effuser needs to extend, so that the effuser can smoothly extend from the box body opening without being contacted with the effuser door. After the effuser retracts, the driving mechanism drives the effuser door to close. During extending and retracting of the effuser, the effuser is unable to touch the effuser door, so that the extending movement of the effuser is smoother and the effuser is unable to be in frictional contact with the effuser door, which can reduce the noise during system operation.

According to needs, the above technical solutions may be combined to achieve the best technical effect.

The present disclosure discloses an effuser mounting box and an effuser device, wherein the effuser mounting box includes a box body for mounting an effuser, an effuser door pivotally connected with the box body and a driving mechanism for driving the effuser door to turn upward and downward; a front end of the box body is provided with a box body opening for the effuser to extend out; an upper end of the effuser door is connected with the box body and the effuser door is capable of opening and closing the box body opening; and the driving mechanism is mounted on the box body and an output end of the driving mechanism is connected with the effuser door. According to the effuser mounting box and the effuser device disclosed by the present disclosure, during extending and retracting of the effuser, the effuser is unable to touch the effuser door, so that the extending movement of the effuser is smoother and the effuser is unable to be in frictional contact with the effuser door, which can reduce the noise during system operation.

Fifth Embodiment: Effuser Device

Figure 36:
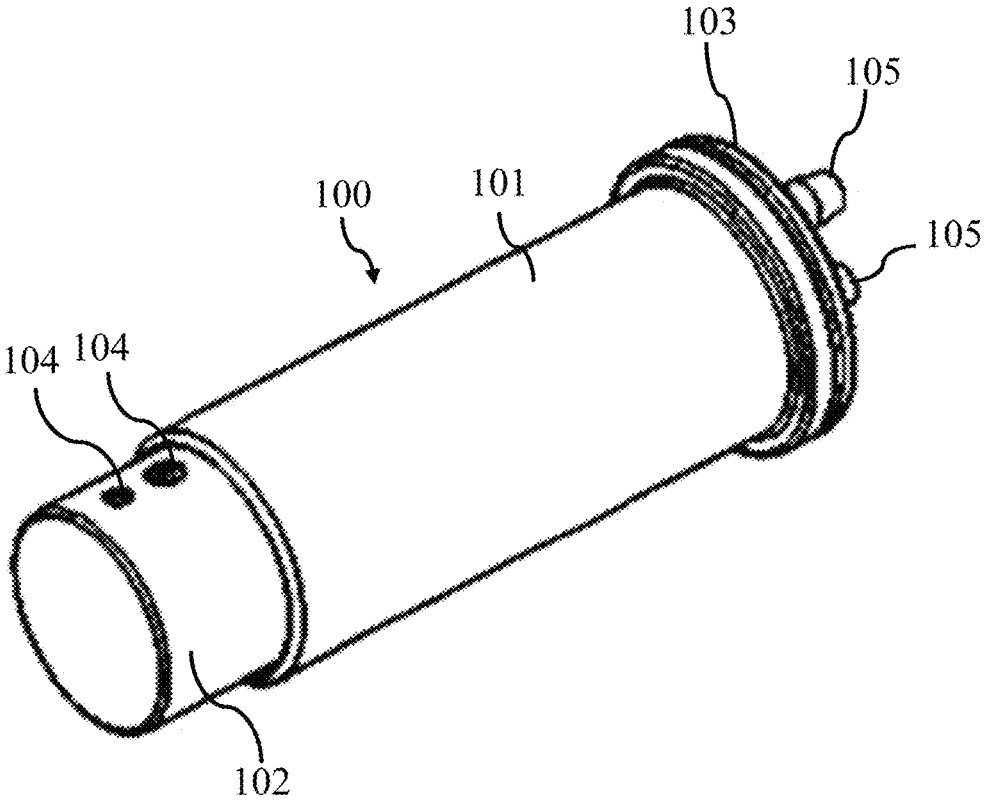
FIG. 36 is a perspective view of an effuser device provided by an embodiment of the present disclosure, wherein an inner sleeve is in a retracted state.
Figure 37:
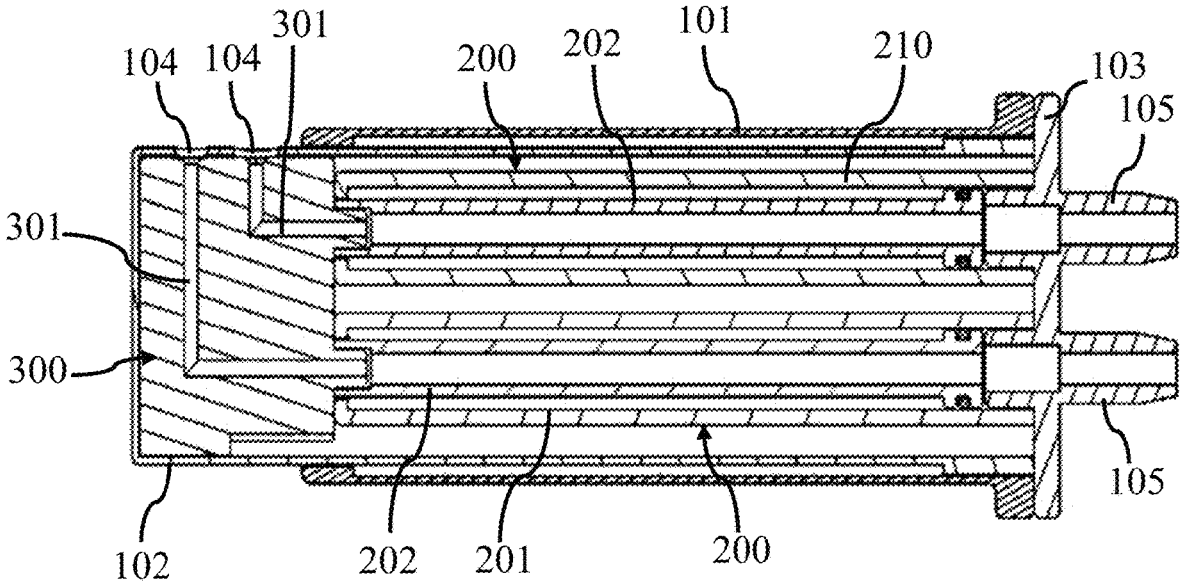
FIG. 37 is a sectional view of the effuser device provided by the embodiment of the present disclosure, wherein the inner sleeve is in the retracted state.
Figure 38:
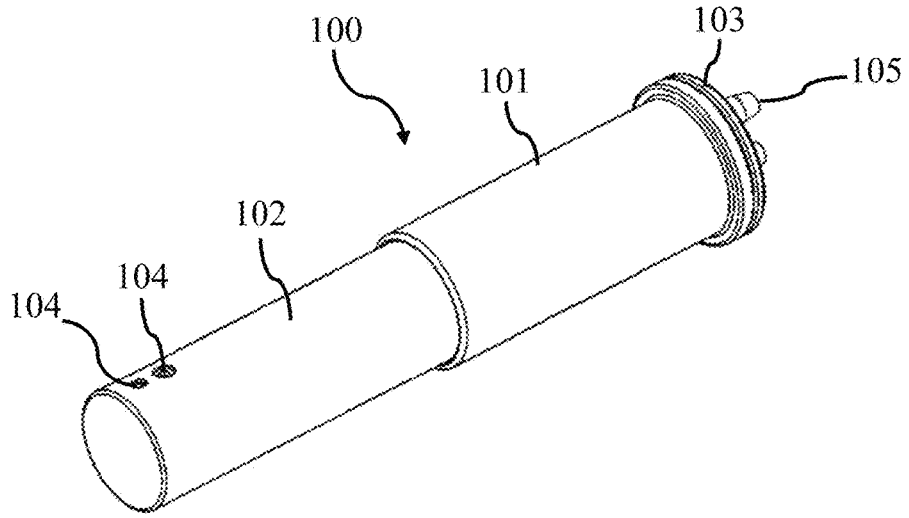
FIG. 38 is a perspective view of the effuser device provided by the embodiment of the present disclosure, wherein the inner sleeve is in an extended state.
Figure 39:
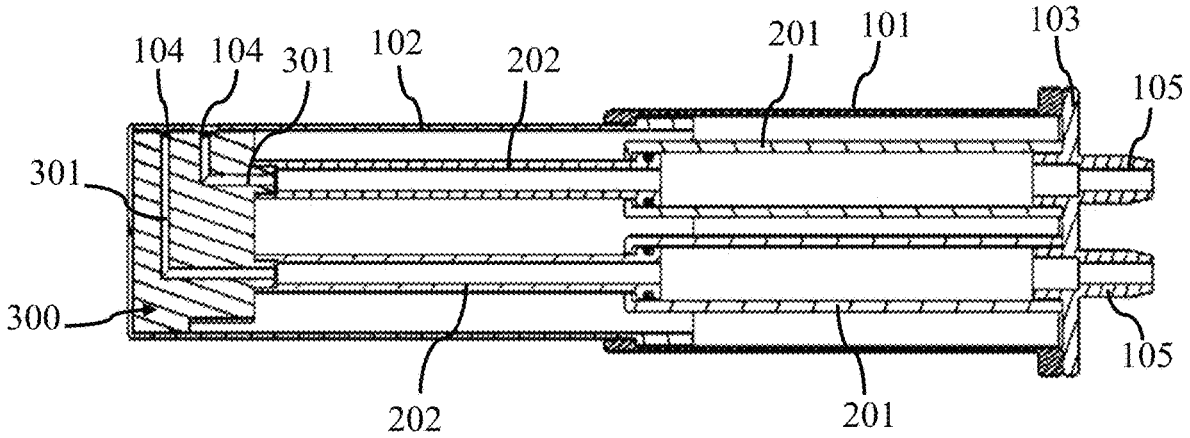
FIG. 39 is a sectional view of the effuser device provided by the embodiment of the present disclosure, wherein the inner sleeve is in the extended state.
Figure 44:
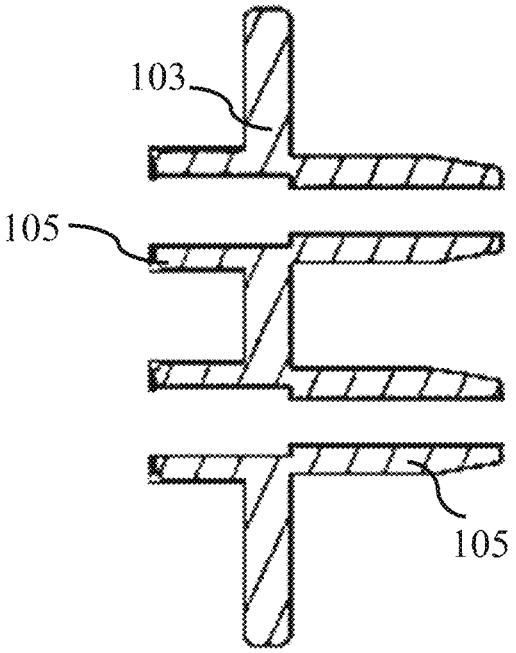
FIG. 44 is a sectional view of a water pipe joint and a sleeve end cover.
Figure 45:
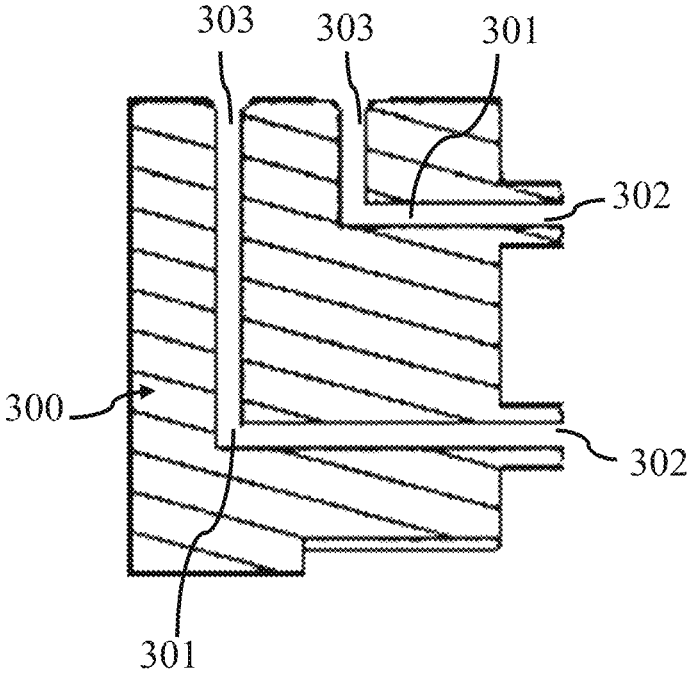
FIG. 45 is a section view of a nozzle.

FIG. 36 is a perspective view of an effuser device provided by an embodiment of the present disclosure, wherein an inner sleeve is in a retracted state. FIG. 37 is a sectional view of the effuser device provided by the embodiment of the present disclosure, wherein the inner sleeve is in the retracted state. FIG. 38 is a perspective view of the effuser device provided by the embodiment of the present disclosure, wherein the inner sleeve is in an extended state. FIG. 39 is a sectional view of the effuser device provided by the embodiment of the present disclosure, wherein the inner sleeve is in the extended state. FIG. 44 is a sectional view of a water pipe joint and a sleeve end cover. FIG. 45 is a section view of a nozzle.

As shown in FIGS. 36, 37, 38, 39, 44, and 45, an effuser device provided by an embodiment of the present disclosure includes a telescopic protection sleeve 100, a telescopic water supply casing 200 and a nozzle 300 with a water flow channel 301.

The protection sleeve 100 includes an outer sleeve 101 and an inner sleeve 102 slidably connected with the outer sleeve 101.

The water supply casing 200 includes an outer casing 201 and an inner casing 202 slidably connected with the outer casing 201.

A sleeve end cover 103 is mounted at one end of the outer sleeve 101, the sleeve end cover 103 is provided with a water pipe joint 105 for being connected with an external water supply pipe, and one end of the inner sleeve 102 far away from the sleeve end cover 103 is provided with a liquid spraying hole 104.

The nozzle 300 is mounted in the inner sleeve 102, and a water outlet end 303 of the water flow channel 301 is communicated with the liquid spraying hole 104.

The outer casing 201 is fixedly mounted in the outer sleeve 101, and one end of the outer casing 201 is connected to the water pipe joint 105. One end of the inner casing 202 is slidably mounted in the outer casing 201, and the other end of the inner casing 202 is connected to a water inlet end 302 of the water flow channel 301.

The effuser device provided by the present disclosure can be mounted in an intelligent toilet.

The effuser device is telescopic and includes the protection sleeve 100, the water supply casing 200 and the nozzle 300.

The protection sleeve 100 has a telescopic structure, which includes the outer sleeve 101 and the inner sleeve 102, wherein the outer sleeve 101 is sheathed on the inner sleeve 102, and the inner sleeve 102 is in clearance fit or sliding connection with the outer sleeve 101, so that the inner sleeve 102 can slide relative to the outer sleeve 101, and the inner sleeve 102 can extend and retract. During mounting, the inner sleeve 102 may be driven to extend and retract by a driving mechanism in the toilet. The driving mechanism may be an air cylinder, and a cylinder body of the air cylinder is fixedly mounted in a mounting space of the toilet; a lug is mounted on the wall of the inner sleeve 102; a piston rod of the air cylinder is connected to the lug; and the inner sleeve 102 is driven to extend and retract by the air cylinder. The driving mechanism may also be a combination of a motor, a gear set and a rack. The rack is mounted on the wall of the inner sleeve 102, the motor is mounted in the mounting space of the toilet, an input gear in the gear set is mounted on a motor shaft of the motor, an output gear in the gear set meshes with the rack, the motor drives the gear set to rotate, and the output gear meshes with the rack to drive the inner sleeve 102 to extend and retract.

The water supply casing 200 has a telescopic structure, which includes the outer casing 201 and the inner casing 202, wherein the outer casing 201 is sheathed on the inner casing 202, and the inner casing 202 is in clearance fit or sliding connection with the outer casing 201, so that the inner casing 202 can slide relative to the outer casing 201, and the inner casing 202 can extend and retract.

The sleeve end cover 103 is mounted at a rear end of the outer sleeve 101, the water pipe joint 105 is mounted on the sleeve end cover 103, and the water pipe joint 105 is used for being connected with an external water supply pipe or an external water supply hose, so as to supply water to the effuser device. A front end of the inner sleeve 102 is provided with the liquid spraying hole 104.

The nozzle 300 is fixedly mounted in the front end of the inner sleeve 102, the outer casing 201 is fixedly mounted in the outer sleeve 101, a rear end of the outer casing 201 is fixedly connected with the water pipe joint 105, a front end of the inner casing 202 is connected with the water inlet end 302 of the water flow channel 301, and the water outlet end 303 of the water flow channel 301 is communicated with the liquid spraying hole 104.

When the inner sleeve 102 is driven to extend and retract, the nozzle 300 moves integrally with the inner sleeve 102, and the nozzle 300 drives the inner casing 202 to move integrally, thereby realizing the extending and retracting of the inner casing 202.

In this way, in the effuser device provided by the present disclosure, when the inner sleeve 102 extends and retracts, the inner casing 202 synchronously extends and retracts with the inner sleeve 102, and the water supply casing 200 is always kept in the protection sleeve 100, which can effectively save an external space of the protection sleeve 100, and is beneficial to spatial layout of other functions of an intelligent toilet and mounting of the effuser device.

In one embodiment, as shown in FIG. 37 and FIG. 39, the effuser device includes more than two water supply casings 200.

Accordingly, the sleeve end cover 103 is provided with more than two water pipe joints 105, the nozzle 300 includes more than two water flow channels 301, and the inner sleeve 102 is provided with more than two liquid spraying holes 104.

Each outer casing 201 is correspondingly connected with one water pipe joint 105, each inner casing 202 is correspondingly connected with the water inlet end 302 of one water flow channel 301, and the water outlet end 303 of each water flow channel 301 is correspondingly communicated with one liquid spraying hole 104.

By arranging more than two water supply casings 200, more than two water pipe joints 105, more than two water flow channels 301 and more than two liquid spraying holes 104, each water supply casing 200 is communicated between one water pipe joint 105 and one water flow channel 301, and each water flow channel 301 is correspondingly communicated with one liquid spraying hole 104, so that water can be supplied by multiple waterways, and the liquid spraying hole 104 may also be arranged in different forms to realize different spraying water types.

Figure 42:
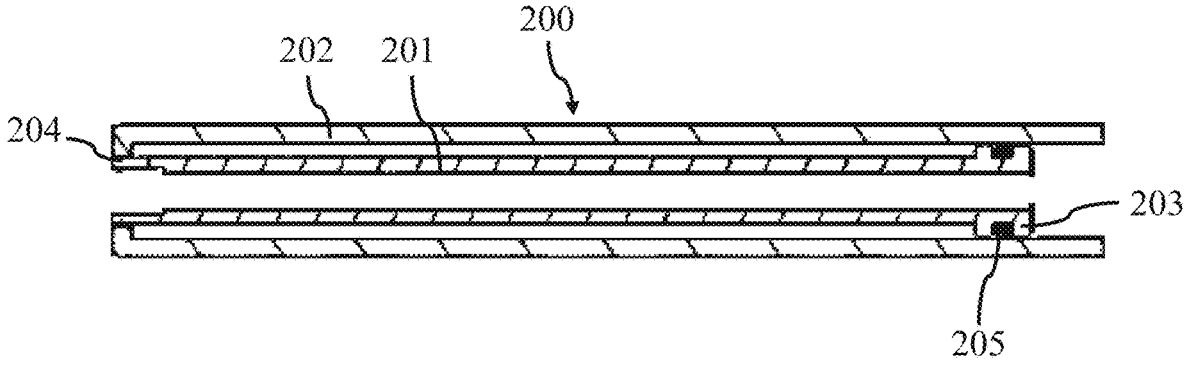
FIG. 42 is a sectional view of a water supply casing when an inner casing is in a retracted state.
Figure 43:
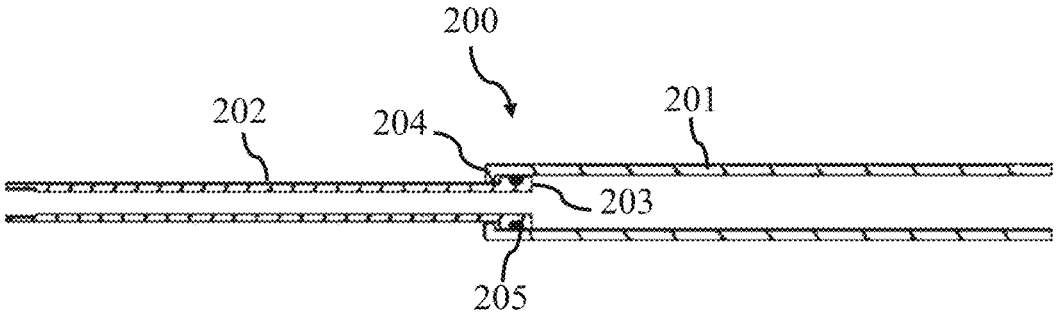
FIG. 43 is a sectional view of the water supply casing when the inner casing is in an extended state.

FIG. 42 is a sectional view of a water supply casing when an inner casing is in a retracted state. FIG. 43 is a sectional view of the water supply casing when the inner casing is in an extended state.

In one embodiment, as shown in FIGS. 42 and 43, a sealing ring 205 is arranged between the inner casing 202 and the outer casing 201 to seal the inner and outer casings and avoid water leakage.

In one embodiment, as shown in FIGS. 42 and 43, one end of the inner casing 202 facing the sleeve end cover 103 is provided with a casing boss 203. The casing boss 203 is in clearance fit with a wall of the outer casing 201.

An end portion of the outer casing 201 facing the nozzle 300 is provided with an annular baffle 204 for stopping the casing boss 203.

The casing boss 203 is arranged at a rear end of the inner casing 202, which projects toward the wall of the outer casing 201, and the casing boss 203 is annularly arranged. The casing boss 203 is in clearance fit or sliding connection with the wall of the outer casing 201. The annular baffle 204 is arranged at the front end of the inner casing 202, which extends toward a wall of the inner casing 202 and is used for stopping and limiting the casing boss 203. An inner diameter of the annular baffle 204 is smaller than an outer diameter of the casing boss 203, and the inner diameter of the annular baffle 204 is larger than an outer diameter of the inner casing 202. During mounting, the front end of the inner casing 202 is inserted from the rear end of the outer casing 201, and the casing boss 203 slides into the outer casing 201 from the rear end of the outer casing 201. When the inner casing 202 extends and the casing boss 203 is stopped by the annular baffle 204, the inner casing 202 extends to the longest distance.

In one embodiment, as shown in FIGS. 42 and 43, the sealing ring 205 is arranged between the casing boss 203 and the wall of the outer casing 201. The casing boss 203 is provided with a groove. The sealing ring 205 is mounted in the groove, and the sealing ring 205 is sealed between the outer casing 201 and the casing boss 203. The sealing ring 205 is a rubber sealing ring. When the inner casing 202 moves relative to the outer casing 201, the sealing ring 205 moves relative to the wall of the outer casing 201 along with the casing boss 203, and keeps to be sealed with the wall of the outer casing 201.

Figure 40:
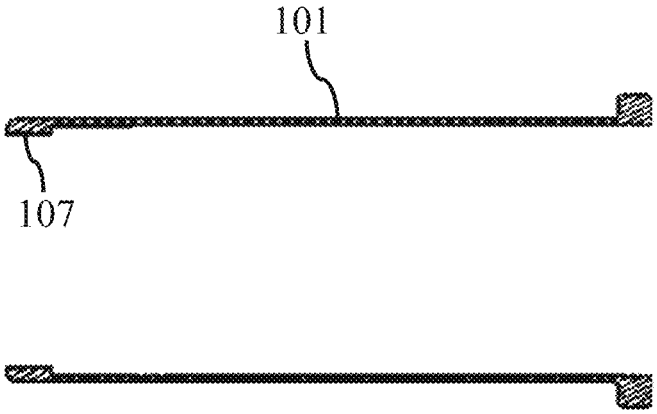
FIG. 40 is a sectional view of an outer sleeve.
Figure 41:
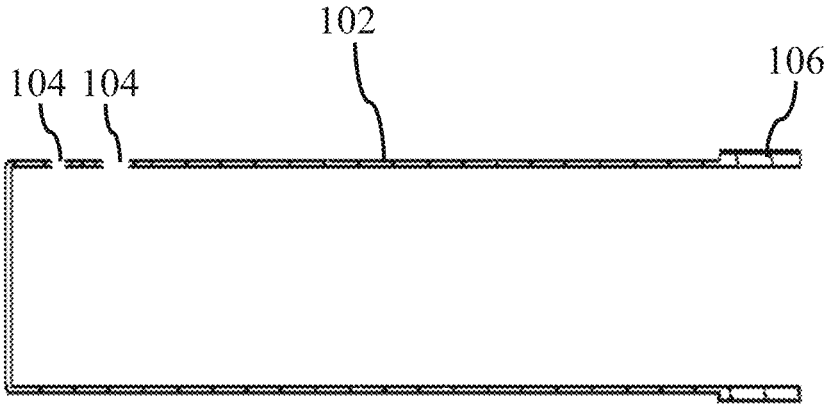
FIG. 41 is a sectional view of the inner sleeve.

FIG. 40 is a sectional view of an outer sleeve. FIG. 41 is a sectional view of the inner sleeve. In one embodiment, as shown in FIGS. 40 and 41, one end of the inner sleeve 102 facing the sleeve end cover 103 is provided with an inner sleeve boss 106. The inner sleeve boss 106 is in clearance fit with a wall of the outer sleeve 101.

An end portion of the outer sleeve 101 facing the nozzle 300 is provided with an outer sleeve boss 107 for stopping the inner sleeve boss 106.

When the inner sleeve 102 moves outward to the maximum distance, the inner sleeve boss 106 is contacted with the outer sleeve boss 107 to restrict the inner sleeve 102 to move. After the inner sleeve 102 retracts in place, the inner sleeve 102 is contacted with the sleeve end cover 103, and the sleeve end cover 103 limits the inner sleeve 102.

Both the inner sleeve boss 106 and the outer sleeve boss 107 are annular. The inner sleeve boss 106 is arranged at a rear end of the inner sleeve 102, and projects and extends toward the wall of the outer sleeve 101. The outer sleeve boss 107 is arranged at a front end of the outer sleeve 101 and extends toward the wall of the inner sleeve 102.

An outer diameter of the inner sleeve boss 106 is smaller than an inner diameter of the outer sleeve 101 and greater than an inner diameter of the outer sleeve boss 107. The inner diameter of the outer sleeve boss 107 is greater than an outer diameter of the inner sleeve 102.

During mounting, the front end of the inner sleeve 102 is inserted from a rear end of the outer sleeve 101, and the inner sleeve boss 106 slides into the outer sleeve 101 from the rear end of the outer sleeve 101. When the inner sleeve 102 extends and the inner sleeve boss 106 is stopped by the outer sleeve boss 107, the inner sleeve 102 extends to the longest distance.

In one embodiment, as shown in FIGS. 36 to 39, the inner sleeve 102 has an inner sleeve extended state and an inner sleeve retracted state.

When the inner sleeve 102 is in the inner sleeve retracted state, the end portion of the inner sleeve 102 provided with the liquid spraying hole 104 is located outside the outer sleeve 101, and at least one liquid spraying hole 104 is located outside the outer sleeve.

With this arrangement, even if the inner sleeve 102 is in the retracted state, liquid can be sprayed outwards through the liquid spraying hole 104 for cleaning by users, thus meeting the needs of different people.

In one embodiment, as shown in FIGS. 36, 37, 38, 39, 42, and 43, the inner casing 202 has an inner casing extended state and an inner casing retracted state.

When the inner sleeve 102 is in the inner sleeve extended state, the inner casing 202 is in the inner casing extended state, the inner sleeve 102 extends from the outer sleeve 101, and the inner casing 202 extends from the outer casing 201.

When the inner sleeve 102 is in the inner sleeve retracted state, the inner casing 202 is in the inner casing retracted state, a part of the inner sleeve 102 retracts into the outer sleeve 101, and at least a part of the inner casing 202 retracts into the outer casing 201.

The extending and retracting of the inner casing 202 are synchronized with that of the inner sleeve 102, and the extending and retracting of the inner casing 202 are driven by the inner sleeve 102. When the inner sleeve 102 is driven to extend, the inner casing 202 is pulled to extend, and when the inner sleeve 102 is driven to retract, the inner casing 202 is pushed to retract.

According to needs, the driving mechanism may be controlled to control the inner sleeve 202 to extend and retract for a specified distance to meet the needs of different users. For example, the piston rod of the air cylinder can be extended and retracted for a specified distance, and the motor can rotate for a specified number of turns.

In one embodiment, as shown in FIG. 37 and FIG. 42, when the inner casing 202 is in the inner casing retracted state, the whole inner casing 202 is retracted into the outer casing 201, which can shorten an axial size of the effuser device.

In one embodiment, the inner casing 202 and the outer casing 201 are hard water pipes respectively. The hard water pipes may be plastic pipes, PVC pipes, metal pipes, and the like, which are convenient to mount in the protection sleeve 100 and realize extending and retracting with the inner sleeve 102.

According to the effuser device provided by the present disclosure, the telescopic water supply casing is arranged in the telescopic protection sleeve, the outer casing of the water supply casing is fixedly mounted in the outer sleeve of the protection sleeve, the inner casing of the water supply casing is located in the inner sleeve of the protection sleeve, the water inlet of the outer casing is connected with the water pipe joint on the sleeve end cover, and the water outlet of the inner sleeve is connected with the water inlet end of the water flow channel of the nozzle. When the inner sleeve extends and retracts, the inner casing extends and retracts synchronously with the inner sleeve, and the water supply casing is always kept in the protection sleeve, which can effectively save the external space of the protection sleeve and is beneficial to the spatial layout of other functions of the intelligent toilet and the mounting of the effuser device.

According to needs, the above technical solutions may be combined to achieve the best technical effect.

The present disclosure discloses an effuser device including a protection sleeve, a water supply casing and a nozzle. The protection sleeve includes an outer sleeve and an inner sleeve; the water supply casing includes an outer casing and an inner casing; a sleeve end cover of the outer sleeve is provided with a water pipe joint and the inner sleeve is provided with a liquid spraying hole; the nozzle is mounted in the inner sleeve, and a water outlet end of a water flow channel is communicated with the liquid spraying hole; and one end of the outer casing is connected with the water pipe joint; one end of the inner casing is slidably mounted in the outer casing, and the other end of the inner casing is connected with a water inlet end of the water flow channel. In the effuser device disclosed by the present disclosure, when the inner sleeve extends and retracts, the inner casing extends and retracts synchronously with the inner sleeve, and the water supply casing is always kept in the protection sleeve, which can effectively save an external space of the protection sleeve, and is beneficial to spatial layout of other functions of an intelligent toilet and mounting of the effuser device.

A controller may be included in the first, second, third, fourth, and fifth embodiment and can be implemented by any appliances. The controller may include a processor, a memory, and a communication interface for interfacing with the devices as discussed in the present disclosure. The components of the controller may communicate using a bus. The controller may be connected to a workstation or another external device (e.g., control panel, remote) and/or a database for receiving user inputs, system characteristics, and any of the values described herein. Optionally, the controller may include an input device and/or a sensing circuit in communication with any of the sensors. The sensing circuit receives sensor measurements from as described above. Optionally, the controller may include a drive unit for receiving and reading non-transitory computer media having instructions. Additional, different, or fewer components may be included. The processor is configured to perform instructions stored in memory for executing the algorithms described herein.

The processor may be a general purpose or specific purpose processor, an application specific integrated circuit (ASIC), one or more programmable logic controllers (PLCs), one or more field programmable gate arrays (FPGAs), a group of processing components, or other suitable processing components. The processor is configured to execute computer code or instructions stored in memory or received from other computer readable media (e.g., embedded flash memory, local hard disk storage, local ROM, network storage, a remote server, etc.). The processor may be a single device or combinations of devices, such as associated with a network, distributed processing, or cloud computing.

The memory may include one or more devices (e.g., memory units, memory devices, storage devices, etc.) for storing data and/or computer code for completing and/or facilitating the various processes described in the present disclosure. The memory may include random access memory (RAM), read-only memory (ROM), hard drive storage, temporary storage, non-volatile memory, flash memory, optical memory, or any other suitable memory for storing software objects and/or computer instructions. The memory may include database components, object code components, script components, or any other type of information structure for supporting the various activities and information structures described in the present disclosure. The memory may be communicably connected to processor via a processing circuit and may include computer code for executing (e.g., by processor) one or more processes described herein. For example, memory may include graphics, web pages, HTML files, XML files, script code, shower configuration files, or other resources for use in generating graphical user interfaces for display and/or for use in interpreting user interface inputs to make command, control, or communication decisions.

In addition to ingress ports and egress ports, the communication interface may include any operable connection. An operable connection may be one in which signals, physical communications, and/or logical communications may be sent and/or received. An operable connection may include a physical interface, an electrical interface, and/or a data interface. The communication interface may be connected to a network. The network may include wired networks (e.g., Ethernet), wireless networks, or combinations thereof. The wireless network may be a cellular telephone network, an 802.11, 802.16, 802.20, or WiMax network, a Bluetooth pairing of devices, or a Bluetooth mesh network. Further, the network may be a public network, such as the Internet, a private network, such as an intranet, or combinations thereof, and may utilize a variety of networking protocols now available or later developed including, but not limited to TCP/IP based networking protocols.

While the computer-readable medium (e.g., memory) is shown to be a single medium, the term "computer-readable medium" includes a single medium or multiple media, such as a centralized or distributed database, and/or associated caches and servers that store one or more sets of instructions. The term "computer-readable medium" shall also include any medium that is capable of storing, encoding, or carrying a set of instructions for execution by a processor or that cause a computer system to perform any one or more of the methods or operations disclosed herein.

In a particular non-limiting, exemplary embodiment, the computer-readable medium can include a solid-state memory such as a memory card or other package that houses one or more non-volatile read-only memories. Further, the computer-readable medium can be a random-access memory or other volatile re-writable memory. Additionally, the computer-readable medium can include a magneto-optical or optical medium, such as a disk or tapes or other storage device to capture carrier wave signals such as a signal communicated over a transmission medium. A digital file attachment to an e-mail or other self-contained information archive or set of archives may be considered a distribution medium that is a tangible storage medium. Accordingly, the disclosure is considered to include any one or more of a computer-readable medium or a distribution medium and other equivalents and successor media, in which data or instructions may be stored. The computer-readable medium may be non-transitory, which includes all tangible computer-readable media.

In an alternative embodiment, dedicated hardware implementations, such as application specific integrated circuits, programmable logic arrays and other hardware devices, can be constructed to implement one or more of the methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

The above only describes the principle and the embodiments of the present disclosure. It should be pointed out that for those of ordinary skills in the art, several other modifications can be made on the basis of the principle of the present disclosure, which should also be deemed to fall within the scope of protection of the present disclosure.

I claim:

1. A water spraying device, comprising:

a housing comprising:

a mechanism mounting cavity, an effuser mounting cavity disposed in front of the mechanism mounting cavity, and a water pipe accommodating cavity disposed on the mechanism mounting cavity and in communication with the effuser mounting cavity;

an effuser comprising a nozzle and configured to move in the effuser mounting cavity;

a water supply hose, at least a portion of the water supply hose disposed in the water pipe accommodating cavity and configured to supply water and move in the water pipe accommodating cavity;

a driving mechanism disposed in the mechanism mounting cavity and configured to drive the effuser to move linearly; and a transmission mechanism connecting the driving mechanism to the effuser, wherein the housing comprises a housing water inlet and the effuser comprises an effuser water inlet, and wherein the water supply hose is connected between the housing water inlet and the effuser water inlet.

2. The water spraying device according to claim 1, wherein the water pipe accommodating cavity extends in a horizontal direction, and wherein a height of the water pipe accommodating cavity is smaller than a length of the water pipe accommodating cavity in a front-back direction.

3. The water spraying device according to claim 1, wherein the housing water inlet is disposed at a front portion of the water pipe accommodating cavity, and wherein the water supply hose is curved in the water pipe accommodating cavity.

4. The water spraying device according to claim 1, wherein the water supply hose is wrapped with a hose sheath.

5. The water spraying device according to claim 1, wherein the effuser has an initial position and a forward position in the effuser mounting cavity and is configured to be switched between the initial position and the forward position, and wherein when the effuser is disposed in the forward position, at least a portion of the water supply hose is disposed in the water pipe accommodating cavity.

6. The water spraying device according to claim 1, wherein at least a portion of the water supply hose is maintained in contact with a top surface of the water pipe accommodating cavity.

7. The water spraying device according to claim 1, wherein the driving mechanism comprises a drive motor, wherein the transmission mechanism comprises a transmission gear set and a transmission chain, wherein an output shaft of the drive motor is connected to a gear shaft of an input end gear in the transmission gear set, and wherein the transmission chain is engaged with an output end gear in the transmission gear set and the transmission chain is fixedly connected to the effuser.

8. The water spraying device according to claim 1, wherein the housing comprises a first housing and a second housing connected to the first housing.

9. The water spraying device according to claim 1, wherein a guide mechanism is disposed in the effuser mounting cavity and the effuser is movable with respect to the guide mechanism.

* * * * *